US008329008B2

(12) United States Patent
Maekawa et al.

(10) Patent No.: US 8,329,008 B2
(45) Date of Patent: Dec. 11, 2012

(54) GAS GENERATING DEVICE AND CARBON ELECTRODE FOR GAS GENERATION

(75) Inventors: Hiroshi Maekawa, Sodegaura (JP); Mitsuru Sadamoto, Sodegaura (JP); Souta Itou, Ichihara (JP); Takahiro Maeda, Sodegaura (JP); Kentaro Suzuki, Musashino (JP); Tetsuya Watanabe, Musashino (JP)

(73) Assignee: Mitsui Chemicals, Inc., Minato-Ku, Tokyo (JP)

( * ) Notice: Subject to any disclaimer, the term of this patent is extended or adjusted under 35 U.S.C. 154(b) by 283 days.

(21) Appl. No.: 12/596,911

(22) PCT Filed: Apr. 22, 2008

(86) PCT No.: PCT/JP2008/001050
§ 371 (c)(1),
(2), (4) Date: Jan. 5, 2010

(87) PCT Pub. No.: WO2008/132836
PCT Pub. Date: Nov. 6, 2008

(65) Prior Publication Data

US 2010/0116649 A1 May 13, 2010

(30) Foreign Application Priority Data

Apr. 23, 2007 (JP) ..... 2007-112974
Aug. 31, 2007 (JP) ..... 2007-225943

(51) Int. Cl.
*C25B 9/06* (2006.01)

(52) U.S. Cl. ..... 204/275.1; 204/278; 204/278.5; 204/284; 204/294

(58) Field of Classification Search ..... 205/619–620; 204/275.1, 278, 278.5, 284, 294
See application file for complete search history.

(56) References Cited

U.S. PATENT DOCUMENTS

| | | | | |
|---|---|---|---|---|
| 4,260,469 | A | 4/1981 | McIntyre et al. | |
| 4,511,440 | A | 4/1985 | Saprokhin et al. | |
| 7,318,976 | B2 * | 1/2008 | Koschany | 429/510 |
| 2004/0238374 | A1 * | 12/2004 | Tojo et al. | 205/619 |
| 2007/0199828 | A1 | 8/2007 | Tasaka et al. | |
| 2008/0053840 | A1 | 3/2008 | Arihara et al. | |

(Continued)

FOREIGN PATENT DOCUMENTS

EP 1 754 804 A1 2/2007

(Continued)

OTHER PUBLICATIONS

Office Action from Chinese Patent Office issued in corresponding Chinese Patent Application No. 200880019419.4 dated Jan. 30, 2011.

(Continued)

*Primary Examiner* — Bruce Bell
(74) *Attorney, Agent, or Firm* — Buchanan Ingersoll & Rooney PC

(57) ABSTRACT

A gas generating device of present invention is generated a first gas at a first carbon electrode by applying a voltage between said first carbon electrode and a second electrode to electrolyzing an electrolytic solution. The first carbon electrode is an anode or a cathode. The first carbon electrode is provided with a plurality of fine gas flow channels which selectively pass said first gas generated on one surface of said first carbon electrode to the other surface without allowing said electrolytic solution to permeate therethrough.

12 Claims, 31 Drawing Sheets

U.S. PATENT DOCUMENTS

| | | | | |
|---|---|---|---|---|
| 2010/0092724 | A1* | 4/2010 | Shiroya et al. | 428/131 |
| 2010/0126875 | A1* | 5/2010 | Maekawa et al. | 205/619 |

FOREIGN PATENT DOCUMENTS

| | | | |
|---|---|---|---|
| JP | 56-130484 | A | 10/1981 |
| JP | 57-200584 | A | 12/1982 |
| JP | 60-155502 | A | 8/1985 |
| JP | 9-1151 | | 1/1997 |
| JP | 11-236693 | A | 8/1999 |
| JP | 3081949 | U | 11/2001 |
| JP | 2002-110182 | A | 4/2002 |
| JP | 2002-339090 | A | 11/2002 |
| JP | 2003-27270 | A | 1/2003 |
| JP | 2005-038738 | A | 2/2005 |
| JP | 2005-270732 | A | 10/2005 |
| JP | 2005-336607 | A | 12/2005 |
| JP | 2006-045625 | A | 2/2006 |
| JP | 2006-291297 | A | 10/2006 |

OTHER PUBLICATIONS

International Search Report for PCT/JP2008/001050 completed Jul. 8, 2008.

* cited by examiner (a)

(b)

100

(a)

(b)

300b (a)

(b)

(c)

(a)

(b)

GAS GENERATING DEVICE AND CARBON ELECTRODE FOR GAS GENERATION

TECHNICAL FIELD

The present invention relates to a gas generating device and a carbon electrode for gas generation.

BACKGROUND ART

A fluorine gas with high activity has been examined as a cleaning gas for use in manufacturing semiconductor devices. Furthermore, the fluorine gas has also been paid attention to as a gas excellent in the environment because its warming potential is low and its effect on the depletion of the ozone layer is small as well. However, too much pressure cannot be applied at the time of carrying out pressurized charging into a gas cylinder since the fluorine gas involves some risk of explosion. Accordingly, there were problems such that it was difficult to handle and the transportation cost was incurred.

In Patent Document 1 (Japanese Patent Laid-open No. 2002-339090), there has been disclosed an apparatus for generating a fluorine gas on site. The document discloses a fluorine gas generating device equipped with an electrolytic bath separated into an anode chamber and a cathode chamber by a partition, and a pressure-maintaining means for supplying gases respectively to the anode chamber and the cathode chamber, and maintaining the inside of the anode chamber and the cathode chamber at a predetermined pressure.

Meanwhile, in Patent Document 2, there has been disclosed an insoluble carbon electrode composed of a vitreous carbon material.

Patent Document 1: Japanese Patent Laid-open No. 2002-339090

Patent Document 2: Japanese Patent Laid-open No. 1999-236693

DISCLOSURE OF THE INVENTION

However, in the past, since a gas generated at an electrode covered a surface of the electrode, there was a problem in that a new reaction was hindered, thereby lowering the reaction efficiency. In particular, when a fluorine gas was generated by the use of carbon as an electrode material of an anode, the fluorine gas and carbon were reacted with each other and an F—C bond was formed at the electrode surface, thereby reducing the wettability of the electrode surface. Thus, the electrode surface was covered with the generated fluorine gas, and a new reaction was therefore hindered. Further, there was a problem such that a by-product such as $CF_4$ or the like was produced by the reaction of carbon with the fluorine gas.

The present invention is carried out in view of such points and its object therefore is to provide a technique for generating a gas more effectively by electrolysis.

(1) A gas generating device for generating a first gas at a first carbon electrode by applying a voltage between the first carbon electrode and a second electrode to electrolyzing an electrolytic solution, wherein the first carbon electrode is an anode or a cathode and wherein the first carbon electrode is provided with a plurality of fine gas flow channels which selectively pass the first gas generated on one surface of the first carbon electrode to the other surface without allowing the electrolytic solution to permeate therethrough.

(2) The gas generating device as set forth in (1), comprising:

a liquid flow channel for allowing the electrolytic solution to flow, the first carbon electrode and the second electrode arranged on both side of the liquid flow channel to contact the electrolytic solution and a first gas storage unit for receiving the first gas which is arranged to sandwich the first carbon electrode between the liquid flow channel and the first gas storage unit, wherein the liquid flow channel is communicated with the first gas storage unit through the fine gas flow channels formed on the first carbon electrode.

(3) The gas generating device as set forth in (2), wherein a second gas is generated at the second electrode by applying a voltage between the first carbon electrode and the second electrode for electrolyzing the electrolytic solution, the second electrode is a second carbon electrode, a second gas storage unit for receiving the second gas which is arranged to sandwich the second carbon electrode between the liquid flow channel and the second gas storage unit is further provided, the second carbon electrode is provided with a plurality of fine gas flow channels which selectively pass the second gas, and the liquid flow channel is communicated with the second gas storage unit through the appropriate fine gas flow channels.

(4) The gas generating device as set forth in (3), wherein the first gas storage unit is a first gas flow channel having a gas inlet for introducing an inert gas and a gas outlet for leading out the first gas along with the inert gas, and the second gas storage unit is a second gas flow channel having a gas inlet for introducing an inert gas and a gas outlet for leading out the second gas along with the inert gas.

(5) The gas generating device as set forth in (4), including a supporting substrate and a cover substrate arranged on the supporting substrate, wherein the liquid flow channel is formed of a groove for first flow channel formed on the supporting substrate and the cover substrate for covering the groove for first flow channel, the first gas storage unit and the second gas storage unit are formed of a groove for second flow channel and a groove for third flow channel respectively formed at intervals with the groove for first flow channel on both sides of the groove for first flow channel of the supporting substrate, and the cover substrate for covering the groove for second flow channel and the groove for third flow channel, the first carbon electrode is arranged in a first recessed portion for arrangement of an electrode disposed between the groove for first flow channel and the groove for second flow channel of the supporting substrate in contact therewith, and the second carbon electrode is arranged between the groove for first flow channel and the groove for third flow channel of the supporting substrate in contact therewith and disposed in the recessed portion for the second electrode arranged at a position facing to the recessed portion for arrangement of the first electrode.

(6) The gas generating device as set forth in any one of (3) to (5), wherein the first carbon electrode and the second carbon electrode are respectively composed of an electrode plate in a plate shape with grooves to be the fine gas flow channels formed thereon.

(7) The gas generating device as set forth in (6), wherein the first carbon electrode and the second carbon electrode are respectively composed of a carbon plate.

(8) The gas generating device as set forth in (3), wherein the first carbon electrode is composed of a first carbon plate with a plurality of through holes to be the fine gas flow channels arranged thereon, the second carbon electrode is composed of a second carbon plate with a plurality of through holes to be the fine gas flow channels arranged thereon, the first carbon electrode and the second carbon electrode are oppositely disposed to each other through the liquid flow channel, the first gas storage unit is provided on a back side of a surface of the first carbon plate facing to the second carbon electrode, and the second gas storage unit is provided on a back side of a surface of the second carbon plate facing to the first carbon electrode.

(9) The gas generating device as set forth in any one of (3) to (8), wherein a plurality of the first carbon electrodes and a plurality of the second carbon electrodes are disposed in the order of the second carbon electrode, the first carbon electrode, the first carbon electrode and the second carbon electrode, the liquid flow channel is disposed between the first carbon electrode and the second carbon electrode, and the first gas storage unit is disposed between the first electrode and the first electrode.

(10) The gas generating device as set forth in any one of (3) to (9), wherein the electrolytic solution is molten salt containing hydrogen fluoride, and wherein the first carbon electrode serving as an anode, a fluorine gas is generated at the first carbon electrode and a hydrogen gas is generated at the second carbon electrode.

(11) The gas generating device as set forth in (1) for generating the first gas at the first carbon electrode by applying a voltage between the first carbon electrode serving as an anode and the second electrode serving as a cathode for electrolyzing the electrolytic solution, comprising:

a liquid flow channel for allowing the electrolytic solution to flow, the first carbon electrode and the second electrode arranged to sandwich the liquid flow channel in which a facing surface is brought into contact with the electrolytic solution, and a first gas storage unit for receiving the first gas arranged so as to surround the back surface of the surface of the first carbon electrode in contact with the electrolytic solution, wherein the fine gas flow channels are through holes for passing gases, the liquid flow channel and the first gas storage unit are communicated with each other via the through holes for passing gases, and the first gas generated on the surface of the first carbon electrode in contact with the electrolytic solution is selectively passed via the through holes for passing gases and supplied to the first gas storage unit.

(12) The gas generating device as set forth in (11) for generating the second gas at the second electrode by applying a voltage between the first carbon electrode and the second electrode for electrolyzing the electrolytic solution, further comprising:

a second gas storage unit for receiving the second gas arranged so as to surround the back surface of the surface of the second electrode in contact with the electrolytic solution is further provided, the second electrode is a second carbon electrode with a plurality of through holes for passing gases formed thereon which can selectively pass the second gas generated on one surface to the other surface, the liquid flow channel and the second gas storage unit are communicated with each other via the through holes for passing gases, and the second gas generated on the surface of the second carbon electrode in contact with the electrolytic solution is selectively passed via the through holes for passing gases and supplied to the second gas storage unit.

(13) The gas generating device as set forth in (12), wherein the first gas storage unit is a first gas flow channel having a gas inlet for introducing an inert gas and a gas outlet for leading out the first gas along with the inert gas, and the second gas storage unit is a second gas flow channel having a gas inlet for introducing an inert gas and a gas outlet for leading out the second gas along with the inert gas.

(14) The gas generating device as set forth in (1), comprising:

a storage tank filled with the electrolytic solution, and the first carbon electrode and the second electrode respectively brought into contact with the electrolytic solution in the storage tank and arranged in the storage tank, wherein the fine gas flow channels formed on the first carbon electrode are through holes.

(15) The gas generating device as set forth in (14), wherein the first carbon electrode and the second electrode are arranged in parallel, and the first gas is generated on one surface of the first carbon electrode facing to the second electrode.

(16) The gas generating device as set forth in (14) or (15), wherein the second electrode is a second carbon electrode with a plurality of through holes formed thereon which can selectively pass the second gas generated on one surface to the other surface, and at least one of the first carbon electrode and the second carbon electrode is immersed in the direction perpendicular to the liquid surface of the electrolytic solution.

(17) The gas generating device as set forth in (16), further comprising:

a gas storage unit which covers the other surface of at least one of the first carbon electrode and the second carbon electrode for receiving the gas released from the other surface.

(18) The electrolyzer as set forth in (17), wherein at least two pairs of the first carbon electrodes and the second carbon electrodes are provided and at least the other surfaces of the first carbon electrodes or the other surfaces of the cathodes are facing to each other, and the gas storage unit for covering both a pair of the other surfaces facing to each other is provided.

(19) The gas generating device as set forth in any one of (16) to (18), wherein the gas storage unit is provided with an inert gas supply unit, and the inside of the gas storage unit can be ventilated by supplying the inert gas from the inert gas supply unit.

(20) The gas generating device as set forth in any one of (16) to (19), wherein the gas storage unit of the first carbon electrode or the second carbon electrode is provided with a raw material gas supply unit, and a raw material gas supplied from the raw material gas supply unit can be supplied to the electrolytic solution via the through holes.

(21) The gas generating device as set forth in any one of (14) to (20), wherein at least one of the first carbon electrode and the second carbon electrode is arranged horizontally to the liquid surface of the electrolytic solution and only the other surface is brought into contact with the liquid surface of the electrolytic solution.

(22) The gas generating device as set forth in any one of (14) to (21), wherein the storage tank is provided with the raw material gas supply unit, and the raw material gas can be supplied to the electrolytic solution from the raw material gas supply unit.

(23) The gas generating device as set forth in any one of (14) to (22), wherein the electrolytic solution is molten salt containing hydrogen fluoride, and with the first carbon electrode serving as an anode, a fluorine gas is generated at the first carbon electrode and a hydrogen gas is generated at the second carbon electrode.

(24) The gas generating device as set forth in any one of (1) to (23), wherein at least one of the first carbon electrode and the second electrode is composed of a carbon material, the fine gas flow channels are through holes for selectively passing gases, and the opening width of the through hole is not more than 1,000 μm.

(25) The gas generating device as set forth in (24), wherein the carbon material is composed of amorphous carbon.

(26) The gas generating device as set forth in (25), wherein the carbon material is composed of a vitreous carbon material.

(27) The gas generating device as set forth in (26), wherein the carbon material is in a film shape or a plate shape.

(28) The gas generating device as set forth in (27), wherein the carbon material is provided with a plurality of through holes arranged in the thickness direction.

(29) The gas generating device as set forth in (28), wherein the first carbon electrode or the second electrode is a carbon electrode for fluorine gas generation.

(30) The gas generating device as set forth in (29), wherein an inner wall surface of the through hole is enlarged in diameter in a tapered shape in the direction of passing of the gas.

(31) The gas generating device as set forth in (30), wherein the carbon material is obtained by firing an organic resin at a temperature of from 700 to 3,200 degrees centigrade.

(32) The gas generating device as set forth in (31), wherein the organic resin is composed of an aromatic resin containing a nitrogen atom.

(33) The gas generating device as set forth in (32), wherein the organic resin contains an aromatic polyimide resin or an aramid resin.

(34) A carbon electrode for gas generation used for the gas generating device as set forth in any one of (1) to (33) composed of a carbon material and provided with a plurality of fine gas flow channels which can selectively pass the gas generated on one surface to the other surface, wherein the opening width of the through hole for passing gases is not more than 1,000 μm.

(35) A carbon electrode for gas generation composed of a carbon material and provided with a plurality of through holes which selectively pass the gas, wherein the opening width of the through hole is not more than 1,000 μm.

(36) The carbon electrode for gas generation as set forth in (34) or (35), wherein the carbon material is composed of amorphous carbon.

(37) The carbon electrode for gas generation as set forth in (36), wherein the carbon material is composed of a vitreous carbon material.

(38) The carbon electrode for gas generation as set forth in (37), wherein the carbon material is in a film shape or a plate shape.

(39) The carbon electrode for gas generation as set forth in (38), wherein the carbon material is provided with a plurality of through holes arranged in the thickness direction.

(40) The carbon electrode for gas generation as set forth in (39), wherein the electrode is a carbon electrode for fluorine gas generation.

(41) The carbon electrode for gas generation as set forth in (40), wherein an inner wall surface of the through hole is enlarged in diameter in a tapered shape in the direction of passing of the gas.

(42) The carbon electrode for gas generation as set forth in (41), wherein the carbon material is obtained by firing an organic resin at a temperature of from 700 to 3,200 degrees centigrade.

(43) The carbon electrode for gas generation as set forth in (42), wherein the organic resin is composed of an aromatic resin containing a nitrogen atom.

(44) The carbon electrode for gas generation as set forth in (43), wherein the organic resin contains an aromatic polyimide resin or an aramid resin.

(45) A process for producing a carbon electrode for gas generation including:

preparing an organic resin material, producing an organic resin film having a plurality of through holes using the organic resin material, and obtaining a carbon material by firing the organic resin film at a temperature of from 700 to 3,200 degrees centigrade.

(46) The process for producing a carbon electrode for gas generation as set forth in (45), in which the organic resin material is an organic resin film in a film shape or a plate shape, and in the producing the organic resin film having a plurality of through holes, a plurality of through holes are formed in the thickness direction of the organic resin film.

(47) The process for producing a carbon electrode for gas generation as set forth in (46), in which, in the producing the organic resin film having a plurality of through holes, the through holes are formed by machining process, etching, injection molding, sandblasting or laser process.

(48) The process for producing a carbon electrode for gas generation as set forth in (47), in which the obtaining the carbon material by firing the organic resin film is carried out in an inert gas atmosphere.

(49) The process for producing a carbon electrode for gas generation as set forth in (48), in which the inert gas is argon or nitrogen.

(50) A process for generating a gas using a gas generating device which is comprised of a liquid flow channel for allowing an electrolytic solution to flow, a first carbon electrode brought into contact with the liquid flow channel and provided with a plurality of fine gas flow channels which selectively pass the gas, a second electrode brought into contact with the liquid flow channel and arranged to sandwich the liquid flow channel between the first carbon electrode and the second electrode, and a first gas storage unit arranged to sandwich the first carbon electrode between the liquid flow channel and the first gas storage unit, comprising:

flowing the electrolytic solution in the liquid flow channel, and applying a voltage between the first carbon electrode and the second electrode for electrolyzing the electrolytic solution, thereby generating a first gas at the first carbon electrode, in which, in the generating the first gas, the electrolysis is carried out while the first gas generated at the first carbon electrode moves to the first gas storage unit through the fine gas flow channels.

(51) A process for generating a gas using a gas generating device which is comprised of the liquid flow channel for allowing an electrolytic solution to flow, the first carbon electrode and the second electrode arranged to sandwich the liquid flow channel in which a facing surface is brought into contact with the electrolytic solution, the first gas storage unit arranged so as to surround the back surface of the surface of the first carbon electrode in contact with the electrolytic solution and the carbon electrode for gas generation as set forth in any one of (35) to (44) as the first carbon electrode, comprising flowing the electrolytic solution in the liquid flow channel, applying a voltage between the first carbon electrode and the second electrode for electrolyzing the electrolytic solution, thereby generating a first gas at the first carbon electrode, in which, in the generating the first gas, the electrolysis is continuously carried out and the first gas generated at the first carbon electrode is selectively passed via the through holes for passing gases and supplied to the first gas storage unit.

According to the present invention, it is possible to provide a gas generating device capable of generating a gas with good efficiency by electrolysis, a carbon electrode for gas generation to be used for the device, a process for producing the carbon electrode and a process for generating a gas.

BEST MODE FOR CARRYING OUT THE INVENTION

Figure 1:
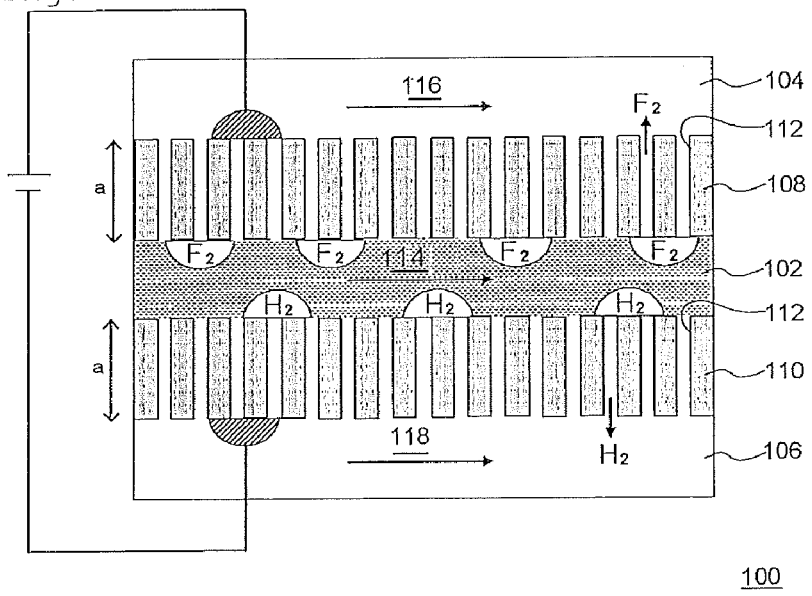
FIG. 1 is a schematic view illustrating the configuration of an electrolytic cell according to an embodiment of the present invention.

Embodiments of the present invention will be illustrated with reference to the drawings. Incidentally, in all drawings, the same components are assigned the same reference numerals and therefore their explanation will be omitted.

First, a carbon electrode for gas generation of present embodiment will be described by using a schematic view illustrating the configuration of a gas generating device (electrolytic cell).

FIG. 1 is a schematic view illustrating the configuration of an electrolytic cell according to present embodiment.

An electrolytic cell 100 is composed of a liquid flow channel 102 for allowing an electrolytic solution 114 to pass therethrough, a first carbon electrode 108 and a second carbon electrode 110 (second electrode) in a film shape or in a plate shape respectively brought into contact with the liquid flow channel 102 and arranged to sandwich the liquid flow channel 102 therebetween, a first gas flow channel 104 (first gas storage unit) arranged to sandwich the first carbon electrode 108 between the liquid flow channel 102 and the first gas flow channel 104, and a second gas flow channel 106 (second gas storage unit) arranged to sandwich the second carbon electrode 110 between the liquid flow channel 102 and the second gas flow channel 106. As the first carbon electrode 108 and the second carbon electrode 110, any carbon electrodes for gas generation can be used. In present embodiment, carbon electrodes used for the second electrode serving as a cathode are exemplified, but metal electrodes can also be used.

The first carbon electrode 108 and the second carbon electrode 110 are arranged respectively between the liquid flow channel 102 and the first gas flow channel 104, and between the liquid flow channel 102 and the second gas flow channel 106. In the first carbon electrode 108 and the second carbon electrode 110, a plurality of fine gas flow channels 112 (through holes for passing gases, referred to as through holes) which selectively pass the gas and do not pass the electrolytic solution 114 are arranged in the thickness direction. The liquid flow channel 102 is communicated with the first gas flow channel 104, and the liquid flow channel 102 is communicated with the second gas flow channel 106 respectively via the through holes 112 for passing gases.

Hereinafter, the operational mechanism of the electrolytic cell 100 according to present embodiment will be illustrated.

Herein, using molten salt containing hydrogen fluoride as the electrolytic solution 114, a fluorine gas generated at the anode and a hydrogen gas generated at the cathode respectively by electrolysis are exemplified.

In this case, in the electrolytic cell 100, the reactions according to the following equations (1) to (3) take place.

$$2HF \rightarrow F_2 + H_2 \quad (1)$$

The reaction at the anode is as follows.

$$2F^- \rightarrow F_2 2e^- \quad (2)$$

Meanwhile, the reaction at the cathode is as follows.

$$2H^+ + 2e^- \rightarrow H_2 \quad (3)$$

In the electrolytic cell 100 of this configuration, the electrolytic solution 114 which is a molten solution, is flowed from left to right through the liquid flow channel 102 in the figure. Furthermore, inert gases 116 and 118, for example, nitrogen gas, are respectively flowed from left to right through the first gas flow channel 104 and the second gas flow channel 106 in the figure. In this state, a voltage is applied between the first carbon electrode 108 and the second carbon electrode 110 such that the first carbon electrode 108 serves as an anode and the second carbon electrode 110 serves as a cathode, for electrolyzing the molten salt. Accordingly, a fluorine gas is generated on the surface of the first carbon electrode 108, and a hydrogen gas is generated on the surface of the second carbon electrode 110, which are brought into contact with the electrolytic solution 114 in the liquid flow channel 102.

Herein, since the through holes 112 for passing gases are arranged on the first carbon electrode 108, the fluorine gas generated on the surface of the first carbon electrode 108 is passed through the through holes 112 for passing gases, moves to the first gas flow channel 104, and moves from left to right through the first gas flow channel 104 along with the inert gas 116 in the figure. Similarly, since the through holes 112 for passing gases are arranged on the second carbon electrode 110, the hydrogen gas generated on the surface of the second carbon electrode 110 is passed through the through holes 112 for passing gases, moves to the second gas flow channel 106, and moves from left to right through the second gas flow channel 106 along with the inert gas 118 in the figure. Accordingly, the fluorine gas generated at the first gas flow channel 104 and the hydrogen gas generated at the second gas flow channel 106 can be respectively recovered.

Since the carbon electrodes for gas generation to be described below are used, gases generated on the electrode surfaces are quickly removed from the electrode surfaces and a new electrolytic solution is supplied to the electrode surfaces, such a gas generating device is capable of carrying out electrolysis with good efficiency. Furthermore, since gases generated on respective electrode surfaces are passed through the through holes 112 for passing gases and separated by moving to the first gas flow channel 104 and the second gas flow channel 106, there is no need to separate them by the use of a skirt or the like.

<Carbon Electrodes for Gas Generation>

Hereinafter, the carbon electrodes for gas generation according to present embodiment will be illustrated.

As the first carbon electrode 108 and the second carbon electrode 110 according to present embodiment, the carbon electrodes for gas generation provided with a plurality of fine gas flow channels (through holes 112 for passing gases), which selectively pass the gases, are used. The position of the through hole 112 for passing gases is not particularly restricted, and they may be formed in a zig-zag shape, in a lattice form or in an oblique lattice form. Furthermore, the opening shape of the through hole 112 for passing gases is not particularly restricted, and may be in a circular shape, in a rectangular shape including a square, in a polygonal shape or in a slit shape. From the viewpoint of stability of electrolysis, the opening size of the through hole 112 for passing gases may be preferably uniform as much as possible. The through holes 112 for passing gases which selectively pass the gas will be described.

$\Delta P$ ($=P_1-P_2$), the difference between the pressure $P_1$ of the electrolytic solution 114 passing through the liquid flow channel 102 and the pressure $P_2$ of the gas flowing through the first gas flow channel 104 or the second gas flow channel 106, is set to be not more than the Young-Laplace pressure obtained by the following Young-Laplace equation (equation (4)), whereby it is possible to selectively pass the gas without allowing the electrolytic solution 114 to pass through the through holes 112 for passing gases.

$$\Delta P(=P_1-P_2) \leqq -4\gamma \cos\theta / w \quad (4)$$

wherein, $\Delta P$ represents the Young-Laplace pressure, $\gamma$ represents the surface tension of the electrolytic solution 114, $\theta$ represents the contact angle of the electrolytic solution 114, and w represents the width of the through hole 112 for passing gases.

Figure 36:
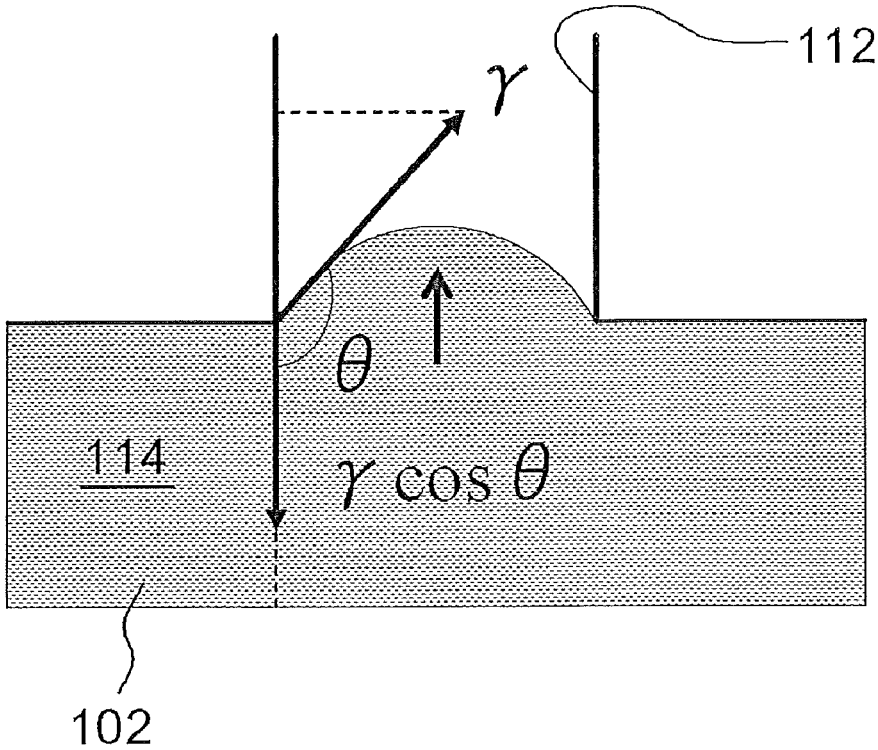
FIG. 36(*a*) to FIG. 36 (*c*) are views illustrating the Young-Laplace equation.
Figure 36:
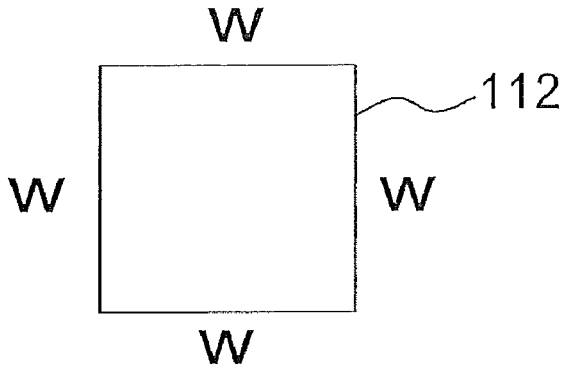
Figure 36:
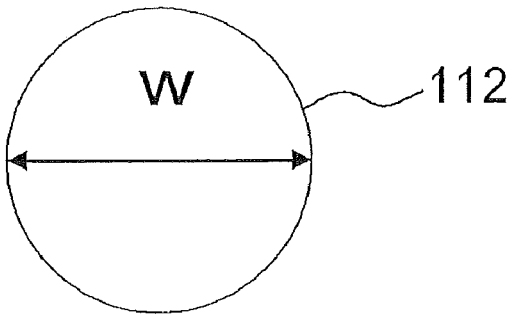

Also by referring to FIG. 36, the Young-Laplace equation will be described. As shown in FIG. 36(*a*), the force required for spreading the electrolytic solution 114 in contact with the contact angle θ in the direction of the through holes 112 for passing gases becomes $-\gamma \cos \theta$. Herein, as shown in FIG. 36(*b*), when the opening portion of the through hole 112 for passing gases is in a rectangular shape of w×w, the surface tension is applied to a side in contact with the electrolytic solution 114. Namely, the force required for pushing the electrolytic solution 114 into the through holes 112 for passing gases at this time becomes $-4w\gamma \cos \theta$. When this value is divided by the area ($w^2$) of the through hole 112 for passing gases and converted into the pressure, the Young-Laplace equation becomes the above equation. Similarly, as shown in FIG. 36(*c*), when the opening portion of the through hole 112 for passing gases is in a circular shape having a diameter of w, the force required for pushing the electrolytic solution 114 into the through holes 112 for passing gases at this time becomes $-wn\gamma \cos \theta$. When this value is divided by the area ($nw^2/4$) of the through hole 112 for passing gases and converted into the pressure, at this time the Young-Laplace equation becomes the above equation as well. Accordingly, the gas-liquid interfaces are formed respectively on a surface in which the first carbon electrode 108 is brought into contact with the liquid flow channel 102 and a surface in which the second carbon electrode 110 is brought into contact with the liquid flow channel 102.

Furthermore, when the through hole 112 for passing gases is in a rectangular shape of w×l (l>>w), that is, the shape of the opening portion is a slit shape, ΔP can be expressed as $-2\gamma \cos \theta/w$ ($\Delta P=-2\gamma \cos \theta/w$).

In present embodiment, the opening width w of the through hole 112 for passing gases is determined so as to satisfy the above equation (4) based on the values which can be taken as the pressure $P_1$ and pressure $P_2$, and the surface tension and the contact angle of the electrolytic solution 114.

In present embodiment, the opening width w of the through hole 112 for passing gases can be not more than 1,000 μm.

In case of a horizontal gas generating device in which the carbon electrode for gas generation is immersed in molten salt so as to be almost even with the top surface of molten salt, the opening width w of the through hole 112 for passing gases can be not more than 1,000 μm, preferably from 50 to 500 μm and further preferably from 100 to 300 μm.

In case of the horizontal gas generating device, the depth of the electrode immersed in molten salt is shallow so that the opening width w of the through hole 112 for passing gases can be made larger. Therefore, an effect of easy processing of electrodes is obtained. For example, when the surface tension of molten salt is $9.4\times10^{-2}$ N/m, the specific gravity of molten salt is 2.0 g/cm$^3$ and the contact angle between molten salt and the carbon electrode for gas generation is 140°, and if the opening width w of the through hole 112 for passing gases is 1,000 μm, the electrode can be immersed to the mathematical depth of 1.4 cm so that the molten salt is never infiltrated into the through holes 112 for passing gases.

In case of a vertical gas generating device in which the carbon electrode for gas generation is immersed in the electrolytic solution so as to be almost perpendicular to the liquid surface of the electrolytic solution, the opening width w of the through hole 112 for passing gases can be not more than 300 μm, preferably from 30 to 200 μm and further preferably from 50 to 150 μm.

In case of the vertical gas generating device, the carbon electrode is immersed in the electrolytic solution so as to be almost perpendicular to the liquid surface of the electrolytic solution so that the pressure applied to the carbon electrode increases as compared to the depth. Thus, the opening width w of the through hole 112 for passing gases needs to be made smaller. On the other hand, a plurality of electrodes are put into the electrolytic solution in parallel, whereby it brings effects that an area of the electrode can be made large and the device can be made compact.

For example, when the surface tension of molten salt is $9.4\times10^{-2}$ N/m, the specific gravity of molten salt is 2.0 g/cm$^3$, and the contact angle between molten salt and the carbon electrode for gas generation is 140°, and if the opening width w of the through hole 112 for passing gases is 300 μm, molten salt is never infiltrated into the through holes 112 for passing gases up to the mathematical depth of 4.8 cm. The smaller the opening width w of the through hole 112 for passing gases becomes, the electrode can be immersed deeper in molten salt, whereas there is a limitation because a higher technique is required as the through holes are made smaller, thus increasing the processing cost as well.

By this configuration, the gas generated on the surface of the carbon electrode for gas generation is selectively passed through the through holes 112 for passing gases and is removed so that a new electrolytic solution is supplied to the electrode surface. Therefore, such a carbon electrode for gas generation is excellent in field performance and is capable of carrying out electrolysis with good efficiency.

In present embodiment, the thickness a each of the first carbon electrode 108 and the second carbon electrode 110 illustrated in FIG. 1 can be not more than 3 mm and preferably from 20 μm to 1 mm. Herein, the thickness a each of the first carbon electrode 108 and the second carbon electrode 110 may be different.

An inner wall surface of the through holes 112 for passing gases may be configured so as to be enlarged in diameter in a tapered shape in the direction of passing of the gas. By this configuration, an interface between molten salt and generated gas can be maintained well so that separation performance of generated gases is excellent.

Furthermore, the carbon electrode for gas generation according to present embodiment can be composed of a carbon material consisting of amorphous carbon. This carbon material is preferably a vitreous carbon material. By using the carbon electrode for gas generation of this configuration, electrolysis can be carried out with good efficiency over a long period of time.

When graphite is used as an electrode material for the anode, carbon and fluorine are reacted with each other to form a layered compound so that electrical insulation is increased and electrolytic performance is reduced. So, performance as an electrode is lowered in a relatively short period of time in some cases.

On the other hand, when a carbon material composed of amorphous carbon, preferably a vitreous carbon material, is used as a carbon electrode, electrolytic performance is maintained. Thus, such a carbon material can be used as an electrode for a long period of time.

When the carbon electrode for gas generation of present embodiment is composed of a carbon material consisting of amorphous carbon, in Raman spectrum of the laser-Raman method, the half width of the G1 band is from 40 to 100 cm$^{-1}$. Such a carbon electrode for gas generation is composed of a carbon material having a low graphitization degree.

Furthermore, when the carbon electrode for gas generation in present embodiment is composed of a carbon material consisting of amorphous carbon, the half width of a peak corresponding to 002 plane of graphite shown in the vicinity of 22° to 27° is from 1.0° to 15.0° by the X-ray diffraction (XRD). Such a carbon electrode for gas generation is composed of a carbon material having a turbostratic structure with little regularity in the laminated structure of graphite.

According to the gas generating device (FIG. 1) using such a carbon electrode for gas generation, the gas generated on the electrode surface is quickly removed from the electrode surface so that electrolysis can be carried out with good efficiency without covering the electrode surface with the gas and staying there. Furthermore, since the fluorine gas generated on the surface of the anode is quickly removed from the electrode surface, even when carbon is used as an electrode material for the anode, the reaction of the fluorine gas with carbon is suppressed and a new electrolytic solution is supplied to the electrode surface. Thus, electrolysis can be carried out with good efficiency. Also, generation of a by-product such as $CF_4$ or the like can be suppressed.

Furthermore, the carbon electrode for gas generation in present embodiment can be suitably used for the gas generating device of present embodiment to be described later.

Such a carbon electrode for gas generation can be produced in accordance with the following steps:

(a) a step of preparing an organic resin material;

(b) a step of producing an organic resin film having a plurality of through holes for passing gases using the aforementioned organic resin material; and (c) a step of obtaining a carbon material by firing the organic resin film at a temperature of from 700 to 3,200 degrees centigrade.

Respective steps will be described below.

((a) Step of Preparing Organic Resin Material)

In the step (b) to be described later, when an organic resin film having a plurality of through holes for passing gases is produced by machining process, etching, sandblasting process or laser process, an organic resin material in a plate shape or in a film shape is prepared. In this case, the organic resin material can be separately produced or commercial materials can also be used. On the other hand, in the step (b), when an organic resin film having a plurality of through holes for passing gases is produced by injection molding, a thermosetting resin having fluidity obtained by heating at a predetermined temperature can be used as an organic resin material.

As the organic resin, there can be used polyimide resins, photosensitive polyimide resins, aramid resins, acrylonitrile resins, polyetheretherketone resins, phenol resins, furfuryl alcohol resins, furan resins, poly(p-phenylene vinylene) resins, polyoxadiazole resins, poly vinylidene chloride resins or the like. In present embodiment, preferably used is an aromatic resin containing a nitrogen atom. Examples of such a resin include aromatic polyimide resins, aramid resins and the like. It is preferable that such a resin contains a nitrogen atom because carbonization and firing in the firing process quickly proceed. Incidentally, even when a resin containing a nitrogen atom is employed, nitrogen may be contained in the carbon material after firing process in the following step (c) to be described below.

((b) Step of Producing Organic Resin Film Having a Plurality of Through Holes for Passing Gases)

As a method for producing an organic resin film having a plurality of through holes for passing gases, there can be exemplified, for example, machining process, etching, injection molding, sandblasting process and laser process. Incidentally, in firing of the step (c), when the opening width of the through hole for passing gases is reduced in diameter, it is preferable to form the through holes for passing gases in consideration of the degree of its diameter reduction.

To form a plurality of through holes for passing gases by machining process, hole processing may be carried out in the thickness direction of the organic resin film in a plate shape or in a film shape by a method such as drilling, pressing, microimprinting or the like. When a plurality of through holes for passing gases are formed by microimprinting, they may be formed by pushing a plurality of projections formed on a mold to the resin material coated on a substrate for transferring the shape.

To form a plurality of through holes for passing gases by etching, first, a photoresist film is formed on a surface of the organic resin film in a plate shape or in a film shape. Then, predetermined patterns are formed on the photoresist film and then a plurality of through holes for passing gases are formed on the organic resin film by the usual etching method. As the etching method, either dry etching or wet etching can also be used. When the through holes for passing gases are formed by etching, the inner wall surface of the through hole for passing gases can be enlarged in diameter in a tapered shape toward the back side of the through hole for passing gases.

Furthermore, the through holes for passing gases can also be formed by etching from both surfaces of the organic resin film.

To form a plurality of through holes for passing gases by injection molding, an organic resin material having fluidity is injected and filled into a mold in a desired shape, and the resulting material is cured. According to this method, the through holes for passing gases may be produced so as to have a desired shape. Fine carbon powder can also be mixed in the resin to be used for injection molding. Fine carbon powder functions as a filler and is effective in enhancing moldability at the time of injection molding.

To form a plurality of through holes for passing gases by laser process, laser process using an excimer laser or the like can be carried out. Accordingly, the inner wall surface of the through hole for passing gases can be enlarged in diameter in a tapered shape toward the back side of the through hole for passing gases.

In present embodiment, it is preferable to form the through holes for passing gases by etching from the viewpoint of mass productivity.

((c) Step of Obtaining Carbon Material by Firing Organic Resin Film at Temperature of from 700 to 3,200 Degrees Centigrade)

In this step, first, the organic resin film having a plurality of through holes for passing gases formed in the aforementioned step is heated at a rate of 0.1 to 30 degrees centigrade/min so as to reach a predetermined firing temperature. Then, the carbon material can be obtained by firing at 700 to 3,200 degrees centigrade and preferably at 900 to 2,000 degrees centigrade. The suitable and optimum range of the firing time is different depending on the type of the resin constituting the organic resin film or its film thickness, but it is from about 30 minutes to 24 hours after reaching a predetermined firing temperature.

The carbon material obtained in this step can be obtained as a carbon material composed of amorphous carbon, preferably a vitreous carbon material.

Furthermore, firing of the organic resin film is preferably carried out in an inert gas atmosphere. Examples of the inert gas include argon and nitrogen. From the viewpoint of carbonization and firing, preferably used is argon. Furthermore, firing of the organic resin film may also be carried out by reducing the pressure to not more than 0.1 Pa.

Incidentally, in order to suppress bending of the organic resin film during firing, the organic resin film may be sandwiched by reinforcement members having heat resistant from both surfaces.

By firing in the step (c), the opening diameter of the through hole for passing gases prepared by the step (b) becomes small so that an electrode having a smaller opening diameter can be easily prepared.

Thereafter, cutting process or the like is carried out so as to have a predetermined shape as necessary so that the carbon electrode for gas generation in present embodiment can be obtained.

As described above, embodiments of the present invention are illustrated with reference to the drawings. Such embodiments are exemplified in the present invention and various configurations other than the above embodiments can also be adopted.

For example, in the gas generating device of present embodiment, the first carbon electrode 108 and the second carbon electrode 110 are used the carbon electrode for gas generation of present embodiment, whereas at least the carbon electrode for gas generation of present embodiment may be used as the first carbon electrode 108 for generating a fluorine gas.

<Gas Generating Device>

Hereinafter, the embodiment according to the gas generating device of the present invention will be described by using the drawings. Furthermore, in all drawings, the same components are assigned the same reference numerals and appropriate explanation thereof will be omitted.

The gas generating device of present embodiment is provided with the first carbon electrode (anode) and the second electrode (cathode), wherein a voltage is applied between the first and second electrodes for electrolyzing an electrolytic solution, whereby a first gas can be generated at the anode.

On the anode, there are formed a plurality of fine gas flow channels, which selectively pass the first gas generated on one surface to the other surface, without allowing the electrolytic solution to permeate therethrough.

Furthermore, in present embodiment, as the anode and/or cathode, the aforementioned carbon electrodes for gas generation can be used.

The first embodiment will be described below.

(First Embodiment)

The gas generating device according to present embodiment is provided with an anode 5*a* and a cathode 5*b* formed in contact with an electrolytic solution 7.

Figure 2:
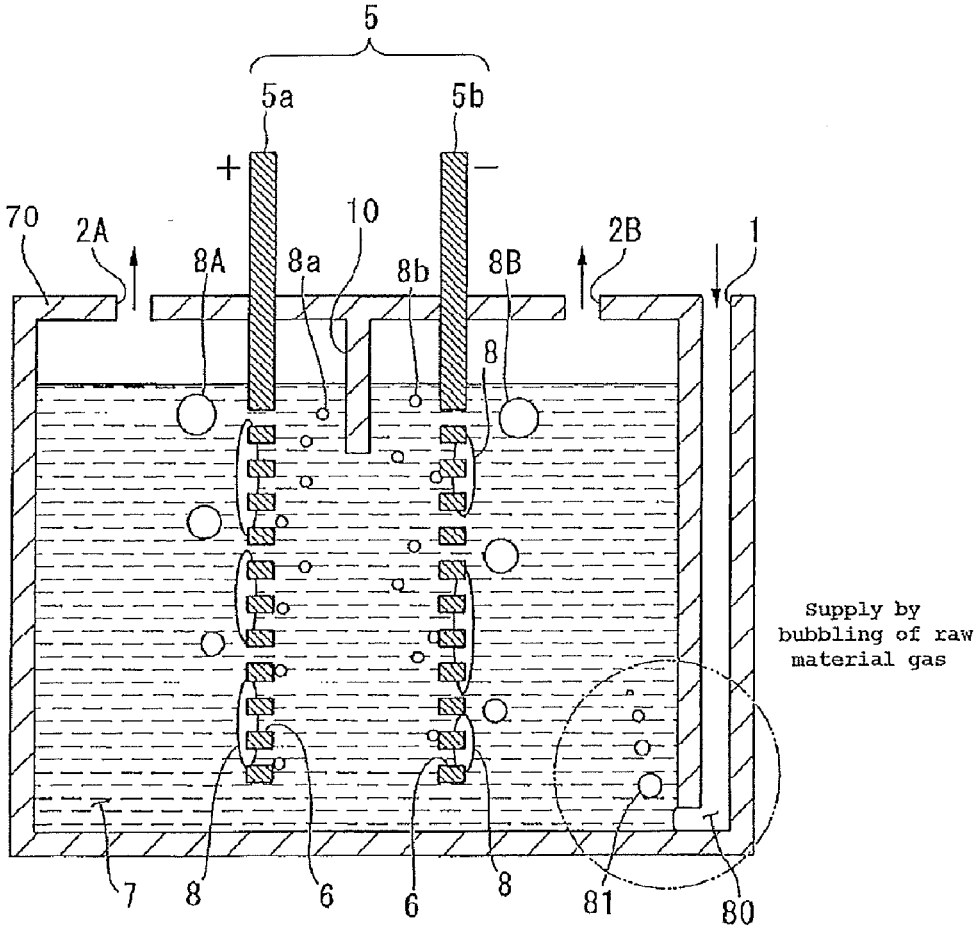
FIG. 2 is a schematic configuration view of an electrolyzer according to present embodiment.

FIG. 2 is a schematic configuration view of a gas generating device according to present embodiment. As shown in FIG. 2, in the gas generating device, an electrolytic bath 70 which is a storage tank, is filled with the electrolytic solution 7 containing molten salt, and an electrode 5 connected with a DC power source is immersed in the electrolytic solution 7. The electrode 5 consists of the anode 5*a* (anode electrode) and the cathode 5*b* (cathode electrode).

On one end of the electrolytic bath 70, a gas flow channel inlet 1 (hereinafter referred to as a raw material gas inlet) is arranged. Via the raw material gas inlet 1, a raw material gas 80 is put into the electrolytic solution 7 in the electrolytic bath 70 and introduced into the electrolytic solution 7 as bubbles 81 from one corner in the bottom of the electrolytic bath 70 (bubbling). Accordingly, the concentration of the electrolytic solution 7 can be maintained and the concentration of the electrolytic solution 7 can be made uniform. Incidentally, the electrolytic bath 70 may be equipped with a stirring means which enables the concentration of the electrolytic solution 7 to be uniform by stirring the electrolytic solution 7.

Furthermore, a partition 10 is arranged on the top of the nearly center part of the electrolytic bath 70. On both sides of the partition 10, there are arranged the anode 5*a* and the cathode 5*b*. It is configured so as to obtain desired gases separately with the progress of electrolysis without being mixed with each other at both sides of the partition 10.

The electrolytic bath 70 is provided with gas flow channel outlets 2A, 2B (hereinafter referred to as the gas outlet) which are capable of discharging desired gases from the upper space of the electrolytic solution 7.

The gas outlet 2A is configured so as to be able to recover the first gas (bubbles 8*a*, 8A) generated on the anode 5*a* with good efficiency. The gas outlet 2B is configured so as to be able to recover the second gas (bubbles 8*b*, 8B) generated on the cathode 5*b* with good efficiency.

Figure 3:
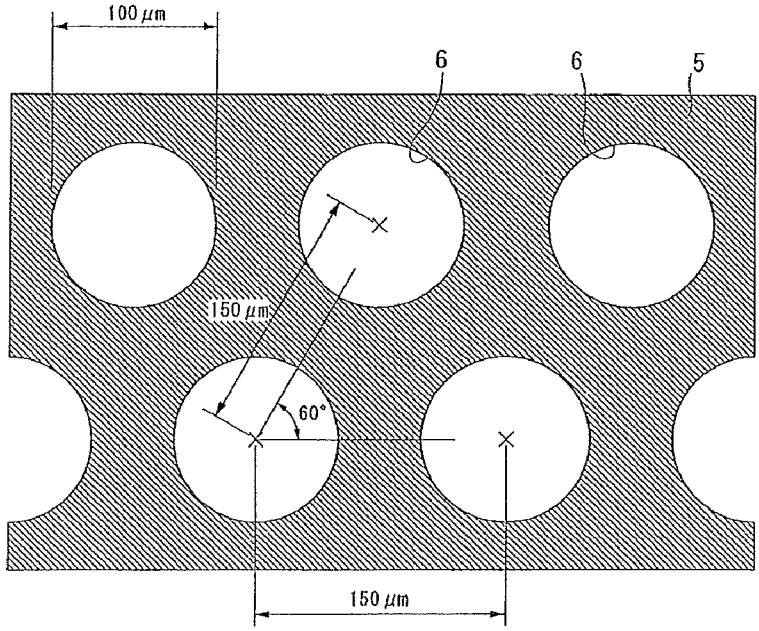
FIG. 3 is an enlarged top plan view of an electrode used for the electrolyzer according to present embodiment.

FIG. 3 is a partially enlarged top plan view of the electrode 5 used for the gas generating device according to present embodiment. As shown in FIG. 3, fine gas flow channels (through holes 6) having a diameter of 100 μm are regularly opened in a zig-zag shape having a pitch of 150 μm at an angle of 60° on the electrode 5.

In present embodiment, depending on the handling gas, the type of the electrolytic solution 7, the shape of the electrolytic bath 70 or the stirring method of the electrolytic solution 7, for example, a plurality of through holes 6 having a diameter of from about 0.5 to 1 mm can be configured to be formed and bubbles 8*a*, 8A, 8*b*, 8B generated as a result of electrolysis can also be configured to pass through these through holes 6.

Furthermore, in any of the anode 5*a* or the cathode 5*b*, there is a problem in deterioration of the electrode on the gas generating surface. When bubbles are required to be quickly removed in any of the anode 5*a* or the cathode 5*b*, the aforementioned carbon electrodes for gas generation can be used for any of the anode 5*a* and the cathode 5*b* as in present embodiment. On the other hand, when deterioration of one of the electrodes does not cause a problem, that electrode may be in a usual rod shape, in a plate shape, or in a cylindrical shape so as to surround the other electrode.

In present embodiment, examples of the electrolytic solution 7 include molten salt containing hydrogen fluoride. As the raw material gas 80, a hydrogen fluoride gas can be used. In this case, the first gas generated on the gas generating surface of the anode 5*a* is a fluorine gas, while the second gas generated on the gas generating surface of the cathode 5*b* is a hydrogen gas.

Hereinafter, effects of the gas generating device according to present embodiment will be illustrated.

In the gas generating device of present embodiment, the through holes 6 on the electrode 5 selectively pass the gas generated on the gas generating surface. That is, even when the pressure (fluid pressure) according to its depth is generated in the electrolytic solution 7, outflow of the electrolytic solution 7 to the gas releasing surface from the gas generating surface is suppressed.

Accordingly, movement of the electrolytic solution 7 to a side of the gas releasing surface via the through holes can be suppressed, and electrolysis can be carried out with good efficiency without hindering movement of the bubbles 8*a*, 8*b*.

Furthermore, in the gas generating device of present embodiment, the storage tank (electrolytic bath 70) is filled with the electrolytic solution 7.

In present embodiment, the electrode 5 subjected to surface treatment as described above is used and bubbles 8*a*, 8*b* can be easily removed from the gas generating surface α so that prevention of electrolysis due to generated gases can be suppressed. Accordingly, the relatively large-scale device can be configured, and desired gases can be supplied with good efficiency and in large quantities.

In present embodiment, the anode 5*a* and the cathode 5*b* are arranged in parallel, and the gas generating surface of the anode 5*a* and the gas generating surface of the cathode 5*b* are oppositely disposed to each other.

Accordingly, the area efficiency in the gas generating device is improved, and the degree of freedom in the design of the electrode structure and the electrolytic bath is improved.

In present embodiment, at least one of the anode 5*a* and the cathode 5*b* is immersed in the direction perpendicular to the liquid surface of the electrolytic solution 7.

Accordingly, removal of bubbles 8*a*, 8*b* from the gas generating surface is accelerated so that the current density per a unit area of the electrode becomes uniform over a long period of time. Thus, the desired gases can be obtained by electrolysis with good efficiency.

In present embodiment, the device is configured such that the raw material gas 80 can be supplied to the electrolytic solution 7 from the raw material gas supply unit.

Accordingly, electrolysis can be continuously carried out and the concentration of the raw material can be maintained at a constant level so that the desired gases can be obtained with good efficiency.

Furthermore, to supply the raw material gas 80 to the electrolytic solution 7 from the raw material gas supply unit, the raw material gas 80 can be introduced into the electrolytic solution 7 from the bottom of the electrolytic bath 70 by bubbling.

Accordingly, even though stirring of the electrolytic solution 7 is incomplete because the volume of the electrolytic bath 70 is not sufficient and the interval between the anode 5*a* and the cathode 5*b* is narrow, or the like, the concentration of the raw material can be made uniform in the inside of the electrolytic bath 70 and in the vicinity of the electrode 5, and the current density on the surface of the electrode 5 can be made uniform. Accordingly, electrolysis is carried out with good efficiency so that the desired gases can be obtained. In the case, it is preferable to cause natural convection to occur in the electrolytic solution 7 by locally heating the electrolytic bath 70.

(Second Embodiment)

The gas generating device according to the second embodiment will be illustrated below with reference to FIG. 4.

Figure 4:
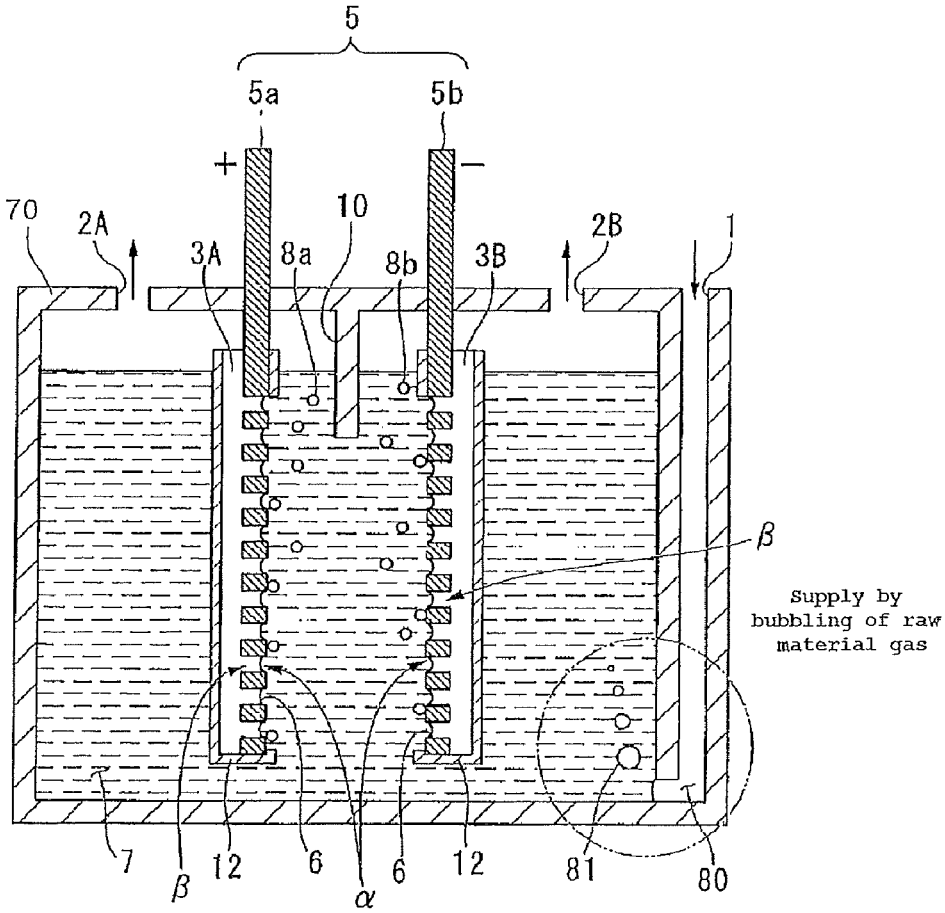
FIG. 4 is a schematic configuration view of an electrolyzer using a ventilating duct-equipped electrode according to present embodiment.

As shown in FIG. 4, there is arranged a gas storage units 12 (hereinafter referred to as a ventilation duct) for covering a gas releasing surface β of the electrode 5 and having gas flow channels 3A, 3B in its interior for receiving the gas released from the gas releasing surface β.

Accordingly, as shown in FIG. 4, bubbles 8*a*, 8*b* generated on the gas generating surface α as electrolysis proceeds are quickly discharged to the gas flow channels 3A, 3B of the gas storage unit 12 in the gas releasing surface β. The gas storage unit 12 is provided with an opening portion in the upper part, and the gases released from the opening portion are discharged from the gas flow channel outlets 2A, 2B (discharge port) and recovered.

Figure 5:
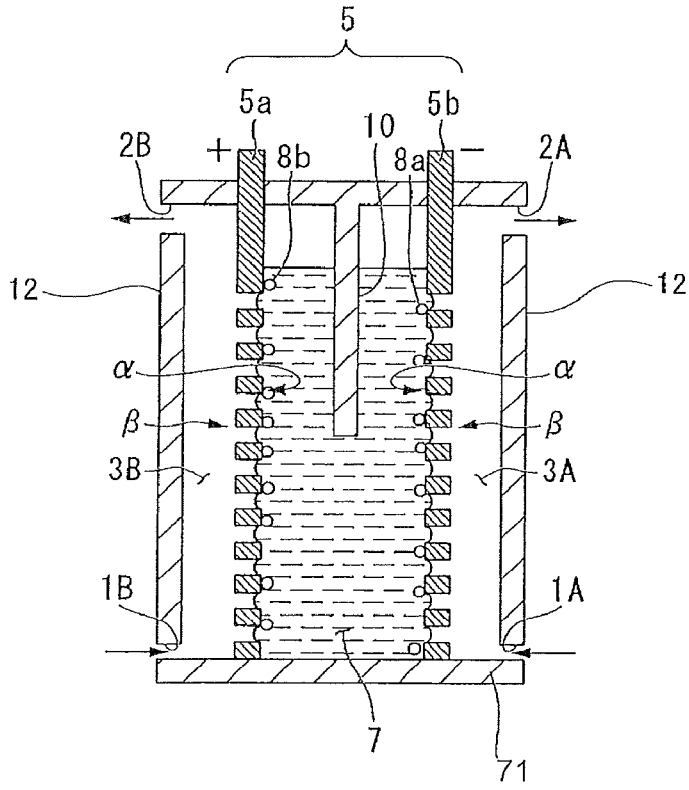
FIG. 5 is a schematic configuration view of an electrolyzer with a gas flow channel arranged on a gas releasing surface according to present embodiment.

FIG. 5 is another aspect of a gas generating device according to present embodiment, which is different from the gas generating device as shown in FIG. 4. The electrolytic solution 7 is filled only between the anode 5*a* and the cathode 5*b*. The electrolytic bath 71 is provided with an inert gas supply unit and it is configured such that an inert gas such as nitrogen, helium or the like can be supplied to the gas flow channels 3A, 3B from the gas flow channel inlets 1A, 1B (inlet port). Accordingly, the gases generated from the gas flow channel outlets 2A, 2B (discharge port) are discharged and recovered.

The gas generating device in FIG. 5 can be configured so as to supply a raw material gas in place of the inert gas to the electrolytic solution 7 via the through holes 6 in the anode 5*a* and/or cathode 5*b*.

Via the through holes 6 capable of selectively passing the gas, the raw material gas is supplied to the electrolytic solution 7 from the gas storage unit 12 and dissolved in the electrolytic solution 7. Then, bubbles 8*a*, 8*b* generated by electrolysis move to the inside of the gas storage unit 12 from the gas generating surface α. Since the raw material gas is easily dissolved in the electrolytic solution 7, the raw material gas is selectively passed through the through holes 6 and dissolved in the electrolytic solution 7. That is, the desired generated gases are passed through the through holes 6 in the electrode in the direction of the gas releasing surface β from the gas generating surface α of the electrode 5 and they are separated, while the raw material gas is passed through the through holes 6 of the electrode 5 in the direction of the gas generating surface α from the gas releasing surface β of the electrode 5 and is dispersed in the electrolytic solution 7, thereby replenishing the raw material.

In present embodiment, using molten salt containing hydrogen fluoride as the electrolytic solution, a hydrogen fluoride gas supplied to the gas storage unit 12 of the cathode side generating a hydrogen gas is exemplified as a raw material gas.

Figure 6:
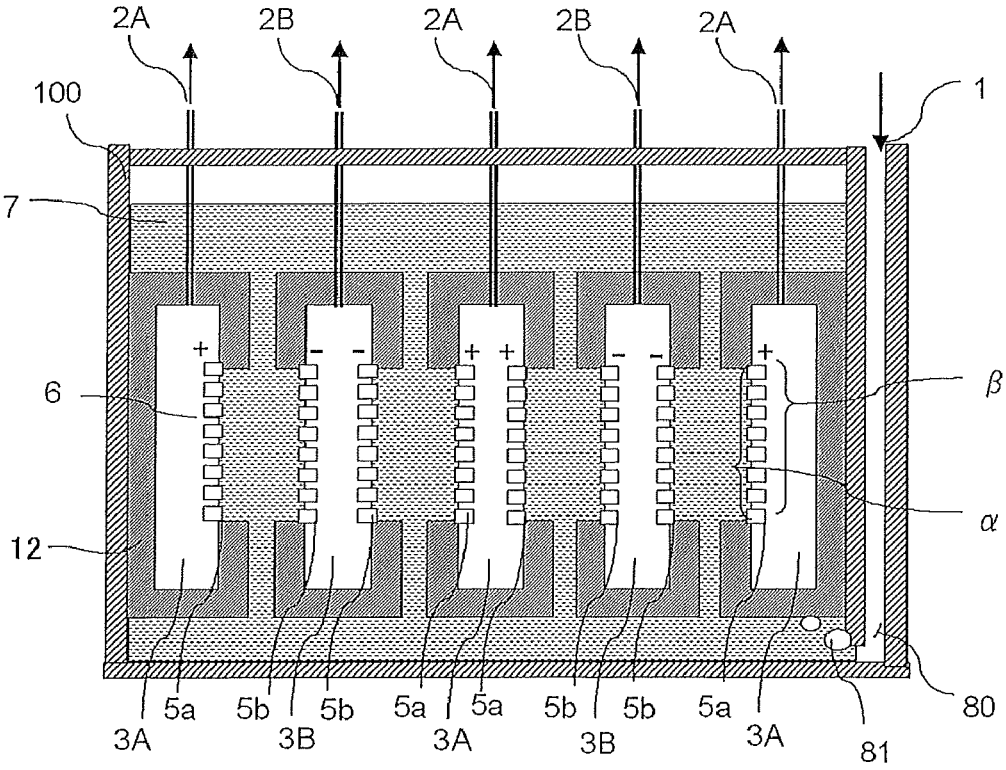
FIG. 6 is a schematic configuration view of an electrolyzer equipped with a gas storage unit surrounding opposing gas generating surfaces according to present embodiment.

FIG. 6 is another aspect of an electrolyzer according to present embodiment, which is different from the electrolyzer as shown in FIG. 4. The gas storage unit 12 is arranged so as to surround both the gas releasing surfaces β, β facing to each other. The gases released from the gas releasing surface β are quickly discharged to the gas flow channels 3A, 3B in the gas storage unit 12. The gas storage unit 12 is provided with gas flow channel outlets 2A, 2B (discharge port) in the upper part, and the generated gases are discharged from the gas flow channel outlets 2A, 2B and recovered.

Hereinafter, effects of the gas generating device according to present embodiment will be illustrated.

The gas generating device in present embodiment is provided with the gas storage unit 12 for covering the gas releasing surface β of at least one of the anode 5*a* and the cathode 5*b* and receiving gases discharged from the gas releasing surface β.

When the gas releasing surface β is covered with gas, bubbles 8*a*, 8*b* effectively move to a side of the gas releasing surface β via the through holes 6 so that deterioration of the electrode 5 can be suppressed and a capability to recover the generated gases can also be improved. Accordingly, the gas generating device in present embodiment can be preferably used for relatively large-scale devices.

Furthermore, the gas generating device of present embodiment is configured to enable ventilation by supplying the inert gas to the inside of the gas storage unit 12 from the inert gas supply unit.

By supply of the inert gas, since a flow of the gases is formed in the inside of the gas flow channels 3A, 3B, the surface tension affects for absorbing the gases 8*a*, 8*b* into the inside of the gas flow channels 3A, 3B. Accordingly, electrolysis can be carried out with good efficiency.

The gas generating device in present embodiment is provided with a gas supply unit at the gas storage unit 12 of the anode 5*a* or the cathode 5*b*, and is able to enable to supply the raw material gas supplied from the gas supply unit to the electrolytic solution 7 via the through holes 6.

Accordingly, electrolysis can be continuously carried out and electrolysis can be carried out with good efficiency because the concentration of the raw material can be maintained at a constant level.

The electrolyzer in present embodiment is provided with at least two pairs of anodes 5*a* and cathodes 5*b*. At least the gas releasing surfaces β of the anodes 5*a* or the gas releasing surfaces β of the cathodes 5*b* are oppositely disposed to each other. There is arranged the gas storage unit 12 for covering any of a pair of the gas releasing surfaces β, β facing to each other.

Accordingly, the device configuration can be simplified and the degree of freedom in the design of the electrolytic bath is improved.

(Third Embodiment)

The gas generating device according to the third embodiment will be illustrated below with reference to FIG. 7.

Figure 7:
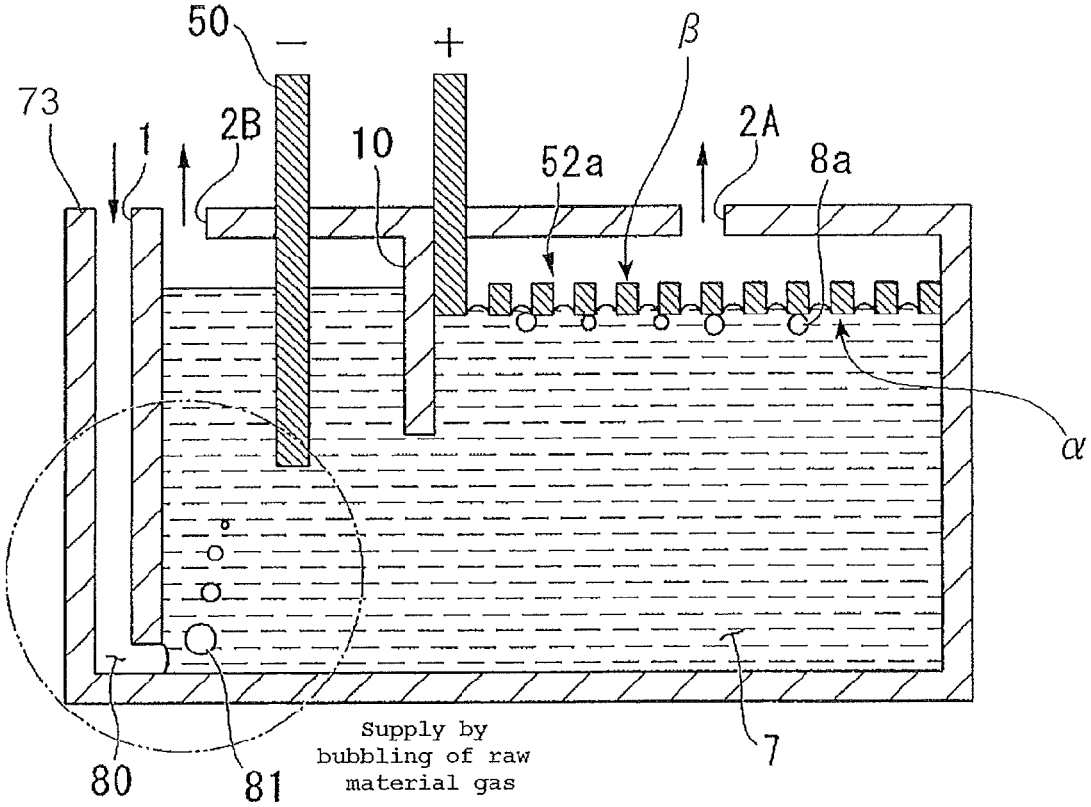
FIG. 7 is a schematic configuration view of an electrolyzer using an electrode in a drop-lid shape according to present embodiment.

FIG. 7 illustrates a gas generating device having an anode and a cathode which are arranged horizontally to the liquid surface of the electrolytic solution 7 and in which the gas generating surface is brought into contact with the liquid surface of the electrolytic solution 7.

FIG. 7 is a schematic configuration view of the gas generating device in which only an anode 52*a* having the through holes 6 is brought into contact with the liquid surface of the electrolytic solution 7 on its gas generating surface α. Herein, as a cathode 50, an electrode without having any through holes is used. To decide the position of the anode 52*a*, there can be exemplified a method for floating the electrode on the liquid surface of the electrolytic solution 7, a method for controlling the liquid surface at all times, or the like. According to this configuration, bubbles 8*a* can be quickly recovered. The cathode 50 may be in a rod shape or in a plate shape. When the gas generated at the cathode 50 does not hinder electrolysis, this configuration can be adopted.

In present embodiment, examples of the electrolytic solution 7 include molten salt containing hydrogen fluoride. The gas generated on the gas generating surface α of the anode 52*a* is a fluorine gas, while the gas generated at the cathode 50 is a hydrogen gas.

Hereinafter, effects of the gas generating device according to present embodiment will be illustrated.

In the gas generating device (FIG. 7) of present embodiment, at least one of the anode 52*a* or the cathode 50 is arranged horizontally to the liquid surface of the electrolytic solution 7 and the gas generating surface α is brought into contact with the liquid surface of the electrolytic solution 7.

Accordingly, since the entire gas releasing surface β is covered with gas and the bubbles 8*a* move to a side of the gas releasing surface β more quickly, the efficiency in recovering the bubbles 8*a* can be improved. Furthermore, even when lyophilic property of the gas generating surface α brought into contact with the electrolytic solution 7 is lowered, the electrolytic solution 7 does not move to a side of the gas releasing surface β via the through holes 6 so that a gas phase and a liquid phase are easily separated, and a capability to recover the gases is not lowered.

(Fourth Embodiment)

A gas generating device according to the fourth embodiment will be illustrated below with reference to FIGS. 8 and 9.

Figure 8:
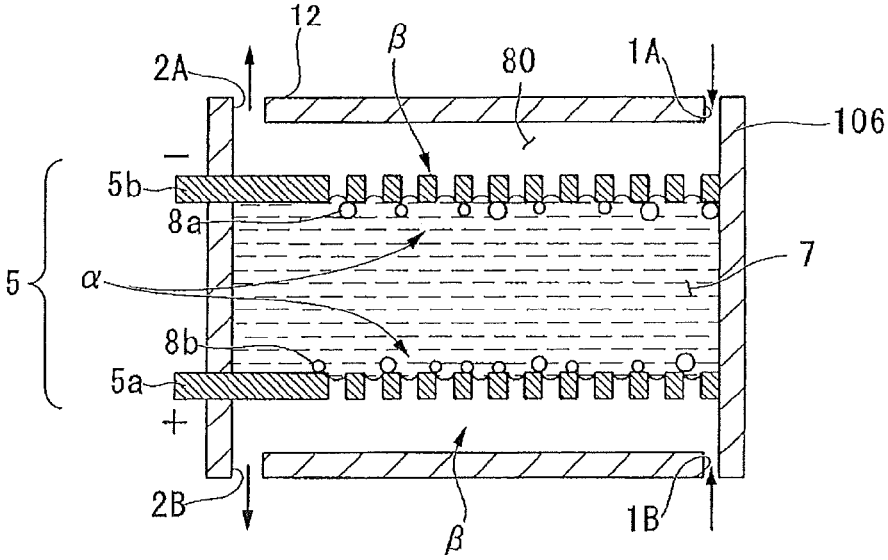
FIG. 8 is a schematic configuration view of an electrolyzer with an anode and a cathode horizontally arranged according to present embodiment.
Figure 9:
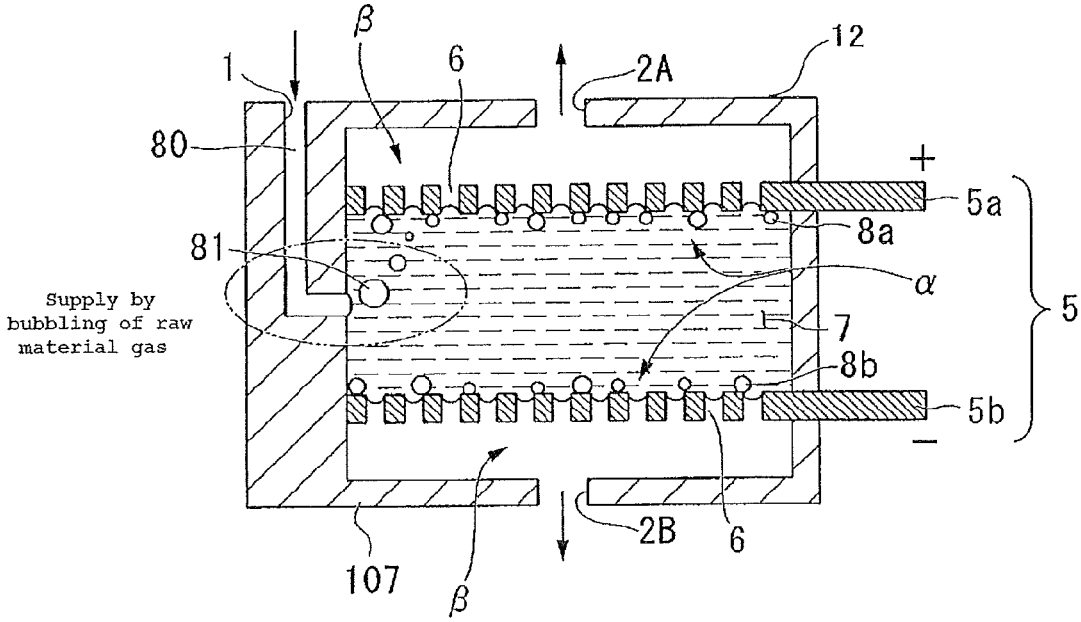
FIG. 9 is a schematic configuration view of an electrolyzer with an anode and a cathode horizontally arranged according to present embodiment.

As shown in FIGS. 8 and 9, an anode 5*a* and a cathode 5*b* are oppositely disposed to each other and at the same time horizontally disposed. The electrolytic solution 7 is filled between these electrodes.

The gas generating device of FIG. 8 is configured such that the raw material gas 80 can be supplied to the inside of the gas storage unit through a gas flow channel inlet 1A (inlet port) arranged on an electrolytic bath 76, and the raw material gas 80 is supplied to the electrolytic solution 7 via the through holes 6 of the cathode 5*b*. Herein, it can also be configured such that the raw material gas 80 is supplied to the electrolytic solution 7 via the through holes 6 of the anode 5*a*.

Via the through holes 6 capable of selectively passing the gases, the raw material gas 80 is supplied to the electrolytic solution 7 from the gas storage unit and dissolved in the electrolytic solution 7. Then, the bubbles 8*a* generated by electrolysis are moved to the gas storage unit from the gas generating surface α. Since the raw material gas 80 is easily dissolved in the electrolytic solution 7, the raw material gas 80 is selectively passed through the through holes 6 and dissolved in the electrolytic solution. Namely, the desired generated gases are passed through the through holes 6 of the electrode in the direction of the gas releasing surface β from the gas generating surface α of the electrode 5. On the other hand, the raw material gas 80 is passed through the through holes 6 of the electrode 5 in the direction of the gas generating surface α from the gas releasing surface β of the electrode 5 and dispersed in the electrolytic solution 7. Accordingly, the raw material can be additionally supplied to the electrolytic solution 7.

When either the bubbles 8*a* or 8*b* is desired gases, the device can be configured so as to recover only desired generated gases without replenishing the raw material gas 80 via the through holes 6 of the electrode for generating desired gases. In present embodiment, using molten salt containing hydrogen fluoride as the electrolytic solution, a hydrogen fluoride gas supplied to the gas storage unit of the cathode side for generating a hydrogen gas is exemplified as the raw material gas 80.

FIG. 9 is a schematic configuration view of a gas generating device for bubbling the raw material gas 80 into the electrolytic solution 7 in the gas generating device illustrated in FIG. 8.

In the aforementioned gas generating device with reference to FIG. 8, the raw material gas 80 is supplied via the through holes 6 of the electrode 5. Instead, the gas generating device as shown in FIG. 9 is configured so as to supply the gas to the electrolytic solution 7 by directly causing bubbling. Specifically, the raw material gas 80 is supplied directly to the electrolytic solution 7 from the gas flow channel inlet 1 in an electrolytic bath 77.

When the interval between the anode 5*a* and the cathode 5*b* is apart from each other, harmful effects such as increase of the electrolytic voltage and the like occur in some cases. So, the interval between the anode 5*a* and the cathode 5*b* is set narrow in order to achieve a desired electrolytic voltage in some cases.

When the interval between the anode 5*a* and the cathode 5*b* is narrowed, a convection current by heating or a convection current by bubbling hardly takes place between these electrodes. Thereby, the concentration of the electrolytic solution 7 between the electrodes is lowered or the concentration becomes non-uniform. As the result, the electric field becomes non-constant in some cases. Furthermore, when the depth (distance between the anode 5*a* and the cathode 5*b*) of the electrolytic bath 77 is shallow as compared to the width and area of the electrode 5 or the width and area of the electrolytic bath 77, a convection current by heating or a convection current by bubbling hardly takes place. Thereby, the concentration of the electrolytic solution 7 between the electrodes is lowered or the concentration becomes non-uniform. As the result, the electric field becomes non-constant in some cases. In order to solve this phenomenon, in FIG. 9, a method for supplying the raw material gas 80 from the gas releasing surfaces β of the anode 5*a* and the cathode 5*b* can also be adopted.

Hereinafter, effects of the gas generating device according to present embodiment will be illustrated.

The gas generating device of present embodiment is provided with a gas supply unit arranged at a gas storage unit of the anode 5*a* or the cathode 5*b*, and is configured so as to enable to supply the raw material gas 80 supplied from the gas supply unit to the electrolytic solution 7 via the through holes 6.

Accordingly, electrolysis can be continuously carried out and the concentration of the raw material can be maintained at a constant level so that electrolysis can be carried out with good efficiency.

Furthermore, as shown in FIG. 9, when the device is configured to supply the raw material gas 80 directly to the electrolytic solution 7 from the gas flow channel inlet 1 in the electrolytic bath 77, only the desired generated gases can be obtained from the anode 5*a* and/or cathode 5*b* without mixing the raw material gas therein as compared to the configuration of FIG. 8.

(Fifth Embodiment)

When the gas generated on the gas generating surface α of the anode hinders electrolysis of the electrolytic solution 7, the gas generating device according to the fifth embodiment uses an electrode having a gas permeable structure equipped with the through holes 6 in the anode. This gas generating device (electrolytic cell) will be described with reference to FIGS. 10 to 14. Incidentally, in present embodiment, using molten salt containing hydrogen fluoride as the electrolytic solution, a fluorine gas generated from the anode and a hydrogen gas generated from the cathode are exemplified herein.

FIGS. 10 to 14 illustrate a gas generating device using an electrode equipped with a plurality of through holes in the thickness direction of an electric conductor in a film shape or in a plate shape as an anode.

Figure 10:
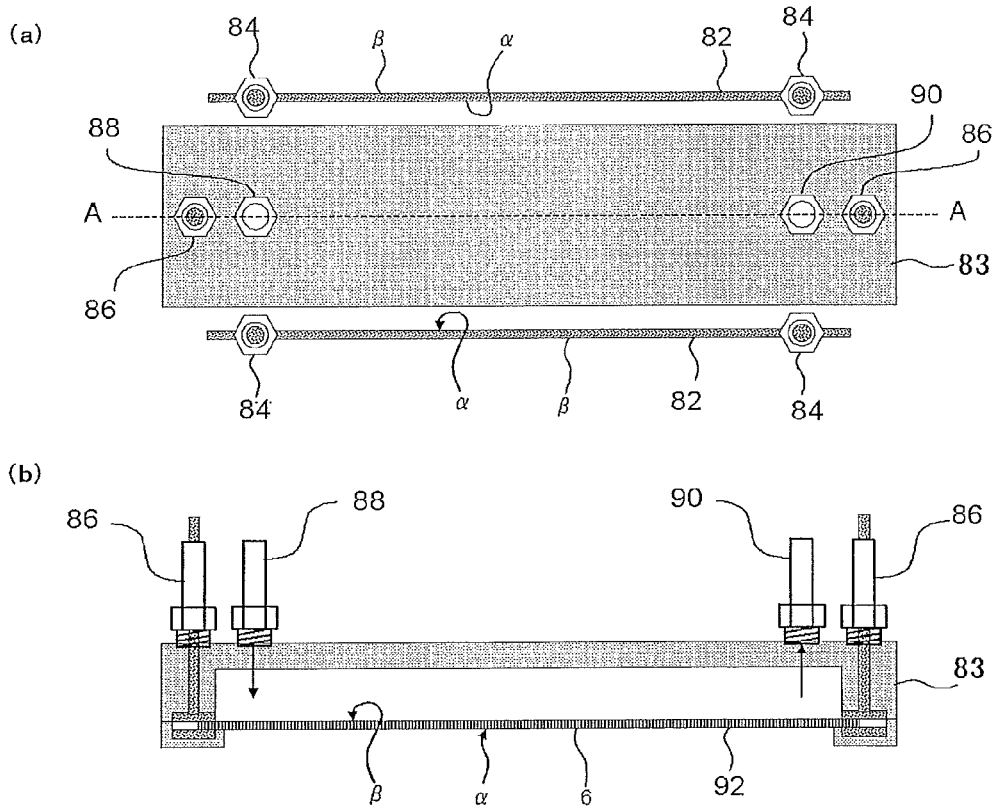
FIG. 10(*a*) is a top view and 10(*b*) is an A-A line sectional view of an electrolytic cell according to present embodiment.

FIG. 10 is a schematic configuration view of the gas generating device arranged such that the gas generating surface α of an anode 92 is brought into contact with the liquid surface of the electrolytic solution. Herein, illustration of the electrolytic bath and the electrolytic solution is omitted.

Figure 11:
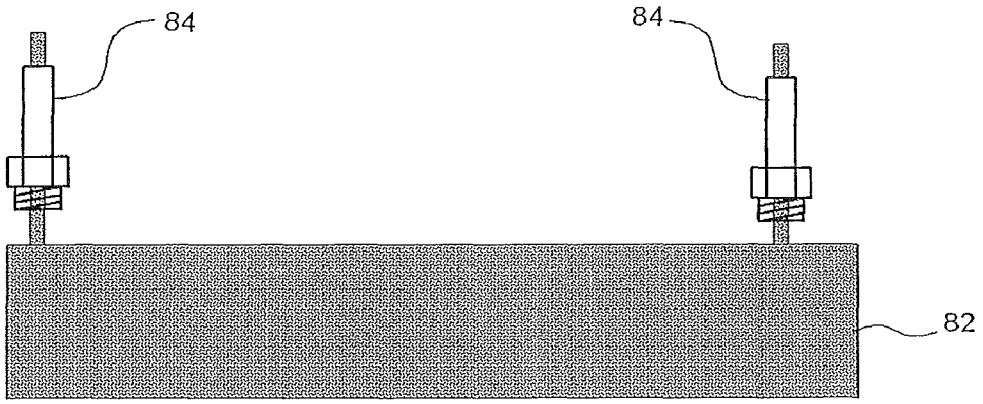
FIG. 11 is a side view of a cathode electrode of the electrolytic cell according to present embodiment.

FIG. 10(*a*) is a schematic top view of the gas generating device, while FIG. 10(*b*) is an A-A sectional view of FIG. 10(*a*). FIG. 11 is a top plan view of a cathode 82.

As shown in FIGS. 10(*a*) and (*b*), a gas storage unit 83 covers the gas releasing surface β of the anode 92. The anode 92 is electrically connected with the cathode 82 via connecting portions 86, 86 such that a voltage can be applied between these electrodes. Furthermore, an inert gas inlet port 88 and a gas discharge port 90 are arranged on an upper surface of the gas storage unit 83. Accordingly, the gas generated at the anode 92 can be recovered.

Two cathodes 82, 82 are arranged on both sides of the gas storage unit 83. The cathode 82 is electrically connected with the anode 92 via connecting portions 84, 84 such that a voltage can be applied between these electrodes (FIG. 11).

In the gas generating device illustrated in FIGS. 10 and 11, the gas generated on the gas generating surface α of the anode 92 moves to the inside of the gas storage unit 83 via the through holes 6. Then, an inert gas is introduced into the gas storage unit 83 from the inert gas inlet port 88, and the desired gas is recovered from the gas discharge port 90 along with the inert gas.

On the other hand, as shown in FIG. 10(*a*), the two cathodes 82, 82 are arranged on both sides of the anode 92 and arranged vertically to the liquid surface of the electrolytic solution. The cathode 82 does not have the through holes 6. The gas generated at the cathode 82 is grown in the form of bubbles on the gas generating surface α. Then, when bubbles become a predetermined size, bubbles float up from the gas generating surface α and are recovered.

Figure 12:
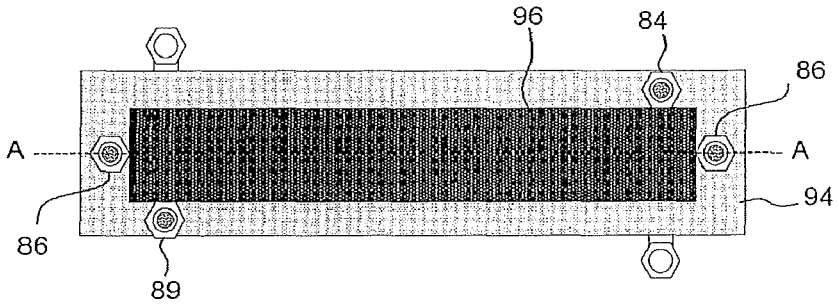
FIG. 12(*a*) is a top view and 12(*b*) is an A-A line sectional view of an electrolytic cell according to present embodiment.
Figure 12:
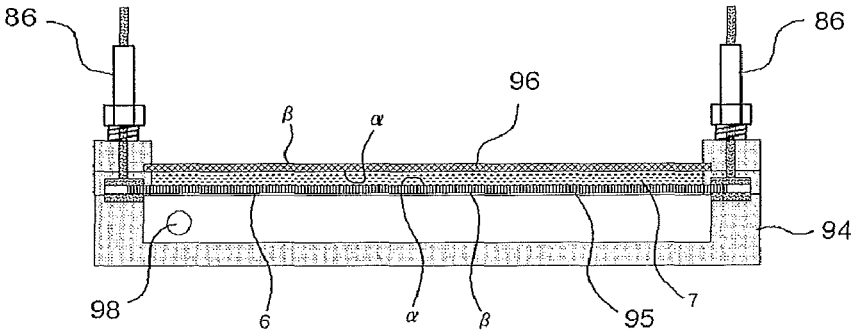

FIG. 12 is a schematic configuration view of an gas generating device in which an anode 95 and a cathode 96 are oppositely disposed to each other and arranged in parallel, and the electrolytic solution 7 is filled between these electrodes which are horizontally arranged.

FIG. 12(*a*) is a schematic top view of the gas generating device, while FIG. 12(*b*) is an A-A sectional view of FIG. 12(*a*).

As shown in FIG. 12(*b*), the anode 95 and the cathode 96 are oppositely disposed to each other and arranged in parallel, and the electrolytic solution 7 is filled between these electrodes which are horizontally arranged. The anode 95 is positioned below the cathode 96. A gas storage unit 94 covers the gas releasing surface β of the anode 95. The gas storage unit 94 is provided with an inert gas inlet port 98, and is configured such that the desired gases can be recovered from a gas discharge port (not illustrated).

In the gas generating device, the gas generated on the gas generating surface α of the anode 95 moves to the inside of the gas storage unit 94 placed below by the surface tension from the through holes 6. Then, the inert gas is introduced into the gas storage unit 94 from the inert gas inlet port 98, while the desired gas is recovered from the gas discharge port (not illustrated) along with the inert gas.

On the other hand, the cathode 96 is configured such that the gas generating surface α is brought into contact with the electrolytic solution and the gas generated on the gas generating surface α is passed upward via the fine gas flow channels. The gas storage unit (not illustrated) is arranged on an upper surface of the cathode 96, and the gas generated at the cathode 96 can be recovered. Since the gas generated at the cathode 96 is passed upward via the fine gas flow channels by buoyancy, a structure such as a nickel mesh can also be used.

Figure 13:
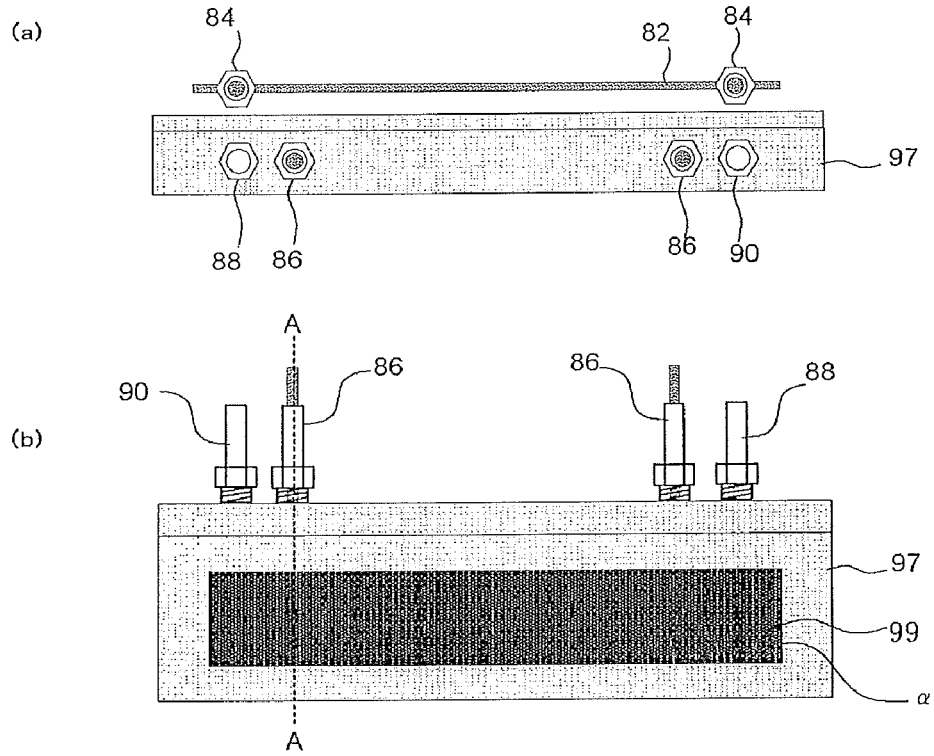
FIG. 13(*a*) is a top view of the electrolytic cell and 13(*b*) is a side view of an anode electrode according to present embodiment.

FIG. 13 is a schematic configuration view of a gas generating device in which a gas storage unit covers only a gas releasing surface β of an anode 99. FIG. 13(*a*) is a schematic top view of the gas generating device, while FIG. 13(*b*) is a side view of the anode of FIG. 13(*a*). Incidentally, illustration of the electrolytic bath and the electrolytic solution is omitted.

Figure 14:
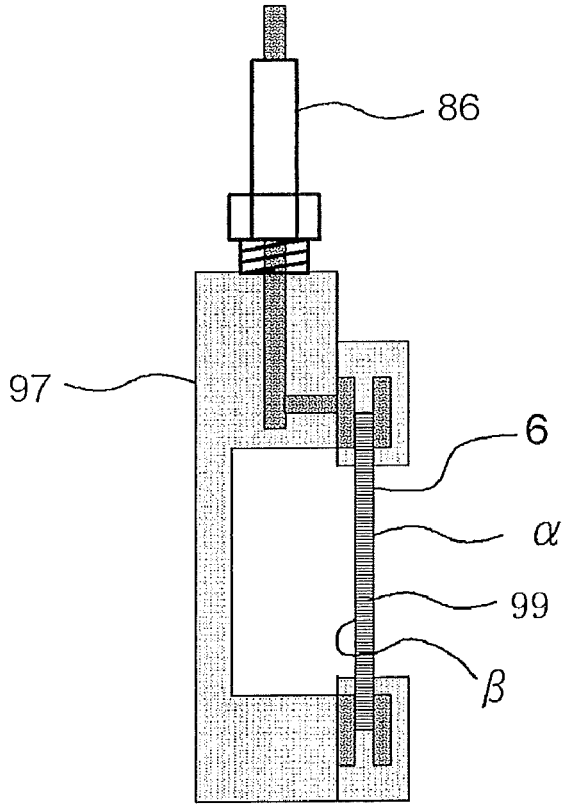
FIG. 14 is an A-A line sectional view of the cathode electrode in FIG. 13(*b*).

As shown in FIG. 13, the anode 99 and the cathode 82 are oppositely disposed to each other and arranged in parallel, and both of these electrodes are arranged perpendicular to the liquid surface of the electrolytic solution. FIG. 14 is an A-A sectional view of the anode 99 shown in FIG. 13(*b*). As shown in FIG. 14, a gas storage unit 97 covers the gas releasing surface β of the anode 99. The gas storage unit 97 is provided with the inert gas inlet port 88, and is configured such that the desired gas can be recovered from the gas discharge port 90.

In the gas generating device, the gas generated on the gas generating surface α of the anode 99 moves to the inside of the gas storage unit 97 from the through holes 6 by the surface tension. Then, an inert gas is introduced into the gas storage unit 97 from the inert gas inlet port 88, and the desired gas is recovered from the gas discharge port 90 along with the inert gas.

On the other hand, the gas generated at the cathode 82 is grown in the form of bubbles on the gas generating surface. Then, when bubbles become a predetermined size, bubbles float up from the gas generating surface and are recovered.

Furthermore, in present embodiment, an electrode in a structure equipped with the through holes 6 at the anode in use is exemplified. However, when the gas generated at the cathode does not hinder electrolysis, an electrode in a structure equipped with the through holes 6 at the cathode can also be used.

Hereinafter, effects of the gas generating device according to present embodiment will be illustrated.

In the gas generating device of present embodiment, only an electrode (anode) which generates a gas hindering electrolysis of the electrolytic solution is used as an electrode in a gas permeable structure having the through holes 6. Accordingly, the degree of freedom in the design of the other electrode (cathode) is improved and the degree of freedom in the design of the gas generating device is further improved.

(Sixth Embodiment)

A gas generating device according to the sixth embodiment is provided with a supporting substrate (substrate 150 for flow channel) and a cover substrate 152 arranged on the substrate 150 for flow channel. The device is provided with the liquid flow channel 102 comprised of a first flow channel formed on the substrate 150 for flow channel and the cover substrate 152 for covering the groove.

A first gas storage unit 104 and a second gas storage unit 106 are formed of a groove for second flow channel and a groove for third flow channel respectively formed apart from the groove for first flow channel on both sides of the groove for first flow channel on the substrate 150 for flow channel, and the cover substrate 152 for covering the groove for second flow channel and the groove for third flow channel.

The first carbon electrode 108 is arranged in the inside of a first recessed portion for arrangement of an electrode disposed between the groove for first flow channel and the groove for second flow channel on the substrate 150 for flow channel in contact therewith. The second carbon electrode 110 is arranged between the groove for first flow channel and the groove for third flow channel on the substrate 150 for flow channel in contact therewith and is arranged in the inside of the second recessed portion for arrangement of an electrode at a position facing to the first recessed portion for arrangement of an electrode.

Figure 18:
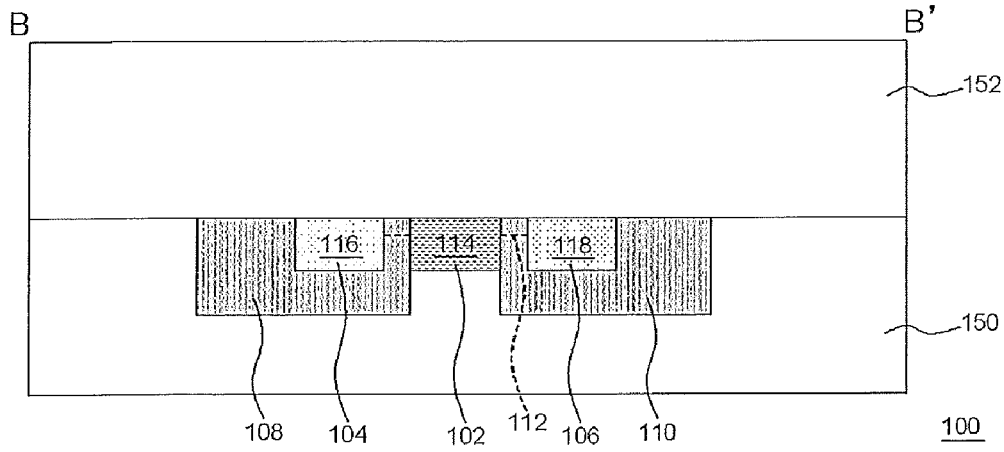
FIG. 18 is a B-B' sectional view of FIG. 15.
Figure 19:
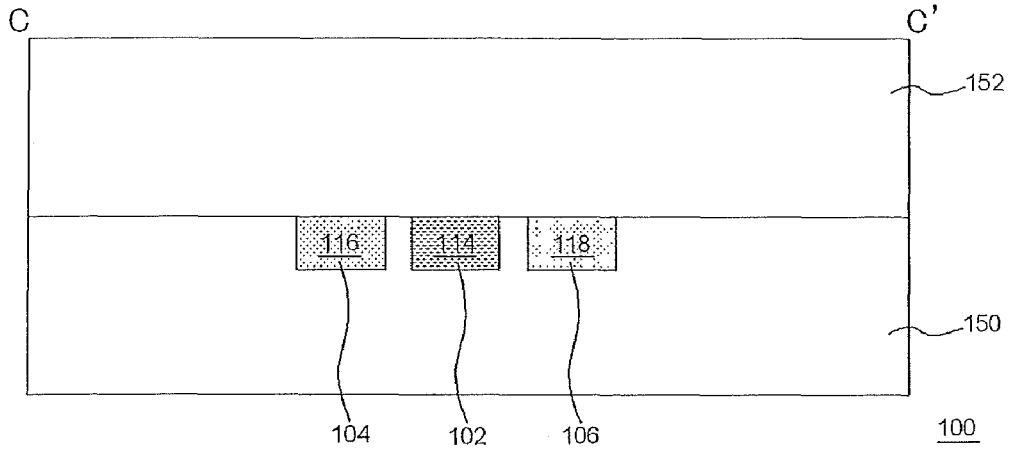
FIG. 19 is a C-C' sectional view of FIG. 15.
Figure 20:
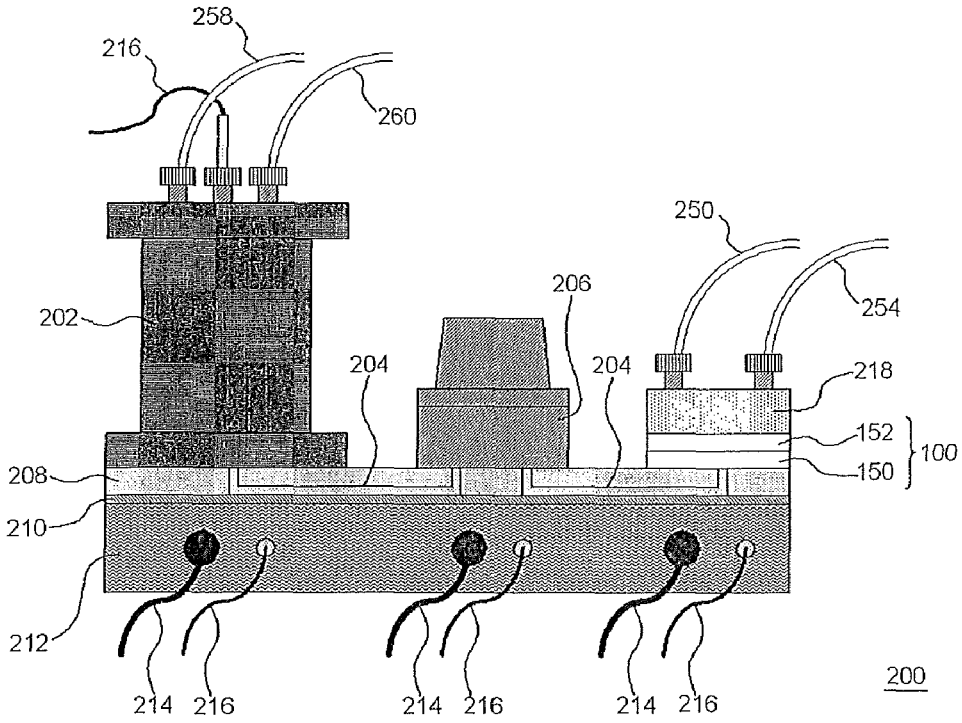
FIG. 20 is a view illustrating the configuration of an electrolytic cell mounting device with the electrolytic cell mounted thereon illustrated in FIG. 15.
Figure 21:
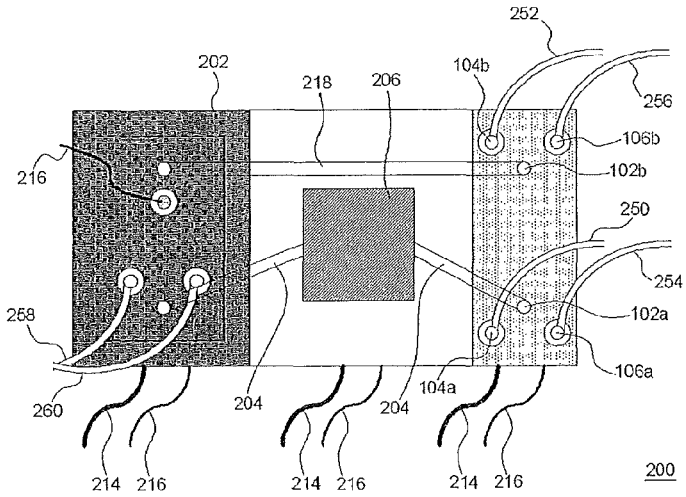
FIG. 21 is a view illustrating the configuration of the electrolytic cell mounting device with an electrolytic cell mounted thereon illustrated in FIG. 15.

The configuration of the electrolytic cell according to present embodiment is illustrated in FIGS. 15 to 19. Furthermore, the configuration that the electrolytic cell illustrated in FIGS. 15 to 19 is mounted on the electrolytic cell mounting device is illustrated in FIGS. 20 and 21. In present embodiment, the electrolytic cell 100 is composed of the supporting substrate (substrate 150 for flow channel) and the cover substrate 152 arranged on the substrate 150 for flow channel. In the following, the electrolytic cell 100 which is a microreactor is exemplified.

Figure 15:
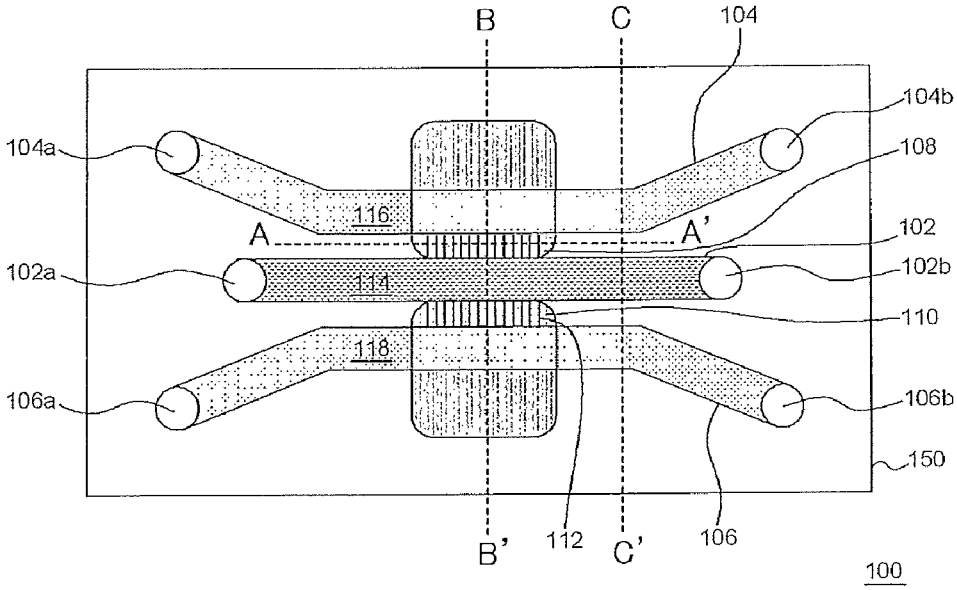
FIG. 15 is a view illustrating the configuration of an electrolytic cell according to present embodiment.
Figure 16:
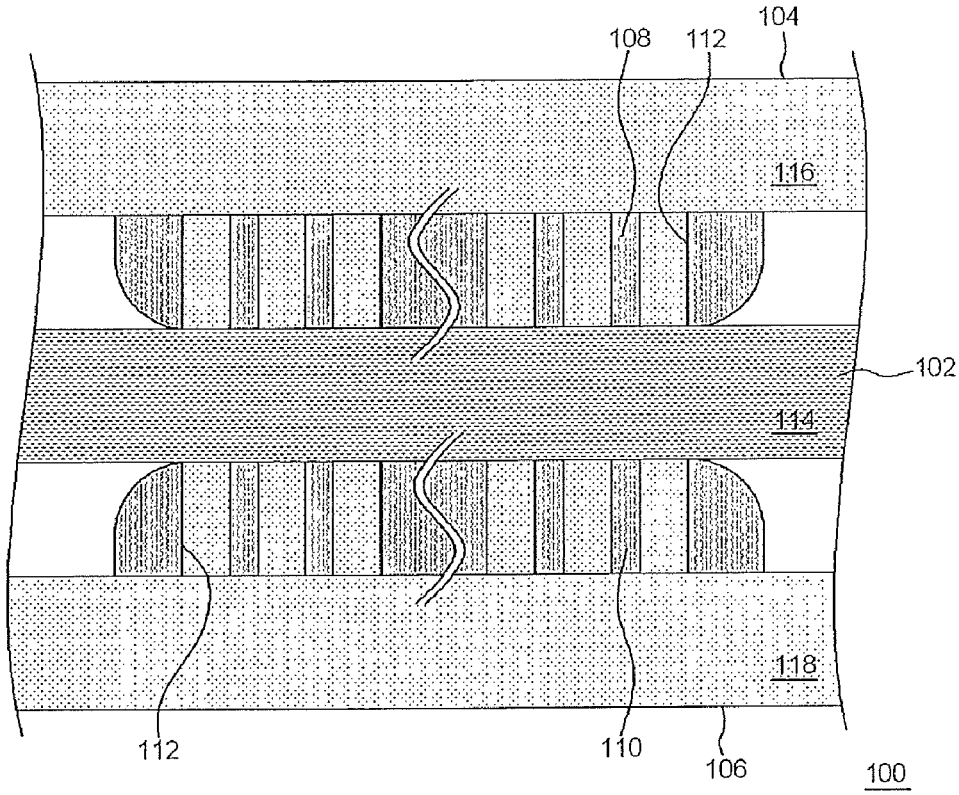
FIG. 16 is a partially enlarged top plan view illustrating a first electrode and a second electrode in FIG. 15.
Figure 17:
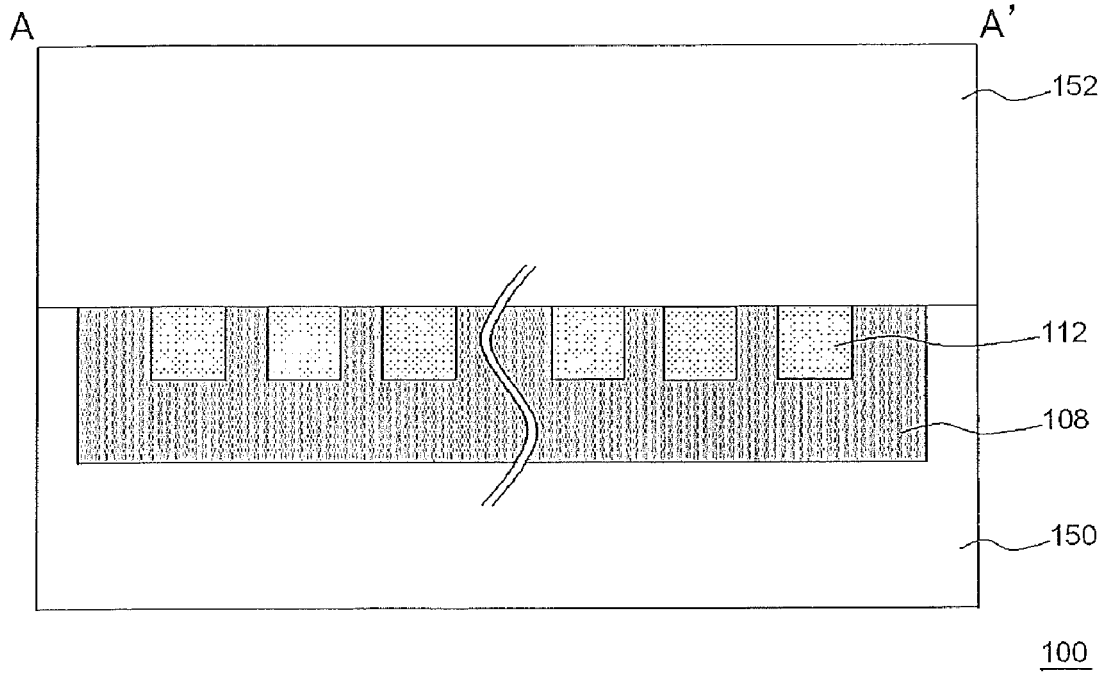
FIG. 17 is an A-A' sectional view of FIG. 15.

FIG. 15 is a top plan view (cover substrate 152 not illustrated) of the electrolytic cell 100. FIG. 16 is a partially enlarged top plan view enlarging the first electrode 108 and the second electrode 110 in FIG. 15. FIG. 17 is an A-A' sectional view of FIG. 15. FIG. 18 is a B-B' sectional view of FIG. 15. FIG. 19 is a C-C' sectional view of FIG. 15. FIGS. 17 to 19 illustrate the configuration including the cover substrate 152 as well.

In present embodiment, the liquid flow channel 102, the first gas flow channel 104 and the second gas flow channel 106 are composed of grooves (grooves for flow channel) formed on the substrate 150 for flow channel. Furthermore, recessed portions with the first electrode 108 and the second electrode 110 which are carbon substrates, fitted therein are also formed on the substrate 150 for flow channel. The first electrode 108 and the second electrode 110 are respectively fitted in the recessed portions.

Grooves respectively constituting parts of the first gas flow channel 104 and the second gas flow channel 106, and a plurality of fine grooves to be fine gas flow channels 112 are formed on the first electrode 108 and the second electrode 110. Herein, the first electrode 108 and the second electrode 110 are oppositely disposed to each other by sandwiching the liquid flow channel 102. Furthermore, in a region where the first electrode 108 and the second electrode 110 are arranged, the liquid flow channel 102, the first gas flow channel 104 and the second gas flow channel 106 are arranged substantially in parallel with one another. Furthermore, the end portions of the first gas flow channel 104 and the second gas flow channel 106 are bent so as to move away from each other and respectively placed at four corners of the substrate 150 for flow channel.

Hereinafter, effects of the gas generating device according to present embodiment will be illustrated.

In the gas generating device of present embodiment, a plurality of fine gas flow channels allowing a gas to pass therethrough but not allowing an electrolytic solution to pass therethrough are formed on the electrode. The liquid flow channel 102 allowing an electrolytic solution to flow therethrough is arranged on one side of the electrode, while the gas storage unit 104 (106) for receiving a gas is arranged on the other side of the electrode. The gas generated on the electrode surface is received in the gas storage unit 104 (106) through the fine gas flow channels 112.

According to this configuration, since the gas generated on the electrode surface is immediately removed from the electrode surface, a new electrolytic solution is supplied to the electrode surface and electrolysis can be carried out with good efficiency. Furthermore, since the gases generated on the electrode surfaces move as it is to the gas storage unit through the fine gas flow channels 112 formed on the electrodes and are separated, there is no need to arrange a partition or the like between the electrodes to avoid mixture of the generated gases.

In the gas generating device of present embodiment, a voltage is applied between the first electrode 108 and the second electrode 110 for electrolyzing the electrolytic solution 114, whereby the second gas is generated at the second electrode 110. It is possible to further arrange the second gas storage unit 106 for receiving the second gas, which is arranged through the second electrode 110 disposed between the liquid flow channel 102 and the second gas storage unit. On the second electrode 110, there are formed a plurality of fine gas flow channels 112 allowing a gas to pass therethrough but not allowing the electrolytic solution 114 to pass therethrough, while the liquid flow channel 102 and the second gas storage unit 106 can be configured to communicate with each other through the fine gas flow channels 112.

According to this configuration, since the gases respectively generated on the electrode surfaces are passed through the fine gas flow channels 112 formed on the electrodes as it is for moving to the first gas flow channel 104 or the second gas flow channel 106 and separated, there is no need to separate them by the use of a skirt or the like.

In the gas generating device of present embodiment, the first gas storage unit 104 can be a first gas flow channel having a gas inlet 104*a* for introducing an inert gas and a gas outlet 104*b* for leading out the aforementioned first gas along with the inert gas. Furthermore, the second gas storage unit 106 can be a second gas flow channel having a gas inlet 106*a* for introducing an inert gas and a gas outlet 106*b* for leading out the aforementioned second gas along with the inert gas.

The gas generating device of present embodiment can be further composed of the supporting substrate (substrate 150 for flow channel) and the cover substrate 152 placed on the substrate 150 for flow channel, while the liquid flow channel 102 can be composed of the groove for first flow channel formed on the substrate 150 for flow channel. The first gas storage unit 104 and the second gas storage unit 106 can be composed of the groove for second flow channel and the groove for third flow channel, which are respectively formed apart from the groove for first flow channel on both sides of the groove for first flow channel on the substrate 150 for flow channel, and the cover substrate 152. The first electrode 108 can be arranged in the inside of the first recessed portion for arrangement of an electrode disposed between the groove for first flow channel and the groove for second flow channel on the substrate 150 for flow channel in contact therewith. The second carbon electrode 110 can be arranged between the groove for first flow channel and the groove for third flow channel on the substrate 150 for flow channel in contact therewith and arranged in the second recessed portion for arrangement of an electrode disposed so as to have a portion facing to the aforementioned first recessed portion for arrangement of an electrode.

According to this configuration, the microreactor can be configured in a simple configuration.

In the gas generating device of present embodiment, the first electrode 108 and the second electrode 110 can be respectively composed of an electrode plate in a plate shape with grooves constituting the fine gas flow channels 112 formed thereon.

In the gas generating device of present embodiment, the first electrode 108 and the second electrode 110 can be respectively composed of a carbon plate.

In the gas generating device of present embodiment, the first electrode 108 can be composed of a first carbon plate with a plurality of through holes to be the fine gas flow channels 112, the second electrode 110 can be composed of a second carbon plate with a plurality of through holes to be the fine gas flow channels 112, the surface of the first electrode 108 and the surface of the second electrode 110 are oppositely disposed to each other, the liquid flow channel 102 is arranged between the first electrode 108 and the second electrode 110, the first gas storage unit 104 is arranged on the back side of the first electrode 108, and the second gas storage unit 106 is arranged on the back side of the second electrode 110.

In the gas generating device of present embodiment, a plurality of first electrodes 108 and a plurality of second electrodes 110 may be arranged in the order of the second electrode 110, the first electrode 108, the first electrode 108 and the second electrode 110. Thus, a region between the first electrode 108 and the second electrode 110 can be defined as the liquid flow channel 102, and a region between the first electrode 108 and the first electrode 108 can be defined as the first gas storage unit 104.

In the gas generating device of present embodiment, the electrolytic solution 114 can be molten salt containing hydrogen fluoride. When the first electrode 108 is an anode, a fluorine gas may be generated at the first electrode 108, and a hydrogen gas may be generated at the second carbon electrode 110.

According to this configuration, even when a carbon electrode is used as the first electrode 108 which is an anode and a fluorine gas is to be generated, the fluorine gas generated on the anode surface is immediately removed from the electrode surface. Thus, the reaction of the fluorine gas with carbon is suppressed. Furthermore, since a new electrolytic solution is supplied to the electrode surface, electrolysis can be carried out with good efficiency. Furthermore, generation of a by-product such as $CF_4$ or the like can also be suppressed.

Incidentally, any arbitrary combination of the aforementioned constituent elements and the expression of the present invention changed among a process, a device and the like are also effective as the embodiments of the present invention.

EXAMPLES

The present invention is now illustrated in detail below with reference to Examples. However, the present invention is not restricted to these Examples.

Example A1

In present Example, the gas generating device (electrolytic cell 100) illustrated in FIGS. 15 to 19 was used. The electrolytic cell 100 of present Example was prepared in the following order.

Since the first electrode 108 and the second electrode 110 have the same configuration, the production procedure of the first electrode 108 is described herein. The second electrode 110 was also prepared in the same manner. A carbon plate (IMF307 1 mmt, a product of Nippon Techno-Carbon Co., Ltd.) to be the first electrode 108 was subjected to machining process and hollowed out at a size of 12 mm×10 mm (r=1 mm). Subsequently, a groove (width: 1.0 mm, depth: 500 μm, a portion corresponding to the first gas flow channel 104 of FIG. 18) to be a part of the first gas flow channel 104 and grooves (portions corresponding to the fine gas flow channels 112 of FIG. 17) to be the fine gas flow channels 112 were processed. The fine gas flow channels 112 were formed by machining process using an end mill having a diameter of 100 μm (solid carbide square end mill AMEL-0.1×1, a product of Saito Seisakusho). Herein, the fine gas flow channels 112 were made in a structure of rectangular grooves perpendicular to the liquid flow channel 102 and the first gas flow channel 104. The size of the fine gas flow channel 112 was 100 μm in width, 100 μm in depth and 400 μm in length, and the fine gas flow channels 112 were formed at fixed intervals so as to be 75 μm in width with the adjacent fine gas flow channels 112. The length of the portion of the first electrode 108 in contact with the liquid flow channel 102 was set to 10 mm. Furthermore, the electrode area of the first electrode 108 in contact with the liquid flow channel 102 was set to 0.05 $cm^2$.

Subsequently, a polycarbonate plate (30 mm×70 mm, 2 mmt) to be the substrate 150 for flow channel was subjected to machining process, the liquid flow channel 102 was formed, and grooves (respectively width: 1.0 mm, depth: 500 μm, portions corresponding to the liquid flow channel 102, the first gas flow channel 104 and the second gas flow channel 106 of FIG. 19) to be the first gas flow channel 104 and the second gas flow channel 106 were formed on both sides of the liquid flow channel 102. Each cross section of the grooves was shaped to a rectangle. Furthermore, recessed portions (portions corresponding to the first electrode 108 and the second electrode 110 of FIG. 18) for fitting the first electrode 108 and the second electrode 110 therein were processed. The first electrode 108 and the second electrode 110 were respectively fitted in the recessed portions. Accordingly, the groove to be the first gas flow channel 104 formed on the first electrode 108 was connected with the groove to be the first gas flow channel 104 formed on the substrate 150 for flow channel, whereby the first gas flow channel 104 was formed. In the same manner, the groove to be the second gas flow channel 106 formed on the second electrode 110 was connected with the groove to be the second gas flow channel 106 formed on the substrate 150 for flow channel, whereby the second gas flow channel 106 was formed.

Next, a polycarbonate plate (30 mm×70 mm, 2 mmt) to be the cover substrate 152 was subjected to machining process, through holes were respectively arranged on the positions corresponding to both ends of the liquid flow channel 102, both ends of the first gas flow channel 104 and both ends of the second gas flow channel 106 on the substrate 150 for flow channel. A diameter of the respective through holes was 1 mm. The through holes arranged on the liquid flow channel 102 were defined as the liquid inlet 102*a* and the liquid outlet 102*b*. The through holes arranged on the first gas flow channel 104 were defined as the gas inlet 104*a* and the gas outlet 104*b*. The through holes arranged on the second gas flow channel 106 were defined as the gas inlet 106*a* and the gas outlet 106*b*. The substrate 150 for flow channel and the cover substrate 152 were stacked in this order and fixed by screws or the like, whereby the electrolytic cell 100 was prepared.

The thus-prepared electrolytic cell 100 was mounted on an electrolytic cell mounting device 200 illustrated in FIGS. 20 and 21. Herein, as the electrolytic solution 114, molten salt of KF·2.3HF (melting point of about 80 degrees centigrade) was used.

The electrolytic cell mounting device 200 was composed of a heater block 212 and a molten salt flow channel plate 208 formed on the heater block. A separator 210 was arranged between the heater block 212 and the molten salt flow channel plate 208. Rod heaters 214 and thermocouples 216 were inserted in the heater block 212. The temperature was measured by using the thermocouple 216 for controlling the rod heater 214, whereby the temperature was controlled. A molten salt bath 202 for receiving molten salt and a pump 206 which is a gear pump, were arranged on the molten salt flow channel plate 208, and the electrolytic cell 100 was mounted on the molten salt flow channel plate 208. On the molten salt flow channel plate 208, there were formed molten salt flow channels 204 connected to the liquid inlet 102*a* in the electrolytic cell 100 through the pump 206 from the molten salt bath 202.

The electrolytic cell 100 was pressed by a pressing plate 218. The molten salt bath 202, the pump 206 and the electrolytic cell 100 were press-bonded onto the heater block 212 using screws by sandwiching the molten salt flow channel plate 208 and the separator 210. Furthermore, the temperature of the heater block 212 was controlled at 100 degrees centigrade.

In this state, using the pump 206, molten salt was supplied to the liquid inlet 102*a* in the electrolytic cell 100 from the molten salt bath 202 at a flow rate of 1.0 mL/min. Further, nitrogen was supplied respectively to the first gas flow channel 104 and the second gas flow channel 106 from the gas inlet 104*a* and the gas inlet 106*a* at a flow rate of 10 mL/min. In present Example, since the surface tension $\gamma$ of the electrolytic solution 114 was 94 [mN/m], the contact angle $\theta$ was 140° and the width w of the fine gas flow channel 112 was 100 μm, the pressure required for pushing the electrolytic solution 114 into the fine gas flow channels 112 at this time was calculated at 2.88 [kPa]. Furthermore, the pressure $P_1$ applied to the electrolytic solution 114 was 1.03 [kPa] (calculated value), while the pressures $P_2$ of the first gas flow channel 104 and the second gas flow channel 106 were respectively $1.58\times10^{-2}$ [kPa] (calculated value). The electrolytic cell 100 was configured to satisfy the above equation (4). At this time, it was confirmed that, by microscope observation, the electrolytic solution 114 was not leaked to the first gas flow channel 104 or the second gas flow channel 106 from the liquid flow channel 102. Furthermore, it was confirmed that, by microscope observation, the gas-liquid interfaces were formed in the vicinity of an interface between the liquid flow channel 102 and the first gas flow channel 104, and an interface between the liquid flow channel 102 and the second gas flow channel 106.

In this state, a voltage was applied between the first electrode 108 and the second electrode 110 such that the first electrode 108 served as an anode and the second electrode 110 served as a cathode for carrying out constant voltage electrolysis at 6.0 V. In the first electrode 108 and the second electrode 110, the gases generated by electrolysis were attached to respective electrodes at first. However, it was confirmed that when the gases were contacted with the gas-liquid interface, the gases were immediately incorporated into gases in the first gas flow channel 104 and the second gas flow channel 106, and disappeared.

Meanwhile, the gas coming out from the gas outlet 104*b* in the first gas flow channel 104 at a side of the first electrode 108 which is an anode, was collected in a Tedlar bag, and a fluorine gas detector tube (gas detector tube No. 17, a product of Gastec Corporation) was used for the measurement. As a result, an indicator of the detector tube was bleached to white. Accordingly, it could be confirmed that a fluorine gas was generated. Furthermore, at the cathode, a hydrogen gas could be recovered.

Figure 22:
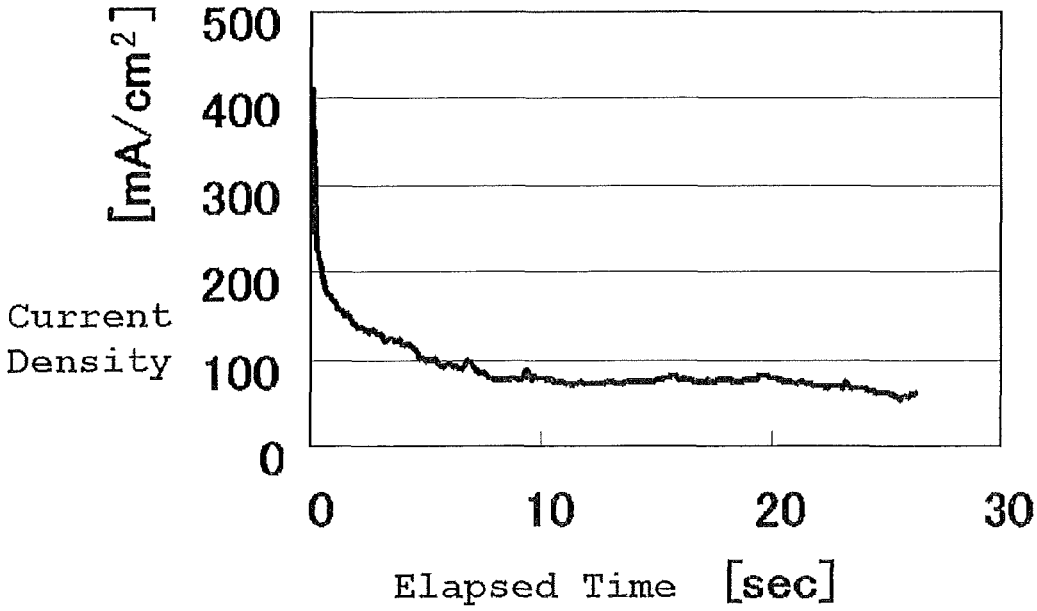
FIG. 22 is a view illustrating the amount of change with the time of current density according to Example.

The amount of change with the time of current density in present Example is illustrated in FIG. 22. Immediately after a voltage was applied, a current was flowed at a current density of about 400 mA/cm$^2$ and the current density was gradually decreased. However, thereafter it was stable at a current density of about 75 mA/cm$^2$.

Comparative Example A1

Figure 23:
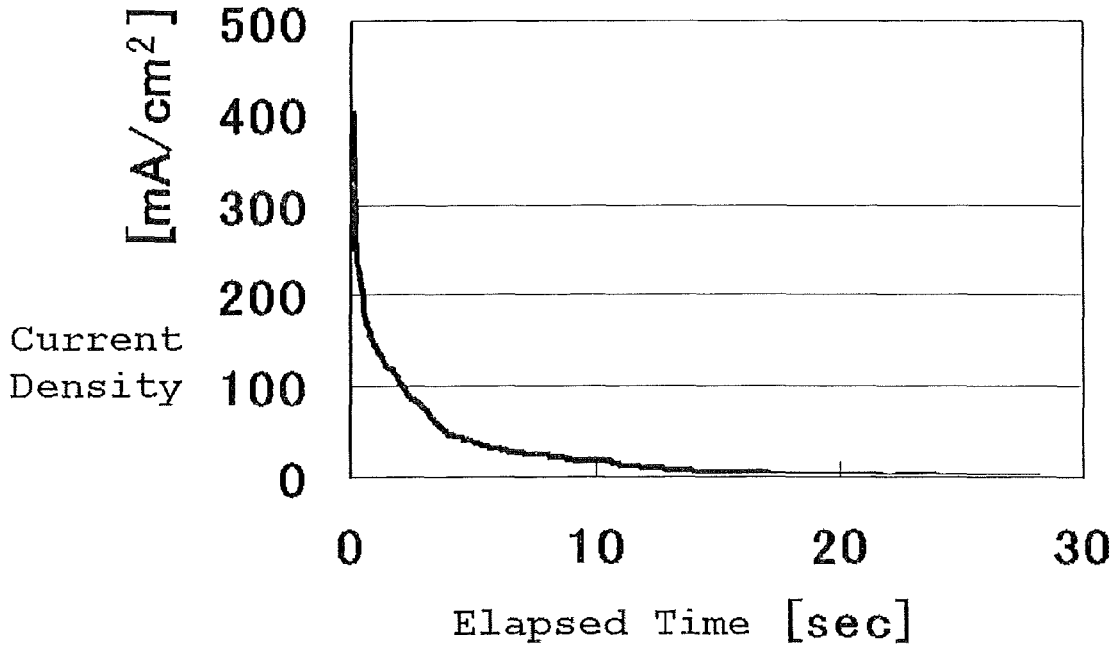
FIG. 23 is a view illustrating the amount of change with the time of current density according to Comparative Example.

The experiment was carried out in the same manner as in Example A1, except that the fine gas flow channels 112 were not formed on a carbon plate as the first electrode 108 and the second electrode 110. A voltage of 6.0 V was applied between the first electrode 108 and the second electrode 110 for measuring the amount of change over the time of current density. The results are illustrated in FIG. 23. Immediately after a voltage was applied, a current was flowed at a current density of about 400 mA/cm$^2$, but the current density was gradually decreased and the current was hardly flowed after about 15 seconds. That was considered because bubbles generated at respective electrodes might be attached to the electrodes and the electrodes could not be brought into contact with molten salt.

Example A2-1

Figure 24:
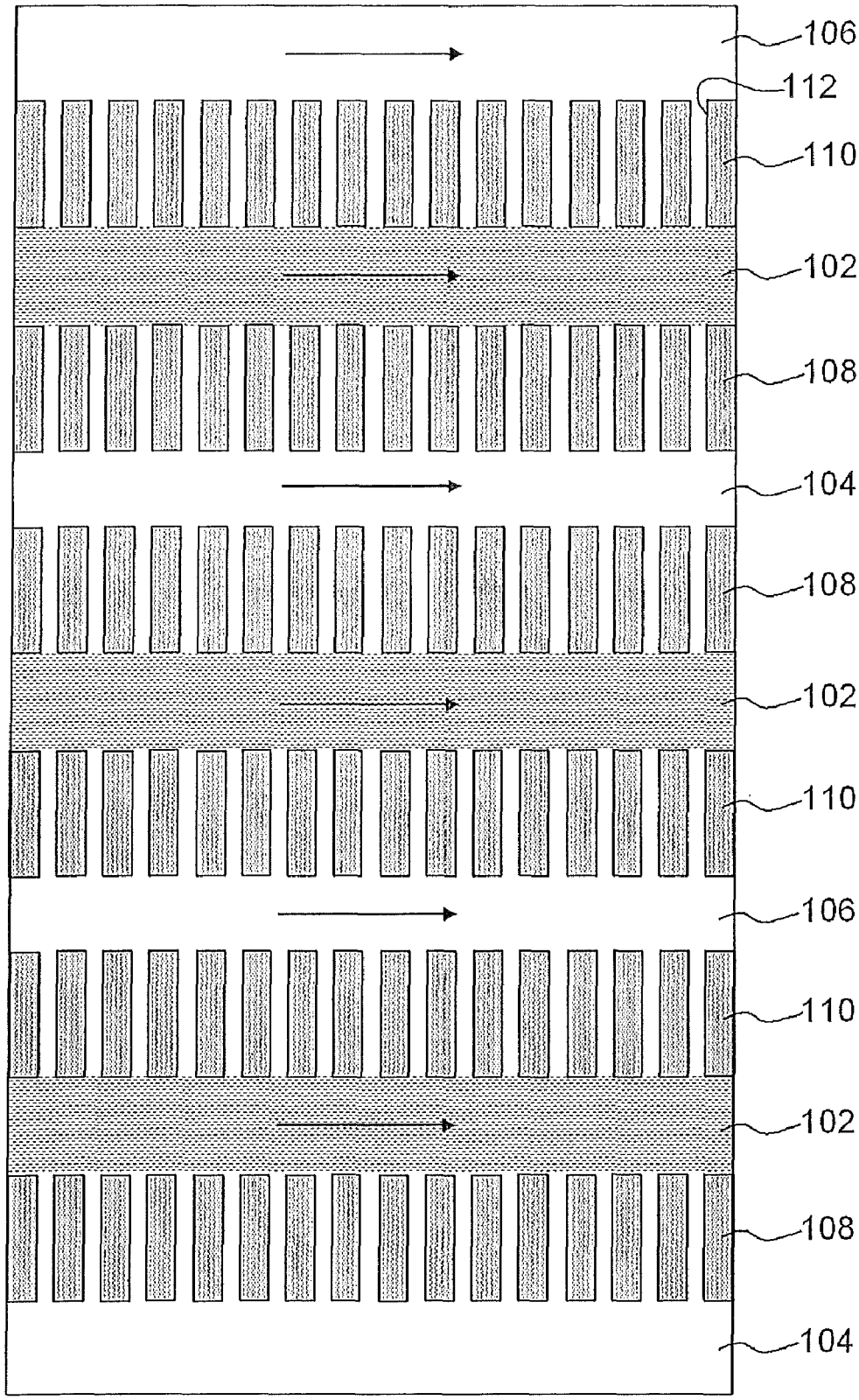
FIG. 24 is a schematic view illustrating the configuration of another example of an electrolytic cell according to Example.
Figure 25:
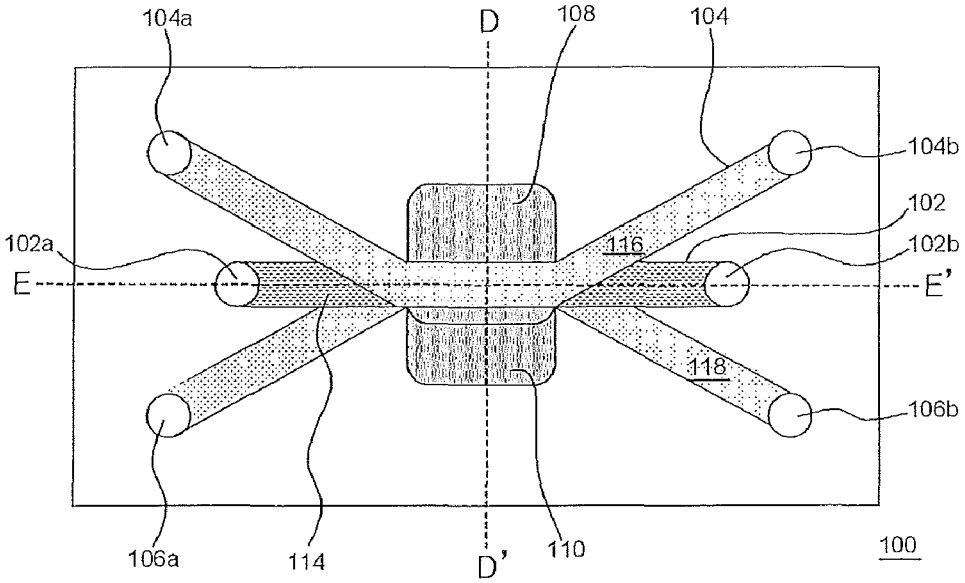
FIG. 25 is a top plan view illustrating the configuration of the electrolytic cell according to Example.
Figure 26:
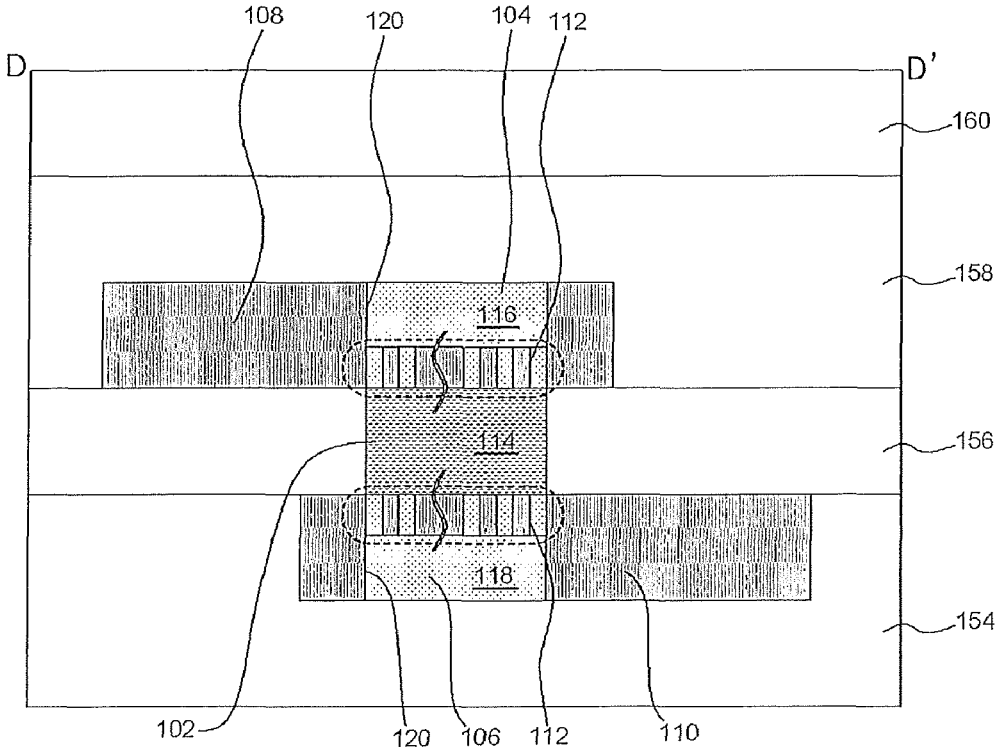
FIG. 26 is a D-D' sectional view of FIG. 25.
Figure 27:
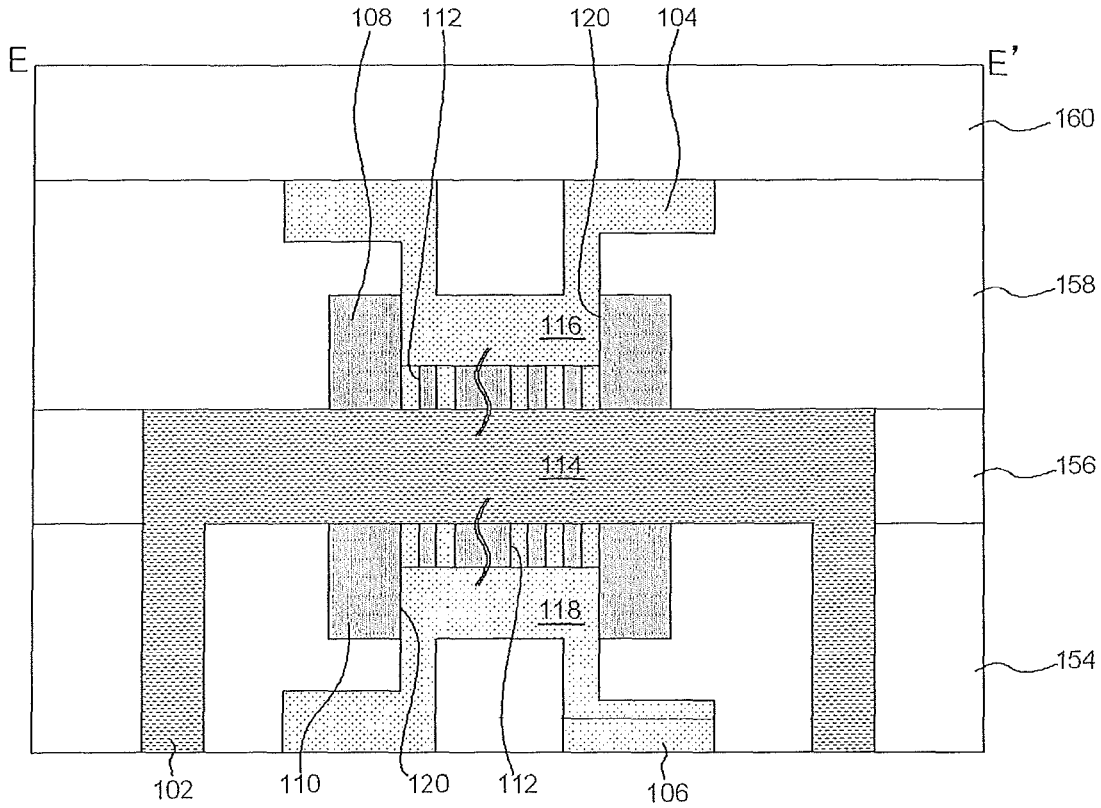
FIG. 27 is an E-E' sectional view of FIG. 25.

In present Example, the configuration of the electrolytic cell is illustrated in FIGS. 24 to 29. In present Example, the electrolytic cell 100 was composed of a second electrode substrate 154, a flow channel substrate 156 arranged thereon, a first electrode substrate 158 arranged thereon and a cover substrate 160 arranged thereon. FIG. 25 is a top plan view of the electrolytic cell 100. Herein, in order to easily understand the configuration, the flow channel substrate 156, the first electrode substrate 158 and the cover substrate 160 are transparently illustrated. FIG. 26 is a D-D' sectional view of FIG. 25. FIG. 27 is an E-E' sectional view of FIG. 25.

In present Example, the liquid flow channel 102, the first gas flow channel 104 and the second gas flow channel 106 were respectively formed on different substrates. As shown in FIG. 26, the liquid flow channel 102 was formed on the flow channel substrate 156, the first gas flow channel 104 was formed on the first electrode substrate 158, and the second gas flow channel 106 was formed on the second electrode substrate 154 respectively. Furthermore, the first electrode 108 and the second electrode 110 were arranged respectively on the first electrode substrate 158 and the second electrode substrate 154. As shown in FIG. 27, the liquid flow channel 102 was also arranged on the second electrode substrate 154.

Figure 28:
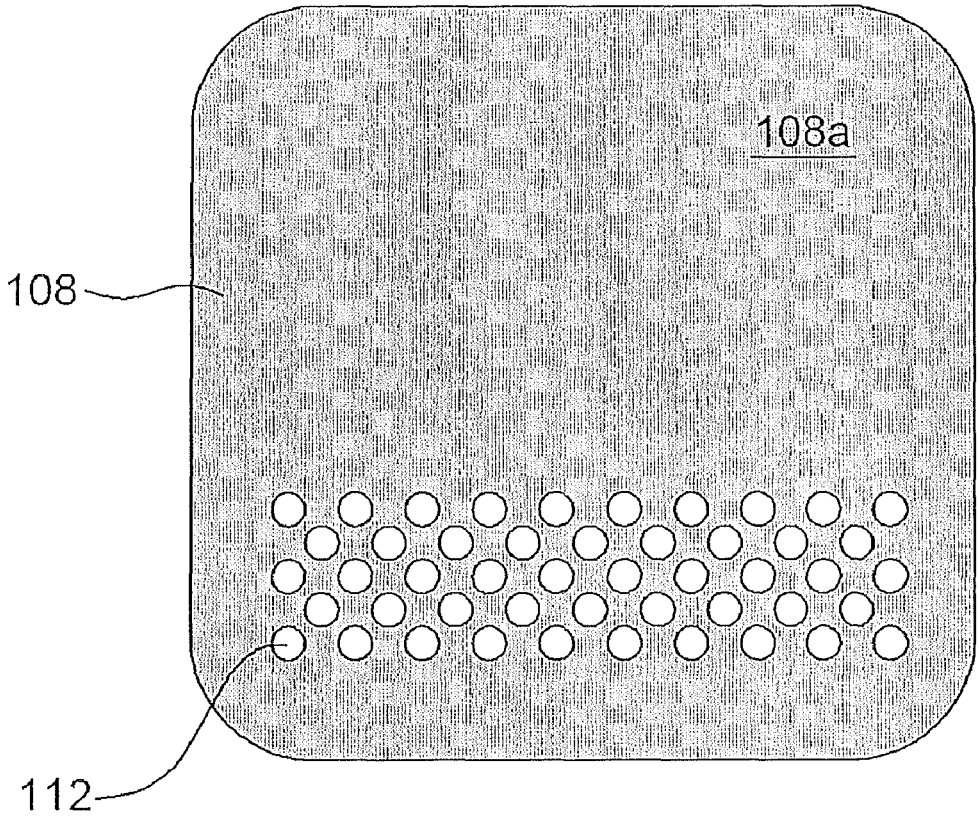
FIG. 28(*a*) is a schematic view of a front surface and 28(*b*) is a schematic view of a back surface of a first electrode in FIG. 25.
Figure 28:
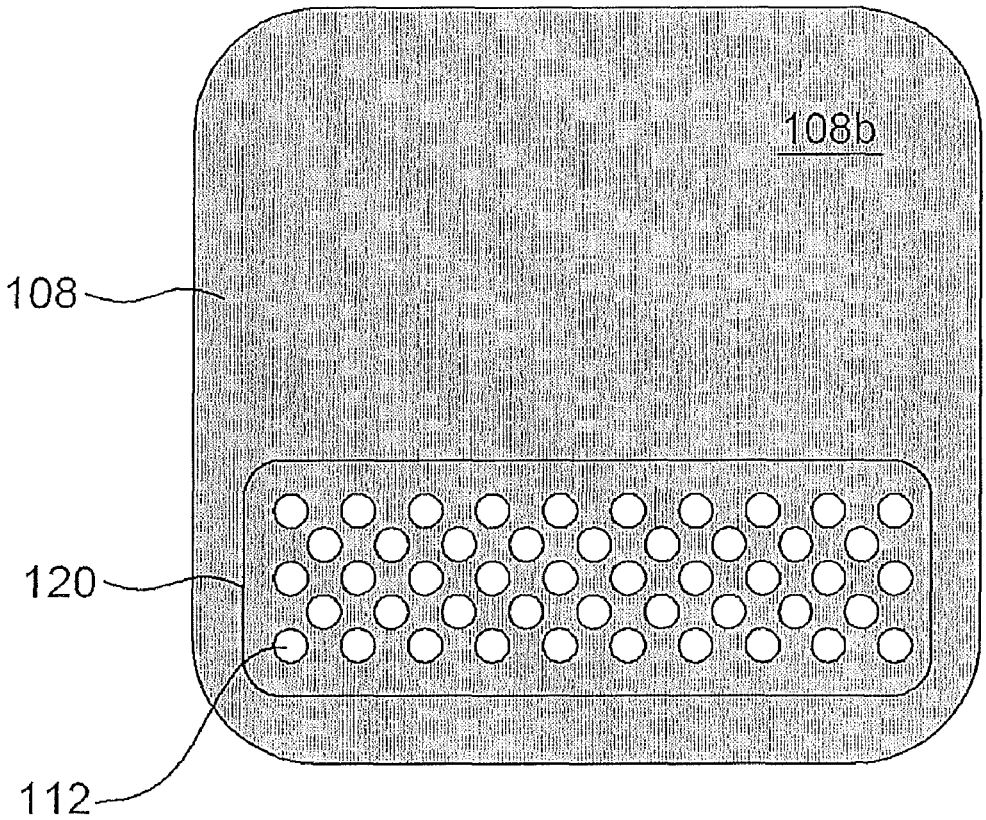

FIG. 28 is a schematic view of a surface and a back surface of the first electrode 108 in FIG. 25. Since the first electrode 108 and the second electrode 110 have the same configuration, the configuration of the first electrode 108 is described herein. FIG. 28(*a*) illustrates a surface of the first electrode 108 in contact with the liquid flow channel 102 which is a surface of the first electrode 108 in contact with the electrolytic solution 114 (hereinafter referred to as a surface 108*a*). FIG. 28(*b*) illustrates an opposite surface of the first electrode 108 in contact with the liquid flow channel 102 which is a surface in contact with the first gas flow channel 104 (hereinafter referred to as a back surface 108*b*). A plurality of fine gas flow channels 112 were arranged on the first electrode 108. Furthermore, a recessed portion (counterbore) 120 was arranged on the back surface 108*b* of the first electrode 108.

Figure 29:
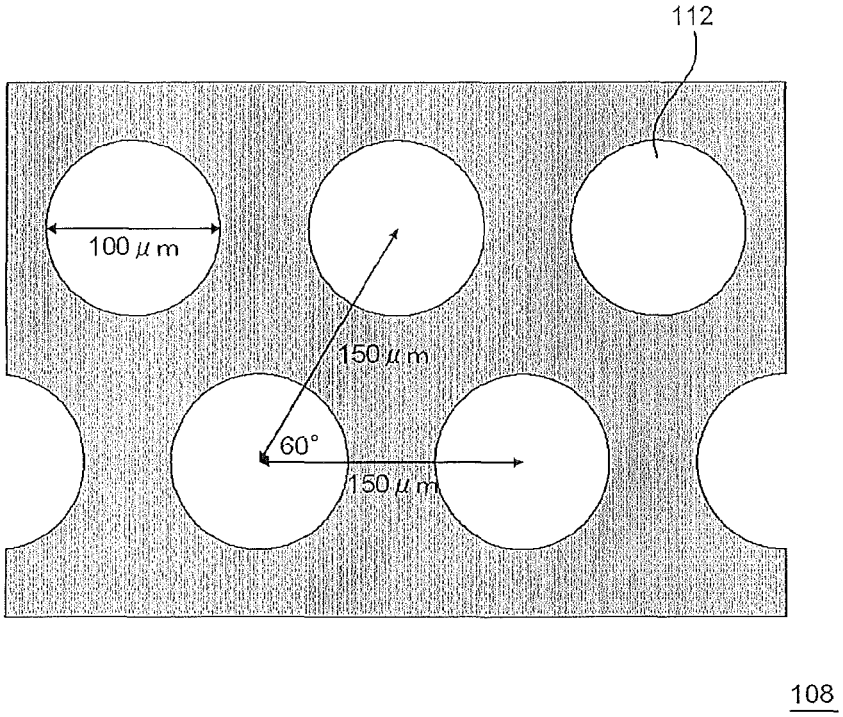
FIG. 29 is a partially enlarged view illustrating an enlarged part of fine gas flow channels on the first electrode.

FIG. 29 is a partially enlarged view enlarging a portion of the fine gas flow channels 112 on the first electrode 108. The fine gas flow channels 112 could be arranged, for example, in a 60° zig-zag form at a pitch of 150 μm.

The electrolytic cell 100 of present Example was prepared in the following order.

Since the first electrode 108 and the second electrode 110 have the same configuration, the production procedure of the first electrode 108 is described herein. The second electrode 110 was also prepared in the same manner. A carbon plate to be the first electrode 108 (IMF307 1 mmt, a product of Nippon Techno-Carbon Co., Ltd.) was subjected to machining process and hollowed out at a size of 12 mm×10 mm (r=1 mm). Subsequently, a recessed portion 120 illustrated in FIG. 28(*b*) was formed. The depth of the recessed portion was 0.6 mm. Furthermore, holes to be the fine gas flow channels 112 were processed on a portion with the recessed portion 120 in the first electrode 108 formed thereon. The fine gas flow channels 112 were formed by machining process using a drill having a diameter of 100 μm (solid carbide roumer drill ADR-0.1, a product of Saito Seisakusho). The size of the fine gas flow channel 112 was 100 μm in diameter. Furthermore, as shown in FIG. 29, a plurality of fine gas flow channels 112 were arranged in a 60° zig-zag form at a pitch of 150 μm. A region of the portion with the fine gas flow channels 112 formed thereon in contact with the electrolytic solution 114 in the liquid flow channel 102 was 1 mm in width and 10 mm in length.

Since the first electrode substrate 158 and the second electrode substrate 154 have the same configuration, the production procedure of the first electrode substrate 158 is described herein. The second electrode substrate 154 was also prepared almost in the same manner. A polycarbonate plate (30 mm×100 mm, 2 mmt) to be the first electrode substrate 158 was subjected to machining process for forming a recessed portion for fitting the first electrode 108 therein. Furthermore, the first gas flow channel 104 for connecting with the recessed portion 120 in the first electrode 108 was formed on the first electrode substrate 158. The size of the first gas flow channel 104 of a portion in contact with the fine gas flow channels 112 was 1.0 mm in width, 10 mm in length and 600 μm in depth. Incidentally, a contact hole to be the liquid flow channel 102 was formed on the second electrode substrate 154.

Subsequently, a polycarbonate plate (30 mm×70 mm, 1 mmt) to be the flow channel substrate 156 was subjected to machining process for forming the liquid flow channel 102. Both ends of the liquid flow channel 102 were respectively connected with the liquid inlet 102*a* and the liquid outlet 102*b* via the through holes formed on the second electrode substrate 154. Diameters of the through holes were respectively 1 mm.

Next, a polycarbonate plate (30 mm×70 mm, 2 mmt) to be the cover substrate 160 was subjected to machining process, and through holes were formed respectively at the positions corresponding to both ends of the first gas flow channel 104 in the first electrode substrate 158. Diameters of the through holes were respectively 1 mm. The second electrode substrate 154, the flow channel substrate 156, the first electrode substrate 158 and the cover substrate 160 were laminated in this order and fixed by screws or the like, whereby the electrolytic cell 100 was prepared.

The thus-prepared electrolytic cell 100 was mounted on the same electrolytic cell mounting device 200 as that illustrated with reference to FIGS. 20 and 21 in Example A1, and the electrolytic solution was electrolyzed, whereby gases were generated. Herein, as the electrolytic solution 114, molten salt of KF·2.3HF (melting point of about 80 degrees centigrade) was used.

The electrolytic cell 100 was pressed by the pressing plate 218, and the molten salt bath 202, the pump 206 and the electrolytic cell 100 were press-bonded onto the heater block 212 using screws by sandwiching the molten salt flow channel plate 208 and the separator 210 therebetween. Furthermore, the temperature of the heater block 212 was controlled at 100 degrees centigrade.

In this state, using the pump 206, molten salt was supplied to the liquid inlet 102*a* in the electrolytic cell 100 from the molten salt bath 202 at a flow rate of 1.0 mL/min. Further, nitrogen was supplied respectively to the first gas flow channel 104 and the second gas flow channel 106 from the gas inlet 104*a* and the gas inlet 106*a* at a flow rate of 10 mL/min. In present Example, since the surface tension $\gamma$ of the electrolytic solution 114 was 94 [mN/m], the contact angle $\theta$ was 140° and the width (diameter) w of the fine gas flow channel 112 was 100 μm, the pressure required for pushing the electrolytic solution 114 into the fine gas flow channels 112 at this time was calculated at 2.88 [kPa]. Furthermore, the pressure $P_1$ applied to the electrolytic solution 114 was 0.48 [kPa] (calculated value), while the pressures $P_2$ of the first gas flow channel 104 and the second gas flow channel 106 were respectively $1.58\times10^{-2}$ [kPa] (calculated value). The electrolytic cell 100 was configured to satisfy the above equation (4). At this time, it was confirmed that the electrolytic solution 114 was not leaked to the first gas flow channel 104 or the second gas flow channel 106 from the liquid flow channel 102.

In this state, a voltage was applied between the first electrode 108 and the second electrode 110 such that the first electrode 108 served as an anode and the second electrode 110 served as a cathode for carrying out constant voltage electrolysis at 7.0 V. The state of the gases generated from the first electrode 108 and the second electrode 110 could not be observed from the relation of the electrode arrangement. However, the gas coming out from the gas outlet 104*b* in the first gas flow channel 104 at a side of the first electrode 108 which is an anode, was collected in a Tedlar bag, and a fluorine gas detector tube (gas detector tube No. 17, a product of Gastec Corporation) was used for the measurement. As a result, an indicator of the detector tube was bleached to white. Accordingly, it could be confirmed that a fluorine gas was generated.

Figure 30:
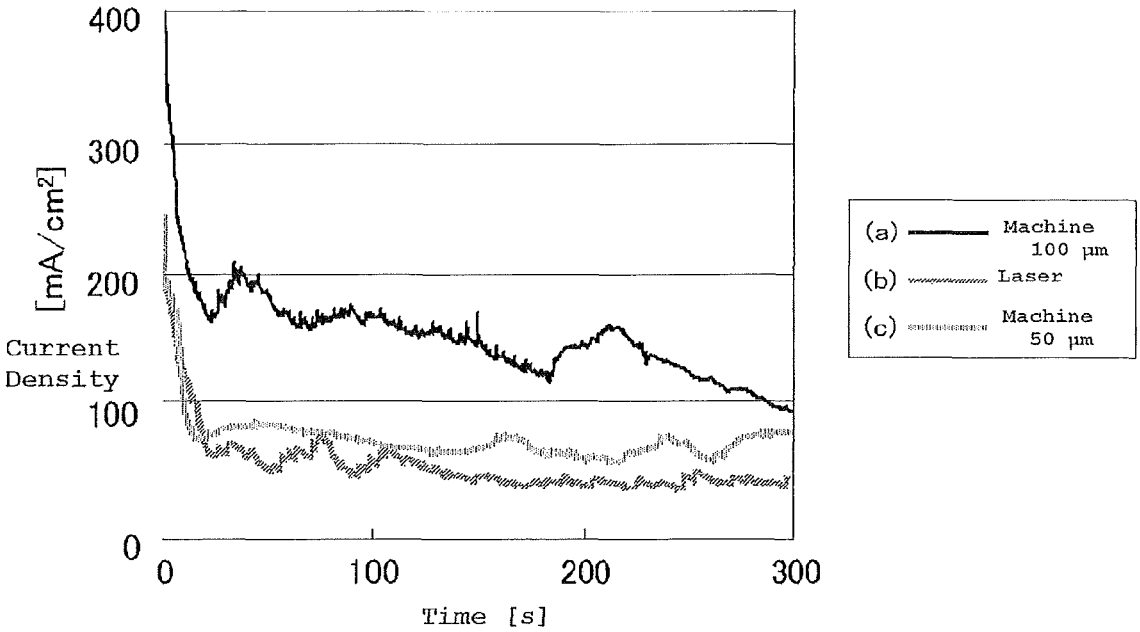
FIG. 30 is a view illustrating the amount of change with the time of current density according to Example.

The amount of change with the time of current density in present Example is illustrated in (a) of FIG. 30. An average current density in a stable state was about 150 mA/cm$^2$.

Example A2-2

The experiment was carried out in the same manner as in Example A2-1, except that the fine gas flow channels 112 in the first electrode 108 and the second electrode 110 were processed by using a laser (fourth harmonic YAG laser beam). The size of the fine gas flow channel 112 processed by a laser was about 205 μm in diameter on the surface (surface 108*a* in FIG. 28(*a*)) in contact with the electrolytic solution, while it was about 5 μm in diameter on the opposite surface (back surface 108*b* in FIG. 28(*b*)). And, the pitch was 50 μm.

The electrolytic cell 100 was mounted on the electrolytic cell mounting device 200, and the temperature of the heater block 212 was controlled at 100 degrees centigrade. In this state, using the pump 206, molten salt was supplied to the liquid inlet 102*a* in the electrolytic cell 100 from the molten salt bath 202 at a flow rate of 1.0 mL/min. Further, nitrogen was supplied respectively to the first gas flow channel 104 and the second gas flow channel 106 from the gas inlet 104*a* and the gas inlet 106*a* at a flow rate of 10 mL/min. In present Example, since the surface tension γ of the electrolytic solution 114 was 94 [mN/m], the contact angle θ was 140° and the width (diameter) w of the fine gas flow channel 112 was 20 μm, the pressure required for pushing the electrolytic solution 114 into the fine gas flow channels 112 at this time was calculated at 14.40 [kPa]. Furthermore, the pressure $P_1$ applied to the electrolytic solution 114 was 0.48 [kPa] (calculated value), while the pressures $P_2$ of the first gas flow channel 104 and the second gas flow channel 106 were respectively $1.58\times10^{-2}$ [kPa] (calculated value). The electrolytic cell 100 was configured to satisfy the above equation (4).

In the same manner as in Example A2-1, a voltage was applied between the first electrode 108 and the second electrode 110 for carrying out constant voltage electrolysis at 7.0 V. The state of the gases generated from the first electrode 108 and the second electrode 110 could not be observed from the relation of the electrode arrangement. However, the gas coming out from the gas outlet 104*b* in the first gas flow channel 104 at a side of the first electrode 108 which is an anode, was collected in a Tedlar bag, and a fluorine gas detector tube (gas detector tube No. 17, a product of Gastec Corporation) was used for the measurement. As a result, an indicator of the detector tube was bleached to white. Accordingly, it could be confirmed that a fluorine gas was generated. Furthermore, the amount of change with the the time of current density in present Example is illustrated in (b) of FIG. 30. An average current density in a stable state was about 50 mA/cm$^2$.

Example A2-3

The experiment was carried out in the same manner as in Example A2-1, except that the diameter of the fine gas flow channels 112 in the first electrode 108 and the second electrode 110 was set to 50 μm, and its pitch was set to 100 μm.

The electrolytic cell 100 was mounted on the electrolytic cell mounting device 200, and the temperature of the heater block 212 was controlled at 100 degrees centigrade. In this state, using the pump 206, molten salt was supplied to the liquid inlet 102*a* in the electrolytic cell 100 from the molten salt bath 202 at a flow rate of 1.0 mL/min. Further, nitrogen was supplied respectively to the first gas flow channel 104 and the second gas flow channel 106 from the gas inlet 104*a* and the gas inlet 106*a* at a flow rate of 10 mL/min. In present Example, since the surface tension γ of the electrolytic solution 114 was 94 [mN/m], the contact angle θ was 140° and the width (diameter) w of the fine gas flow channel 112 was 50 μm, the pressure required for pushing the electrolytic solution 114 into the fine gas flow channels 112 at this time was calculated at 5.76 [kPa]. Furthermore, the pressure $P_1$ applied to the electrolytic solution 114 was 0.48 [kPa] (calculated value), while the pressures $P_2$ of the first gas flow channel 104 and the second gas flow channel 106 were respectively $1.58\times10^{-2}$ [kPa] (calculated value). The electrolytic cell 100 was configured to satisfy the above equation (4).

In the same manner as in Example A2-1, a voltage was applied between the first electrode 108 and the second electrode 110 for carrying out constant voltage electrolysis at 7.0 V. The state of the gases generated from the first electrode 108 and the second electrode 110 could not be observed from the relation of the electrode arrangement. However, the gas coming out from the gas outlet 104*b* in the first gas flow channel 104 at a side of the first electrode 108 which is an anode, was collected in a Tedlar bag, and a fluorine gas detector tube (gas detector tube No. 17, a product of Gastec Corporation) was used for the measurement. As a result, an indicator of the detector tube was bleached to white. Accordingly, it could be confirmed that a fluorine gas was generated. Furthermore, the amount of change with the time of current density in present Example is illustrated in (C) of FIG. 30. An average current density in a stable state was about 70 mA/cm$^2$.

Example A3

Figure 31:
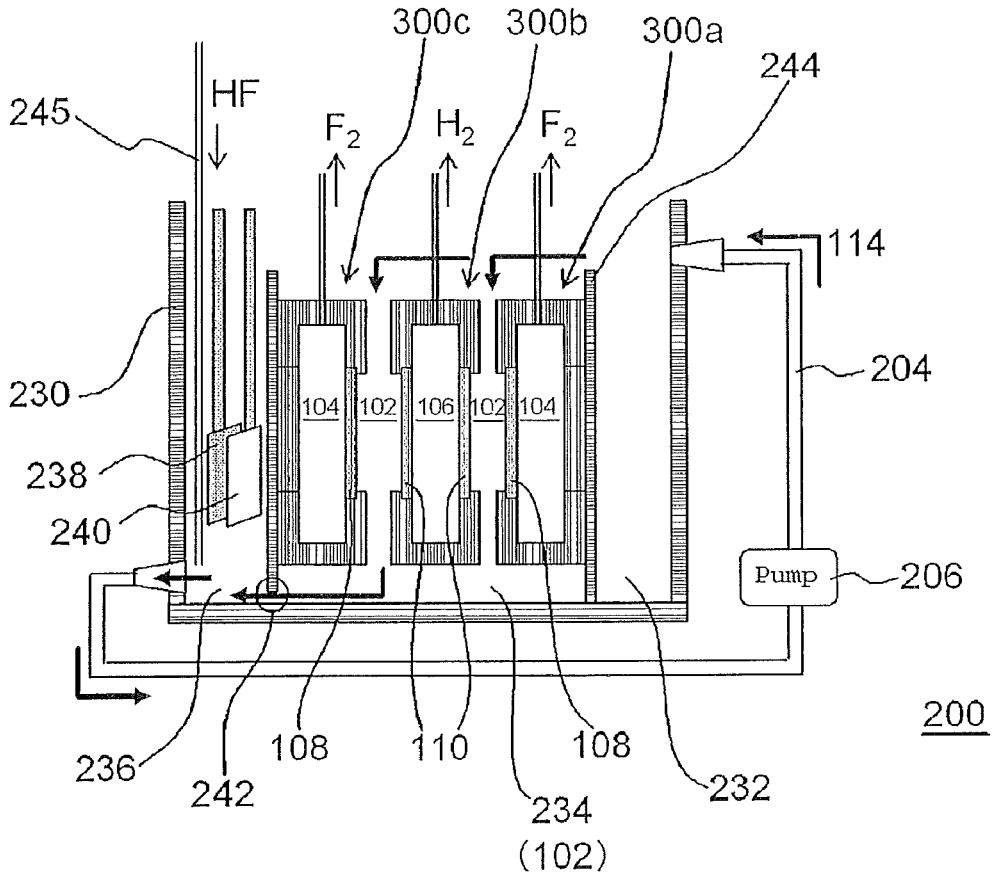
FIG. 31 is a side sectional view of an electrolytic cell mounting device according to Example.
Figure 32:
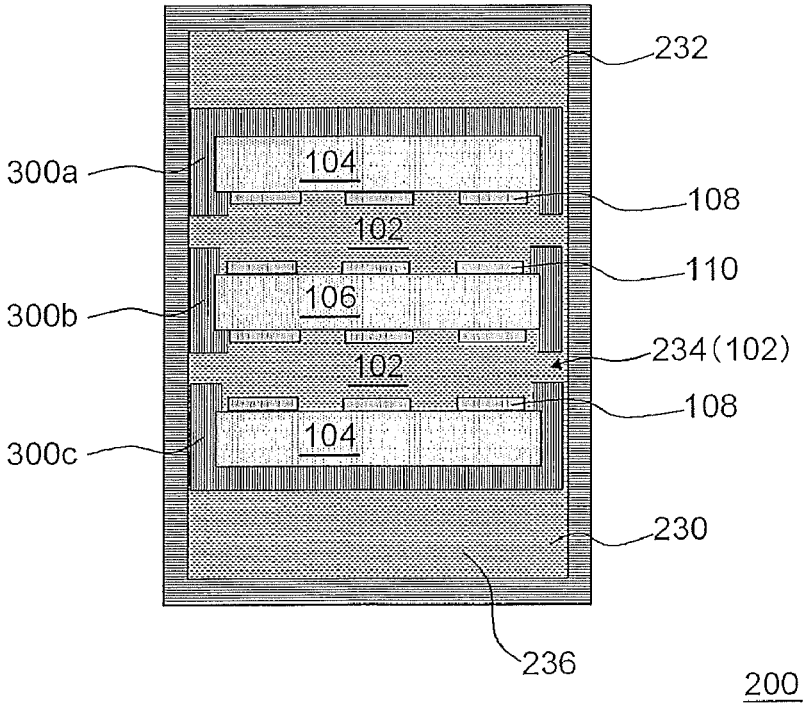
FIG. 32 is a top sectional view of the electrolytic cell mounting device according to Example.

The configuration of the electrolytic cell in present Example is illustrated in FIGS. 31 to 35. FIGS. 31 and 32 illustrate the configuration of the electrolytic cell mounting device with a plurality of electrolytic cells mounted thereon. FIG. 31 is a side sectional view of the electrolytic cell mounting device 200, while FIG. 32 is a top sectional view of the electrolytic cell mounting device 200.

The electrolytic cell mounting device 200 was composed of a molten salt tank 230 which was divided into a first chamber 232, a second chamber 234 and a third chamber 236. Three of an electrolytic cell 300*a*, an electrolytic cell 300*b* and an electrolytic cell 300*c* were mounted on the second chamber 234. Slits were formed on the second chamber 234, and the electrolytic cells 300*a* to 300*c* were inserted along these slits. The third chamber 236 was provided with an electrode plate 238 and an electrode plate 240 respectively made of a nickel electrode for aqueous electrolysis, and an inlet tube 245 for supplying an HF gas. The first chamber 232 was connected with the third chamber 236 by the molten salt flow channel 204 through the pump 206. The configuration of the electrolytic cell mounting device 200 will be described later.

In present Example, the electrolytic cell was composed of a vessel having opening windows and carbon plate electrodes arranged so as to cover the opening windows. A plurality of through holes to be the fine gas flow channels 112 were arranged on the carbon plate electrodes. Accordingly, the electrolytic solution 114 was supplied to the carbon plate electrode surfaces from the outside of the vessel for carrying out electrolysis, whereby the gases generated on the carbon plate electrode surfaces could be incorporated into the inside of the vessel. Namely, the first electrode 108 and the second electrode 110 were respectively composed of a first carbon plate and a second carbon plate having a plurality of through holes to be the fine gas flow channels 112, the surface of the first carbon plate and the surface of the second carbon plate were oppositely disposed to each other, a liquid flow channel was arranged between the first carbon plate and the second carbon plate, a first gas storage unit which is a vessel, was arranged on the back side of the first carbon plate, and a second gas storage unit which is a vessel, was arranged on the back side of the second carbon plate.

The electrolytic cell 300*b* was composed of six second electrodes 110 that were carbon plate electrodes. A plurality of fine gas flow channels 112 which is a plurality of the same through holes as those illustrated with reference to FIG. 29, were formed on respective carbon plate electrodes. Further, the electrolytic cell 300*a* and the electrolytic cell 300*c* were equipped with three first electrodes 108 which were the same carbon plate electrodes. The electrolytic cells 300*a* to 300*c* were arranged in the inside of the second chamber 234 such that the second electrodes 110 on the electrolytic cell 300*b*, the first electrodes 108 on the electrolytic cell 300*a* and the first electrodes 108 on the electrolytic cell 300*c* were respectively facing to one another.

Figure 33:
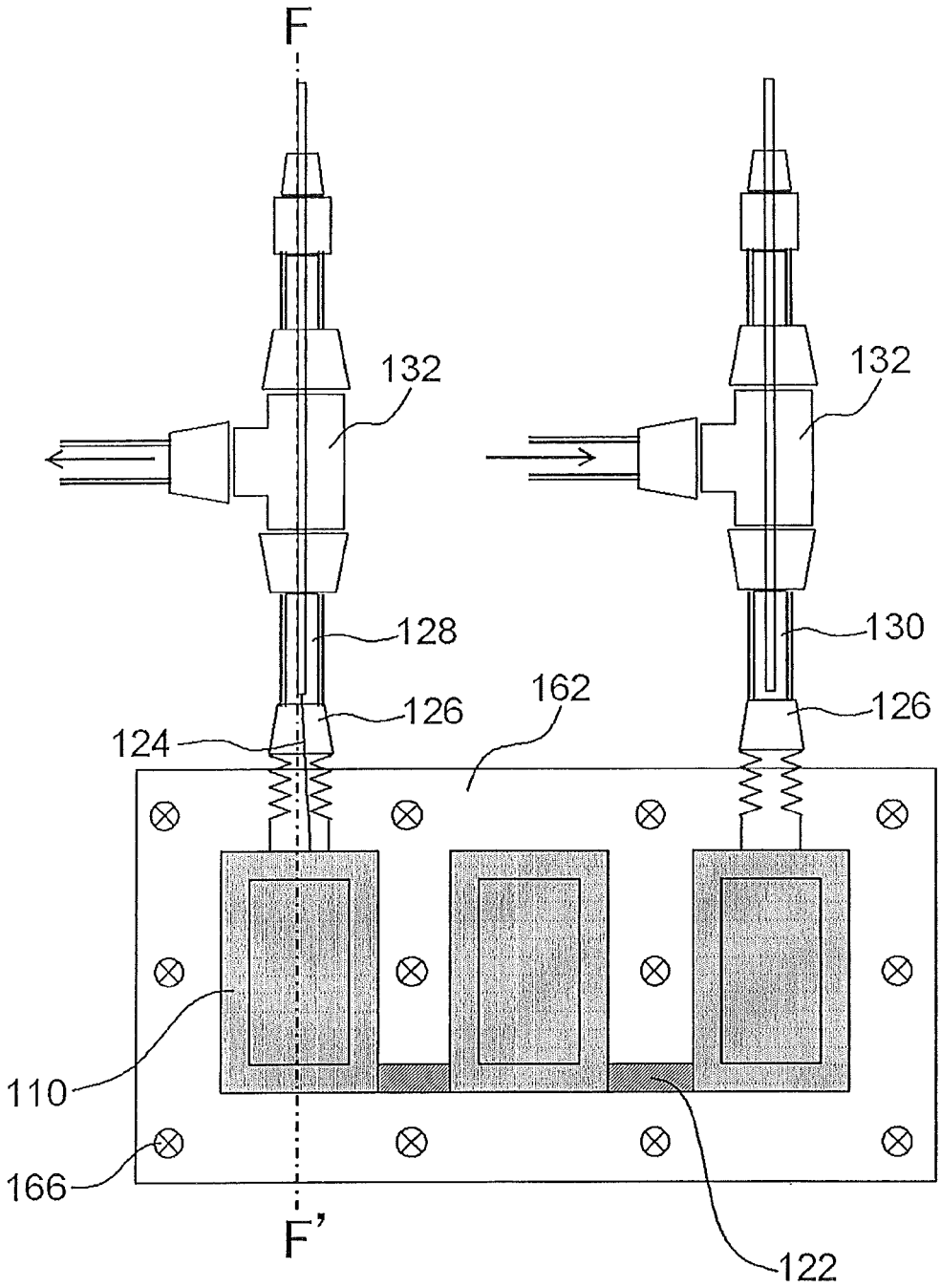
FIG. 33 is a view illustrating the configuration of an electrolytic cell according to Example.
Figure 34:
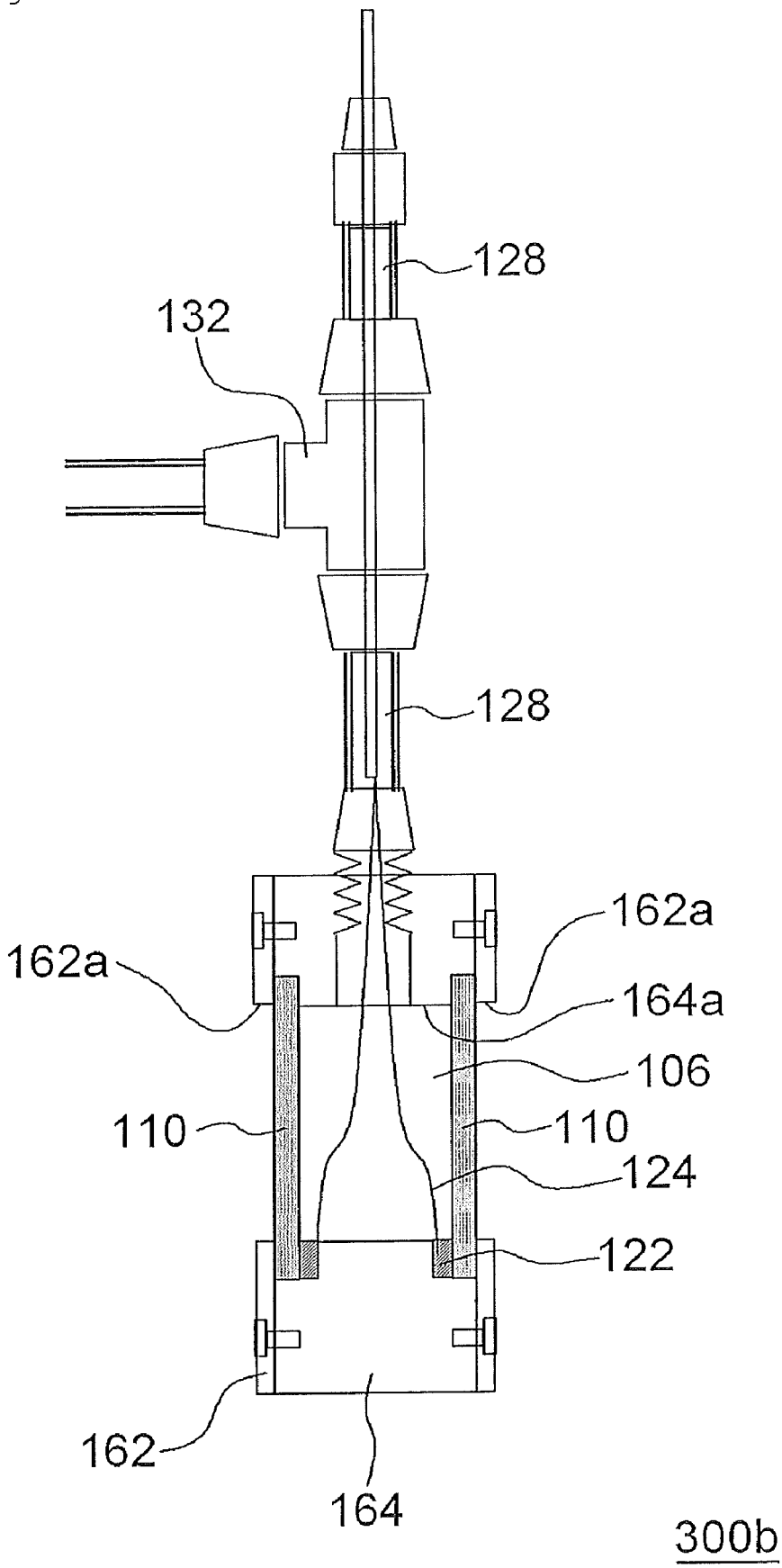
FIG. 34 is an F-F' sectional view of FIG. 33.

FIGS. 33 and 34 are each a view illustrating a structure of the electrolytic cell 300*b* mounted in the center among three electrolytic cells 300*a* to 300*c* illustrated in FIGS. 31 and 32. FIG. 34 is an F-F' sectional view of FIG. 33. As shown in FIG. 34, the electrolytic cell 300*b* was provided with the second electrodes 110 formed on both surfaces so as to respectively face to the first electrodes 108 on the electrolytic cell 300*a* and the electrolytic cell 300*c* when it was mounted on the electrolytic cell mounting device 200. The electrolytic cell 300*b* was composed of a cell vessel 164 with a recessed portion 164*a* arranged thereon, an electrode pressing plate 162 with windows 162*a* arranged thereon for mounting the second electrode 110, a metal frame 122 for electrical communication for passing electricity to the second electrode 110, and wires 124 for passing electricity. The electrode pressing plate 162 was mounted on the cell vessel 164 by screws 166. Furthermore, a Teflon tube 128 and a Teflon tube 130 were respectively mounted in the upper part of the cell vessel 164 via Teflon (registered trademark) joints 126. Three-way valves 132 were respectively mounted on the Teflon tube 128 and the Teflon tube 130. Herein, the gas was flowed in through the Teflon tube 130, and the gas was flowed out through the Teflon tube 128. In this configuration, a space inside the cell vessel 164 became the second gas flow channel 106.

The electrolytic cell in present Example was prepared in the following order. The production procedure of the electrolytic cell 300*b* is illustrated below as an example.

As the second electrode 110, a carbon plate (G348 1 mmt, a product of Tokai Carbon Co., Ltd.) was subjected to machining process and hollowed out at a size of 24 mm×14 mm (r=1 mm). Subsequently, the carbon plates were subjected to counter boring for forming recessed portions (10 mm×20 mm, depth: 0.6 mm). And, holes to be the fine gas flow channels 112 were machined at the recessed portions in the carbon plates. The fine gas flow channels 112 were formed by machining process using a drill having a diameter of 100 μm (carbide solid micro drill ADR-0.1, a product of Saito Seisakusho). The size of the fine gas flow channel 112 was set to 100 μm in diameter. Also in present Example, as shown in FIG. 29, a plurality of fine gas flow channels 112 were arranged in a 60° zig-zag form at a pitch of 150 μm. A region of the portion with the fine gas flow channels 112 formed thereon in contact with the electrolytic solution 114 was set to 10 mm×20 mm. Six such carbon plates were prepared.

Meanwhile, an Ni plate was subjected to machine cutting and machined at a size of 24 mm×14 mm×2 mmt (r=1 mm), and a hollow of 20 mm×10 mm (r=0.5 mm) was arranged to prepare the metal frame 122 for electrical communication.

Furthermore, a PTFE plate (50 mm×70 mm, 1 mmt) to be the electrode pressing plate 162 was subjected to machining process for forming a recessed portion for fitting the second electrode 110 therein and three windows 162*a* enabling the second electrode 110 to be brought into contact with the electrolytic solution 114. Two such electrode pressing plates 162 were prepared.

A PTFE plate (50 mm×70 mm, 10 mmt) to be the cell vessel 164 was subjected to machining process for forming the recessed portion 164*a* to be the first gas flow channel 104. Herein, the depth of the recessed portion 164*a* was set to 10 mm. Furthermore, a recessed portion for fitting the metal frame 122 for electrical communication therein was formed and the metal frame 122 for electrical communication was fitted therein. An Ni wire having a diameter of 0.5 mm as the wire 124 was connected with the metal frame 122 for electrical communication. The second electrode 110 was layered on the metal frame 122 for electrical communication in the cell vessel 164, which was then pressed using the electrode pressing plate 162. The metal frame 122 for electrical communication and the electrode pressing plate 162 were also arranged on the other surface in the same manner. Two Teflon joints 126 were connected with each other in the upper part of the cell vessel 164, and further the Teflon tube 128 and the Teflon tube 130 were connected to respective Teflon joints 126. The Teflon tube 128 was arranged so as to be able to connect with a DC power source outside the cell via the wires 124.

The electrolytic cell 300*a* and the electrolytic cell 300*c* were prepared in the same manner as in the electrolytic cell 300*b*, except that the first electrode 108 was formed on only one surface.

The thus-prepared electrolytic cells 300*a* and 300*b* were mounted on the electrolytic cell mounting device 200. A mechanism to generate gases in the electrolytic cell mounting device 200 is illustrated below with reference to FIGS. 31 and 32 as well. Herein, as the electrolytic solution 114, molten salt of KF·2.3HF (melting point of about 80 degrees centigrade) was used. Further, even though not illustrated, the molten salt tank 230 was arranged on the heater block by sandwiching the separator or the like. The temperature of the heater block 212 was controlled at 100 degrees centigrade.

When the electrolytic solution 114 was gathered in the first chamber 232, the electrolytic solution 114 went over a dam 244 between the first chamber 232 and the second chamber 234, and was poured out from the top of the second chamber 234. At this time, its liquid surface was kept by the dam 244 separating the first chamber and the second chamber. The electrolytic solution 114 flowed into the second chamber 234 was flowed so as to fall along gaps between the electrolytic cells. Namely, in present Example, gaps between the electrolytic cells and the lower part of the electrolytic cells were defined as the liquid flow channel 102. A voltage was applied between the first electrode 108 and the second electrode 110 facing to each other such that the first electrode 108 and the second electrode 110 served as a cathode for electrolyzing the electrolytic solution therebetween. Herein, the electrolytic solution 114 could be molten salt having a HF concentration sufficient for carrying out electrolysis. Furthermore, since the electrolytic solution 114 was constantly flowed over the electrode surface, fresh HF could be applied at the time of electrolysis. The first gas 116 generated on the surface of the first electrode 108 was incorporated in the inside of the electrolytic cell 300*a* and the electrolytic cell 300*c* through the fine gas flow channels 112 arranged on the first electrodes 108. Furthermore, the second gas 118 generated on the surface of the second electrode 110 was incorporated into the inside of the electrolytic cell 300*c* through the fine gas flow channels 112 arranged on the second electrode 110. A nitrogen gas or the like was introduced from the Teflon tube 130, whereby the first gas 116 and the second gas 118 could be taken out from the Teflon tube 128 in the respective electrolytic cells.

The electrolytic solution 114 flowed downward to the second chamber 234 was flowed into the third chamber 236 from a discharge port 242 arranged between the second chamber 234 and the third chamber 236. In the third chamber 236, the amount of HF contained in molten salt was always monitored by the electrode plate 238 and the electrode plate 240. A voltage of not more than 5V was always applied between the electrode plate 238 and the electrode plate 240, and the liquid surface level of molten salt was monitored. When the liquid surface level of molten salt was lowered, an anhydrous HF gas was supplied to the third chamber 236 through the inlet tube 245. Supply of the anhydrous HF was stopped when the liquid surface reached a certain level, whereby the concentration of HF could be maintained at a certain level. The electrolytic solution 114 flowed into the third chamber 236 was discharged to the outside of the molten salt tank 230, whereas it was supplied again to the first chamber 232 by the pump 206.

In the electrolytic cell mounting device 200 having the above configuration, using the pump 206, molten salt which is the electrolytic solution 114, was supplied from the third chamber 236 at a flow rate of 300 mL/min. Further, nitrogen was supplied to the Teflon tubes 130 mounted respectively on the electrolytic cell 300*a*, the electrolytic cell 300*b* and the electrolytic cell 300*c* at a flow rate of 100 mL/min.

In present Example, since the surface tension $\gamma$ of the electrolytic solution 114 was 94 [mN/m], the contact angle $\theta$ was 140° and the width (diameter) w of the fine gas flow channel 112 was 100 μm, the pressure required for pushing the electrolytic solution 114 into the fine gas flow channels 112 at this time was calculated at 2.88 [kPa]. Furthermore, since the electrolytic solution was positioned at the depth of 4 cm from the lowest part of the electrode, the pressure $P_1$ applied to the lowest part of the electrode was 0.80 [kPa] (calculated value), while the pressures $P_2$ of the first gas flow channel 104 and the second gas flow channel 106 were respectively $6.68\times10^{-3}$ [kPa] (calculated value). The electrolytic cell 100 was configured to satisfy the above equation (4). At this time, it was confirmed that the electrolytic solution 114 was not leaked to the first gas flow channel 104 or the second gas flow channel 106.

In this state, a voltage was applied between the first electrode 108 and the second electrode 110 such that the first electrode 108 served as an anode and the second electrode 110 served as a cathode for carrying out electrolysis. The gases generated at respective electrolytic cells were collected from the Teflon tube 128 for the analysis. As a result, it could be confirmed that a fluorine gas was generated at the electrolytic cell 300*a* and the electrolytic cell 300*c*.

In present Example, since the electrolytic solution 114 was circulated and HF was supplied to the third chamber 236, the concentration of HF in molten salt could be maintained to be sufficiently high in order to carry out electrolysis.

As described above, the present invention has been described by way of embodiments. The embodiments are exemplified, and it should be understood to those skilled in the art that many changes to combination of these respective components or respective processes can be made, and such changes belong to the scope of the present invention as well.

Meanwhile, in the above embodiment, as a substance for causing the electrolysis reaction of hydrogen fluoride, potassium fluoride molten salt containing hydrogen fluoride was exemplified. For example, other substances such as caesium fluoride molten salt and the like, or lithium fluoride added to the aforementioned molten salt as an additive agent may be used. Furthermore, in the above embodiment, the fluorine gas generated at the anode and the hydrogen gas generated at the cathode were exemplified, whereas the gas generating device of the present invention could also be used for the generation of other gases such as nitrogen trifluoride, chlorine, oxygen, arsine and the like by electrolysis.

In the above embodiment, a substrate composed of a polycarbonate plate and an electrode composed of a carbon plate were exemplified. On the other hand, in other examples, a substrate was composed of silicon, and grooves to be the flow channels or grooves to be the fine gas flow channels 112 of the electrode were formed on the silicon substrate. A thin film metal forming a film on the electrode portion by thin film technology such as sputtering, deposition or the like was patterned by micromachine technology, impurities were doped on silicon, or the like, whereby a gas generating device could also be formed.

Furthermore, the above embodiment illustrates the configuration of each one of the liquid flow channel 102, the first gas flow channel 104 and the second gas flow channel 106. On the other hand, the configuration of a plurality of such channels can also be adopted. In FIG. 24, the liquid flow channel 102 and a pair of the first electrode 108 and the second electrode 110 disposed to sandwich the liquid flow channel 102 were arranged as a set, and three of these sets were exemplified. In this configuration, the first gas flow channel 104 could be shared between two first electrodes 108. Furthermore, the second gas flow channel 106 could also be shared between two second electrodes 110. Namely, a plurality of first electrodes and a plurality of second electrodes were arranged in the order of the second electrode, the first electrode, the first electrode and the second electrode. A region between the first electrode and the second electrode could be defined as the liquid flow channel, while a region between the first electrode and the first electrode could be defined as the first gas storage unit.

Figure 35:
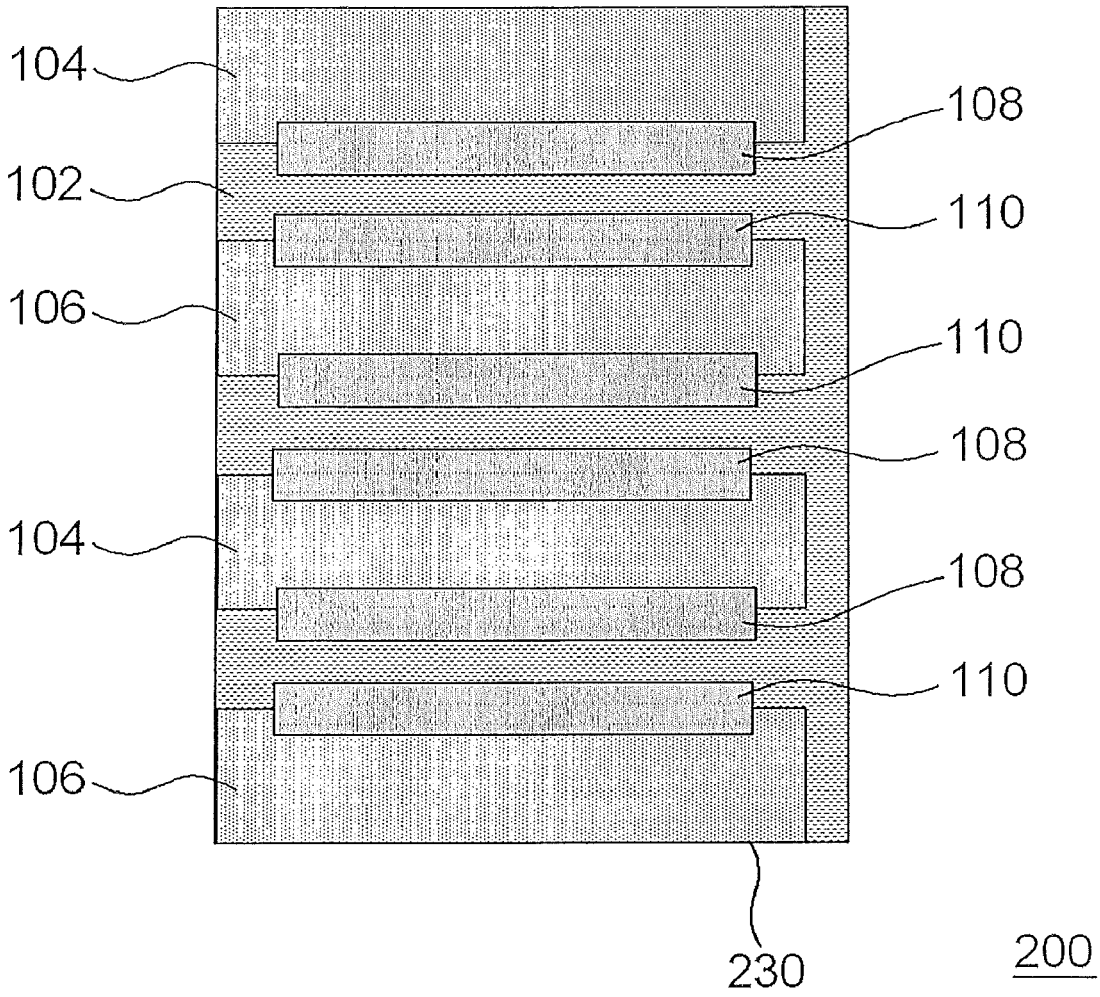
FIG. 35 is a view illustrating the configuration of another example of an electrolytic cell according to Example.

Meanwhile, also in the configuration illustrated in Example A3, as shown in FIG. 35, a number of electrolytic cells arranged further in the molten salt tank 230 can also be configured.

Example B1

As described below, an experiment device of an electrolytic cell using a carbon electrode for gas generation was prepared and the experiment of electrolysis was carried out.

Figure 37:
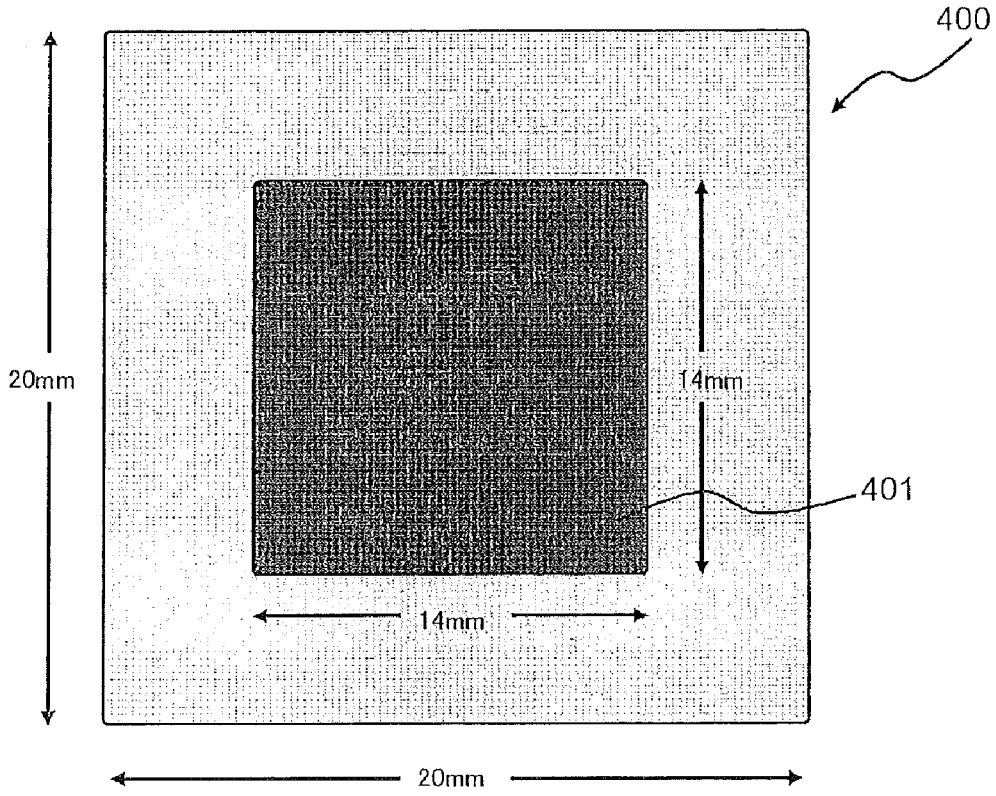
FIG. 37 is a schematic plan view illustrating a resin plate subjected to hole opening process prepared according to Example.
Figure 38:
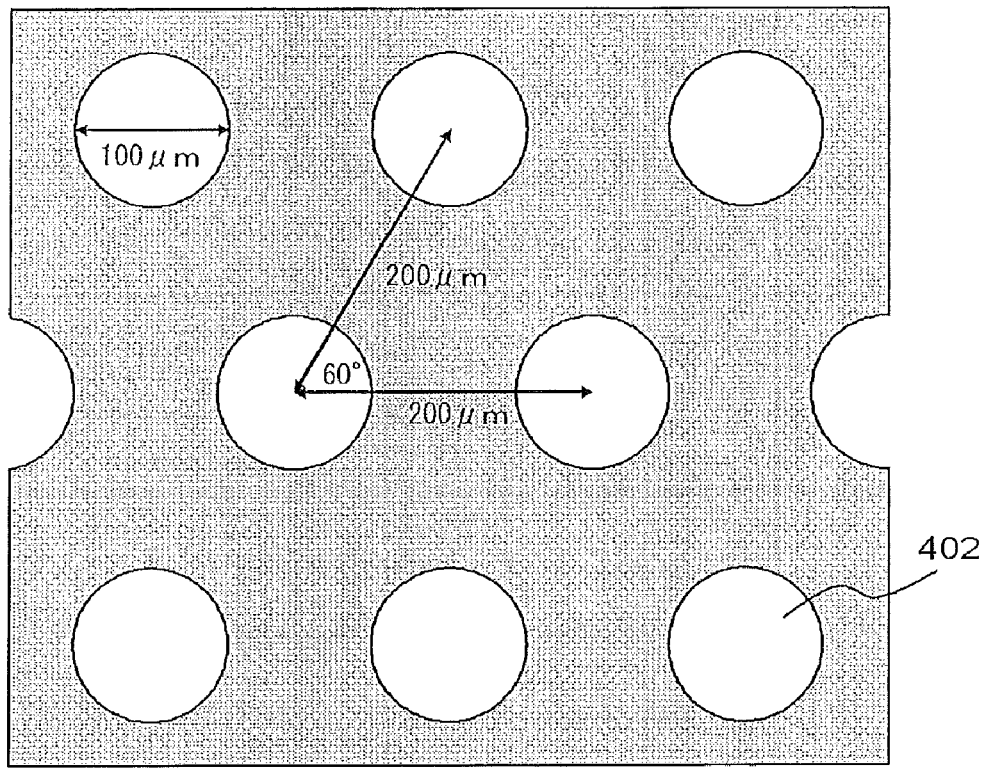
FIG. 38 is an enlarged schematic view of holes illustrated in the figure.
Figure 39:
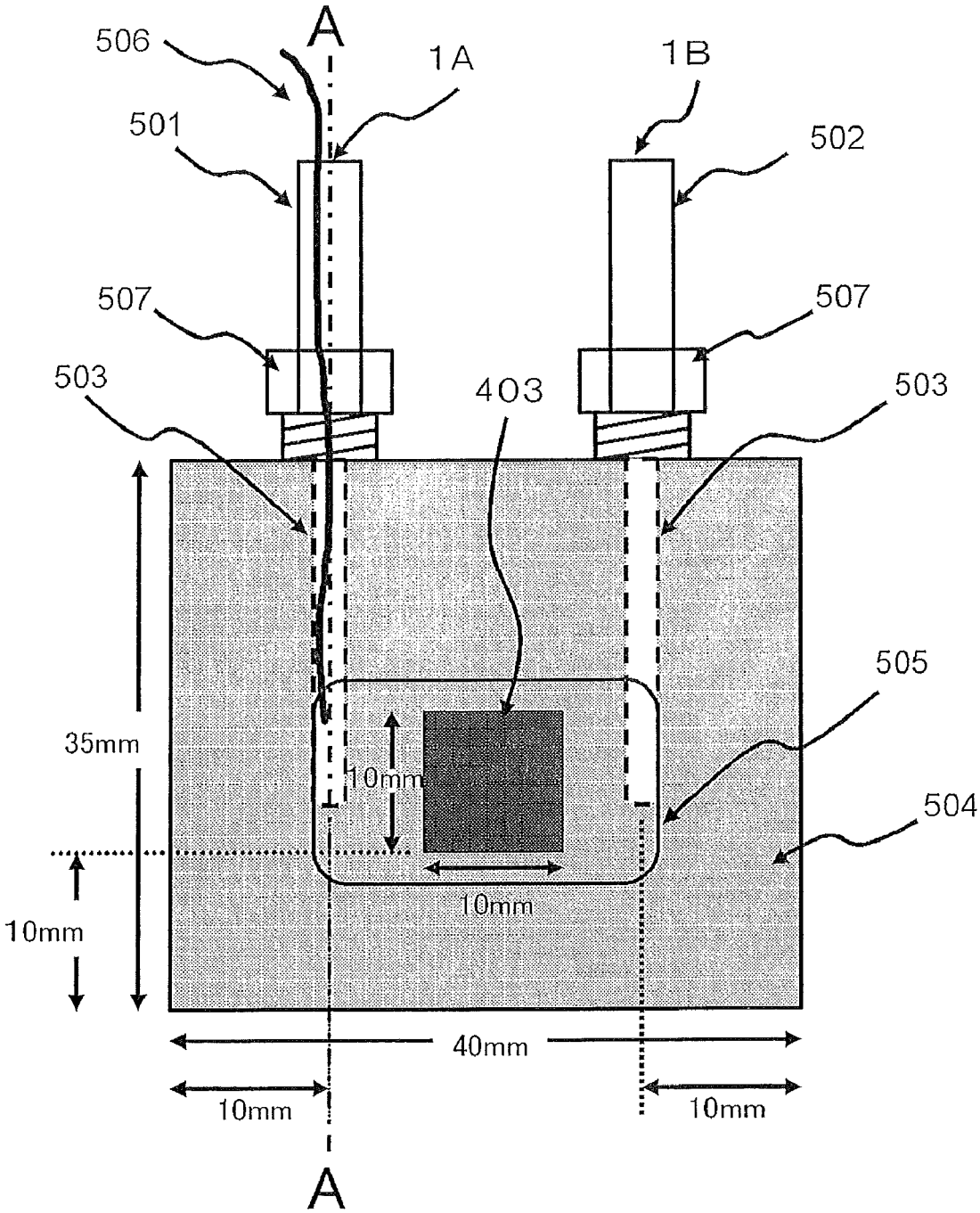
FIG. 39 is an elevational view of an electrolytic cell prepared according to Example.
Figure 40:
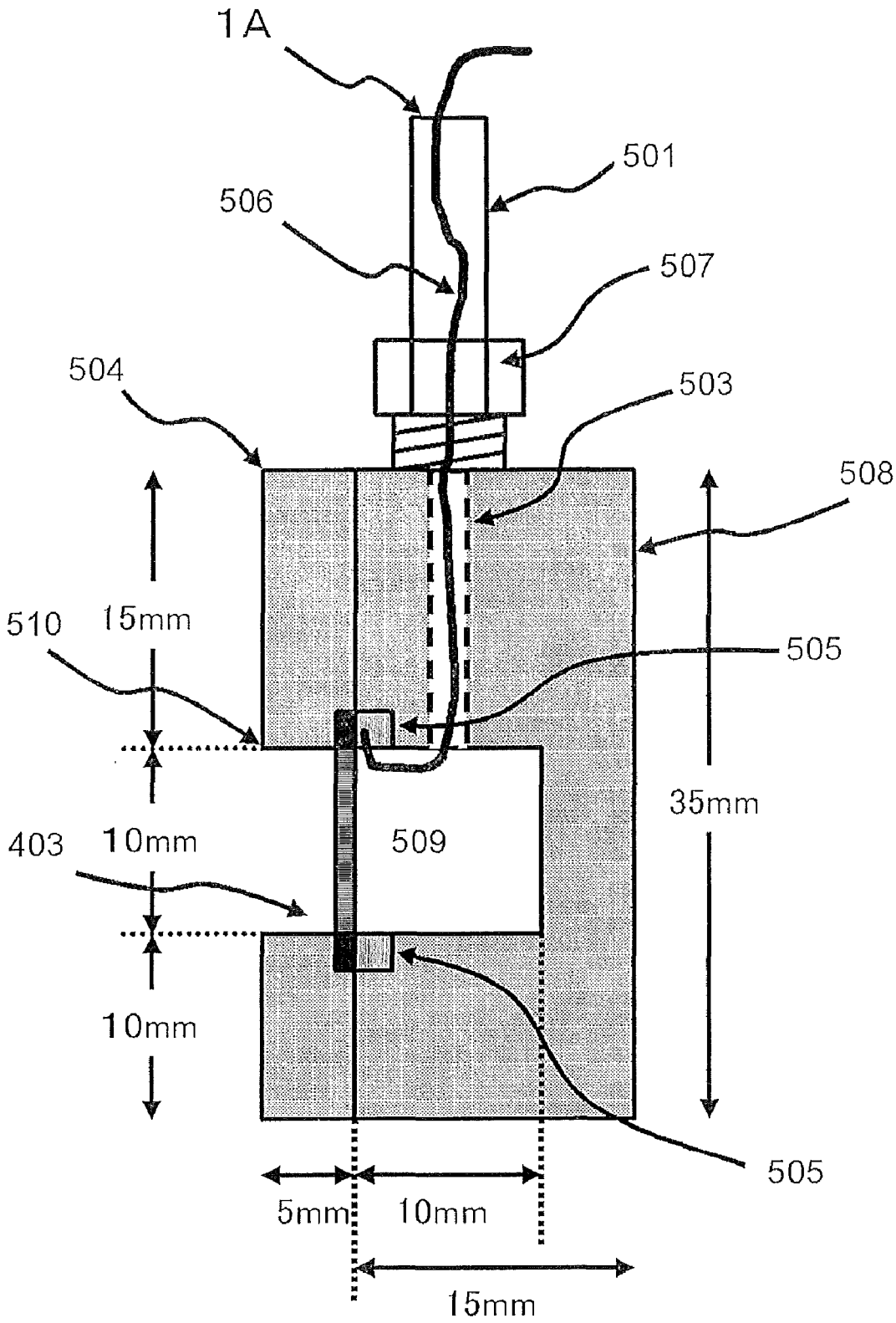
FIG. 40 is an A-A sectional view of the electrolytic cell illustrated in FIG. 39.
Figure 41:
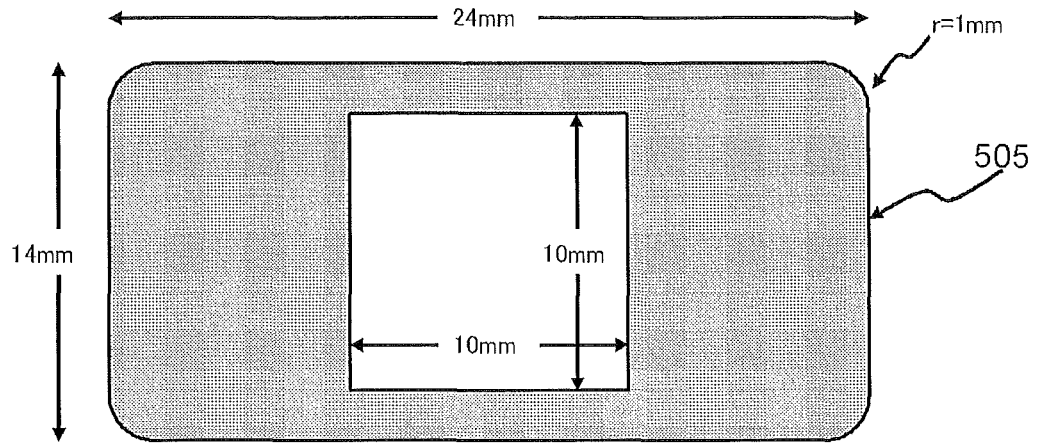
FIG. 41 is a schematic plan view of a metal frame for electrical communication used for the electrolytic cell prepared according to Example.
Figure 42:
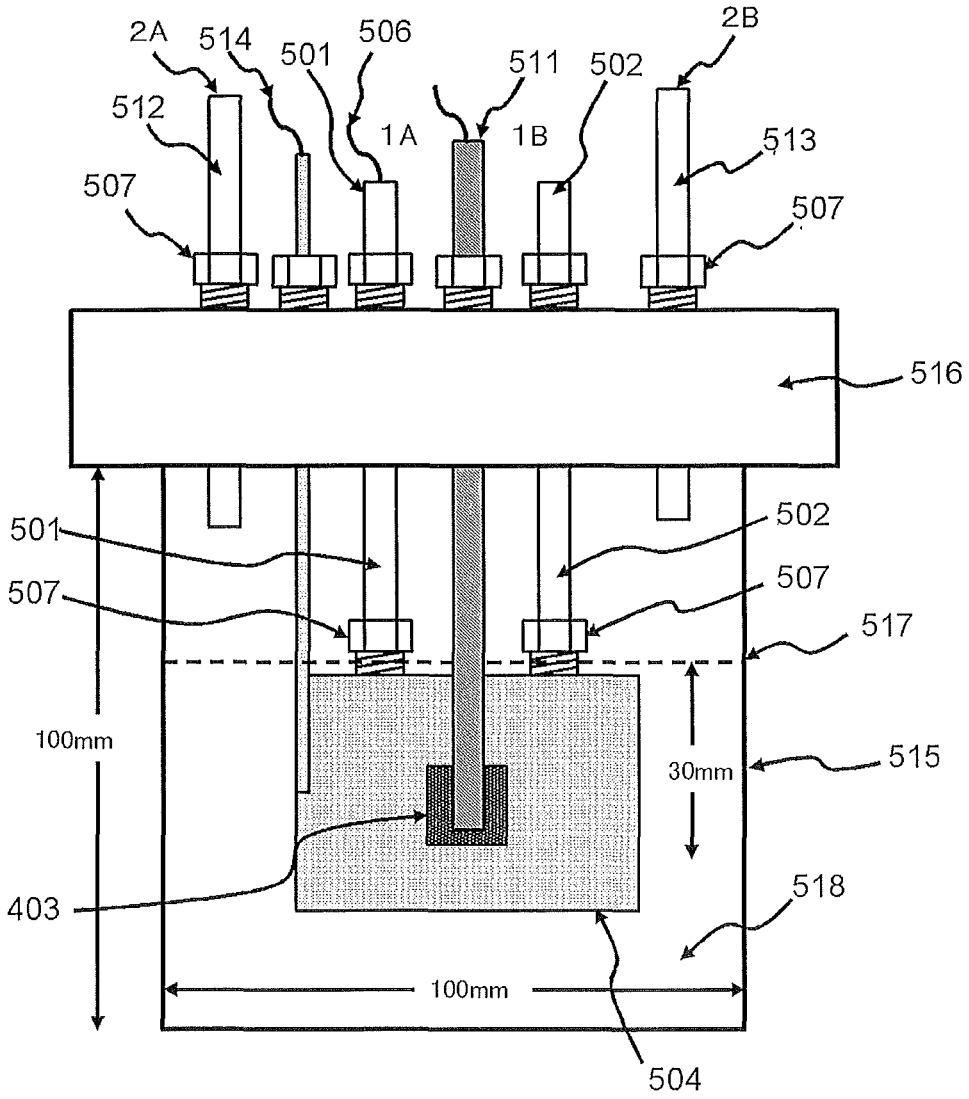
FIG. 42 is a front perspective view of an electrolytic cell experiment device to be used in Example.
Figure 43:
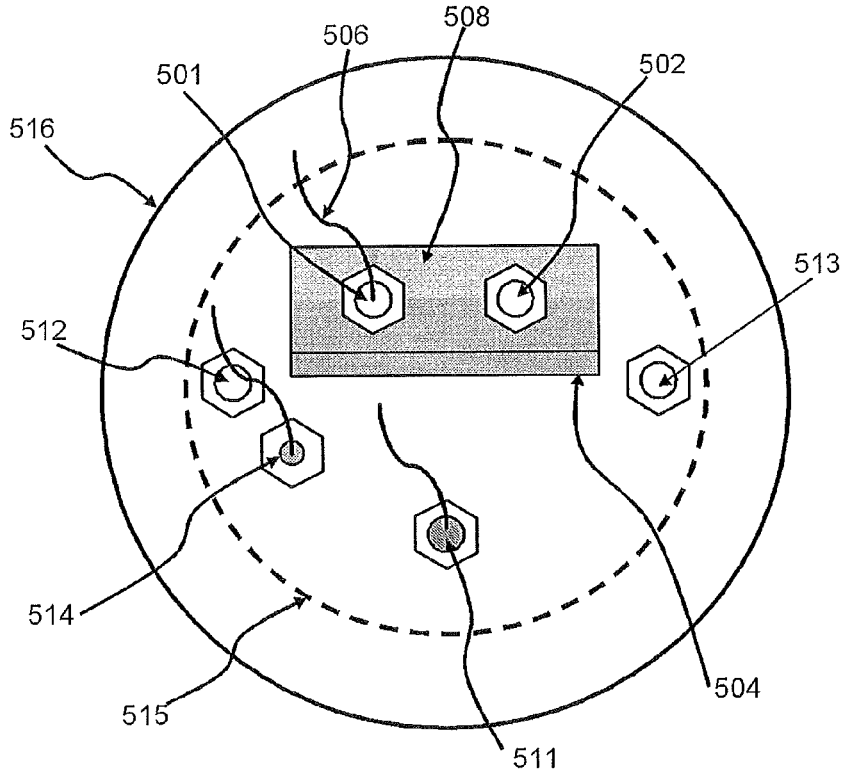
FIG. 43 is a top perspective view of the electrolytic cell experiment device to be used in Example.

Meanwhile, FIG. 37 is a schematic plan view illustrating a resin plate subjected to hole opening process prepared in Example B1. FIG. 38 is an enlarged schematic view of a hole processed portion 401 illustrated in FIG. 37. FIG. 39 is an elevational view illustrating the electrolytic cell prepared in Example B1. FIG. 40 is an A-A sectional view of FIG. 39. FIG. 41 is a schematic plan view of a metal frame 505 for electrical communication to be used for the electrolytic cell prepared in Example B1. FIG. 42 is a front perspective view of the electrolytic cell experiment device to be used in Example B1. FIG. 43 is a top perspective view of the electrolytic cell experiment device to be used in Example B1.

(1) As shown in FIGS. 37 and 38, a plurality of fine holes 402 (through holes for passing gases) as shown in FIG. 38 were subjected to hole process in a 60° zig-zag form at a pitch of 200 μm in the hole processed portion 401 (14 mm×14 mm) in the center of a polyimide plate 400 (UPLEX AD sheet 20 mm×20 mm, 0.5 mmt, a product of Ube Industries, Ltd.) using a drill having a diameter of 100 μm (carbide solid micro drill ADR-0.1, a product of Saito Seisakusho).

(2) The multi-hole machined polyimide plate 400 prepared in (1) was sandwiched between two graphite plates (150 mm×150 mm×30 mm) in order to suppress curvature deformation on firing and put into an oven. The oven was fully replaced with argon, heated under a flow of argon (1 L/min) and heated to 1,500 degrees centigrade over 1 hour. The oven was kept at that temperature for 1 hour and fired, and then stopped heating for natural cooling, and cooled down to 200 degrees centigrade and then taken out. A porous electrode 403 (carbon electrode for gas generation) was completed.

The size of the porous electrode 403 was shrunk by about 20% and the hole diameter was also shrunk by the same degree to be about 80 μm. Furthermore, the electrode 403 was also shrunk in the thickness direction, so the thickness was 430 μm. The half width of the G1 band of Raman spectrum of the porous electrode 403 was 58 $cm^{-1}$, the half width of a peak measured in the vicinity of 22° to 27° by XRD measurement was 7.8°, and the volume resistivity measured by the four-terminal method was $6.5\times10^3$ μΩcm.

The Raman spectrum was measured under conditions of laser wavelength of 532 nm, laser power of 100%, grating of 1800 L/mm, objective lens magnification of 50×, measurement time of 30 seconds and the number of integrations of 3 using JRS-SYSTEM 2000 (microscopic Raman spectrometer, a product of Renishaw PLC). The measured spectrum was subjected to curve fitting using the Gaussian function, and the peak in the vicinity of 1,610 $cm^{-1}$ was defined as the G1 band. The smaller the half width of the G1 band was, the higher the graphitization degree was. On the contrary, the greater the half width was, the lower the graphitization degree was.

XRD measurement was carried out using a measurement device of RINT-1500 (a product of Rigaku Corporation) under conditions of X ray of Cu K-α ray, applied voltage of 50 kV, applied current of 200 mA, scan speed of 4°/min and scan step of 0.2°. From the half width of the peak measured in the vicinity of 22° to 27°, the graphitization degree was evaluated. The peak measured in the vicinity of 22° to 27° was derived from 002 plane of the graphite. As the half width of the peak was narrower, the graphite was considered a highly oriented one, and the measurement result of a usual graphite material was not more than 1.0°. On the contrary, when a graphite layer was small or regularity of the graphite layer was reduced, the half width became great.

(3) The porous electrode 403 prepared in (2) was arranged on the electrolytic cell illustrated in FIG. 39 and the experiment of electrolysis of KF·2HF molten salt was carried out. The electrolytic cell was prepared by subjecting a fluorine resin (PTFE) to machining process. As shown in FIG. 40, the electrolytic cell was provided with a space 509 arranged on a back side of the porous electrode 403.

The porous electrode 403 was sandwiched between a pressing plate 504 and a metal frame 505 for electrical communication, and an electrolytic cell body 508 was pressed by a bolt made of a fluorine resin through the pressing plate 504 for securing electrical communication. In the pressing plate 504, a window 510 (10 mm×10 mm) for bringing the porous electrode 103 into contact with KF·2HF molten salt was opened, and the electrode area at this time became 1 $cm^2$.

The metal frame 505 for electrical communication was configured, as shown in FIG. 41, such that the window of 10 mm×10 mm was opened in the center where the electrode and molten salt were brought into contact with each other, and the generated gas could be released to the space 509. Furthermore, a wire 506 for electrical communication was connected with the metal frame 505 for electrical communication, while the wire 506 for electrical communication was connected with a DC power source apparatus arranged at the outside.

In the electrolytic cell body 508, a tube 501 for supplying a nitrogen gas and a tube 502 for discharging the gas were connected using fluorine resin connectors 507, and both tubes were communicated with the space 509 on the back side of the electrode via through holes 503 opened in the electrolytic cell body 508. The nitrogen gas introduced from the nitrogen gas inlet port 1A was communicated with the space 509 on the back side of the electrode via the through holes 503, and was discharged to the outside of the system from the outlet port 1B along with the gas generated at the electrode.

(4) The electrolytic cell illustrated in FIG. 39 was built into the electrolytic cell experiment device illustrated in FIG. 42. The electrolytic cell experiment device was roughly divided into a bath 515 for storing molten salt 518 and a cover 516.

The electrolytic cell was arranged on the cover 516 through the fluorine resin connectors 507, and the tube 501 for supplying a nitrogen gas and the tube 502 for discharging the gas were communicated with the outside of the electrolytic cell experiment device. A cathode electrode 511 composed of a nickel rod of ϕ6 mm, a thermocouple 514, a tube 512 for supplying a nitrogen gas and a tube 513 for the discharge of the gas were arranged on the cover 516 of the electrolytic cell experiment device through the fluorine resin connectors 507. The nitrogen gas introduced from the nitrogen gas inlet port 2A was discharged to the outside of the system from the outlet port 2B along with the gas generated at the porous electrode 403. The shortest distance between the electrode surface of the electrolytic cell and the cathode electrode 511 was 30 mm. KF·2HF molten salt 518 was poured in up to a line 517, that is, 30 mm above from the deepest part of the electrode for carrying out the experiment.

(5) The electrolytic cell experiment device prepared in (4) was immersed in the oil bath adjusted to 100 degrees centigrade and the nitrogen gas was circulated through the tubes 501 and 512 for supplying a nitrogen gas at a flow rate of 10 mL/min. The wire 506 for electrical communication was connected to an anode of a DC power source and the cathode electrode 511 was connected to a cathode for carrying out the electrolysis experiment.

Figure 44:
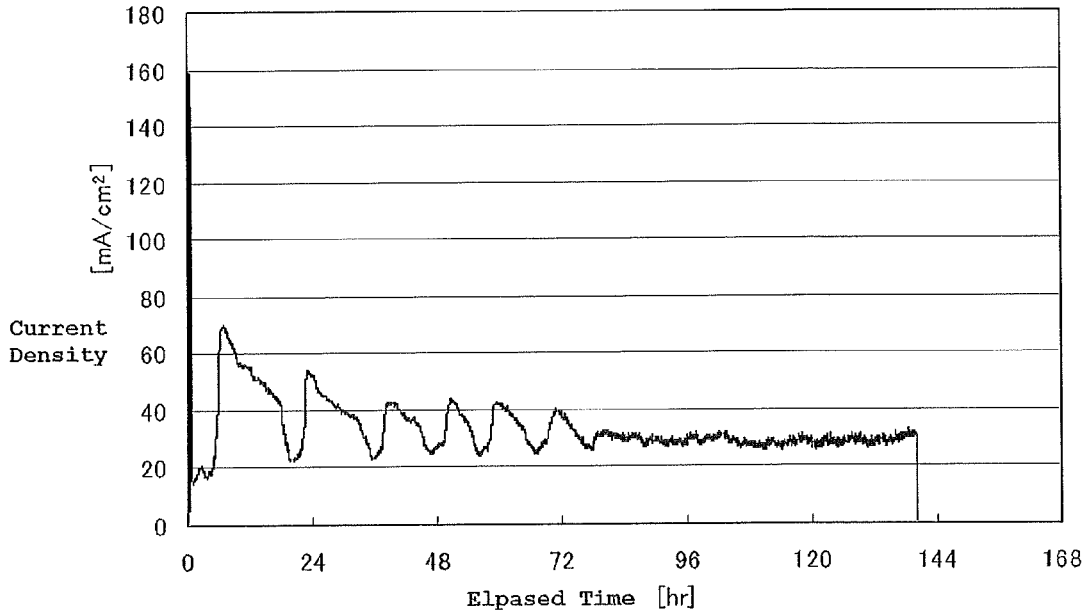
FIG. 44 is a graph showing the amount of change of current density with the elapsed time in Example.

The DC current of 7V was applied to the prepared electrolytic cell experiment device for the experiment and as a result, electrolysis was continuously carried out stably for more than 5 days. The gas coming out from the outlet port 1B was collected in a Tedlar bag, and a fluorine gas detector tube (gas detector tube No. 17, a product of Gastec Corporation) was used for the measurement. As a result, an indicator of the detector tube was bleached to white so that it was confirmed that a fluorine gas was generated. A graph showing the amount of change with the time of current density is illustrated in FIG. 44. An average current density in a stable state was about 30 mA/$cm^2$.

Example B2

The experiment was carried out in the same manner as in Example B1, except that the firing temperature of the porous electrode 403 was changed to 1,300 degrees centigrade. The half width of the G1 band of Raman spectrum of the porous electrode 403 was 62 $cm^{-1}$, the half width of a peak measured in the vicinity of 22° to 27° by XRD measurement was 7.4°, and the volume resistivity measured by the four-terminal method was $4.7\times10^3$ μΩcm. A DC current of 7V was applied for the experiment and as a result, it was stably flowed at an average current density of 5 mA/$cm^2$ for more than one day. Immediately after the initiation of electrolysis, the gas coming out from the outlet port 1B was collected in a Tedlar bag, and a fluorine gas detector tube (gas detector tube No. 17, a product of Gastec Corporation) was used for the measurement. As a result, an indicator of the detector tube was bleached to white so that it was confirmed that a fluorine gas was generated.

Example B3

The experiment was carried out in the same manner as in Example B2, except that the time required for reaching 1,300 degrees centigrade under firing conditions of the porous electrode 403 was changed to 5 hours. The half width of the G1 band of Raman spectrum of the porous electrode 403 was 61 $cm^{-1}$, the half width of a peak measured in the vicinity of 22° to 27° by XRD measurement was 7.3°, and the volume resistivity measured by the four-terminal method was $4.7\times10^3$ μΩcm. A DC current of 7V was applied for the experiment and as a result, it stably flowed at an average current density of 15 $mA/cm^2$ for more than one day. Immediately after the initiation of electrolysis, the gas coming out from the outlet port 1B was collected in a Tedlar bag, and a fluorine gas detector tube (gas detector tube No. 17, a product of Gastec Corporation) was used for the measurement. As a result, an indicator of the detector tube was bleached to white so that it was confirmed that a fluorine gas was generated.

Example B4

The experiment was carried out in the same manner as in Example B2, except that the temperature was kept at 1,300 degrees centigrade for 5 hours after reaching 1,300 degrees centigrade under firing conditions of the porous electrode 403. The half width of the G1 band of Raman spectrum of the porous electrode 403 was 60 $cm^{-1}$, the half width of a peak measured in the vicinity of 22° to 27° by XRD measurement was 7.4°, and the volume resistivity measured by the four-terminal method was $4.5\times10^3$ μΩcm. A DC current of 7V was applied for the experiment and as a result, it stably flowed at an average current density of 10 $mA/cm^2$ for more than one day. Immediately after the initiation of electrolysis, the gas coming out from the outlet port 1B was collected in a Tedlar bag, and a fluorine gas detector tube (gas detector tube No. 17, a product of Gastec Corporation) was used for the measurement. As a result, an indicator of the detector tube was bleached to white so that it was confirmed that a fluorine gas was generated.

Comparative Example B1

The experiment was carried out in the same manner as in Example B1, except that a plate which was fired in the same manner as in Example B1 without boring was used instead of the porous electrode 403. The half width of the G1 band of Raman spectrum of the carbon plate was 57 $cm^{-1}$, the half width of a peak measured in the vicinity of 22° to 27° by XRD measurement was 7.5°, and the volume resistivity measured by the four-terminal method was $6.8\times10^3$ μΩcm. A DC current of 7V was applied for the experiment and as a result, a current was flowed at a current density of 200 $mA/cm^2$ at an early stage of electrolysis, but after an hour, the current was rarely flowed.

Example C1

The experiment results will be described below using an electrolytic cell experiment device (hereinafter referred to as this experiment device) with reference to FIGS. 45 to 47.

Figure 45:
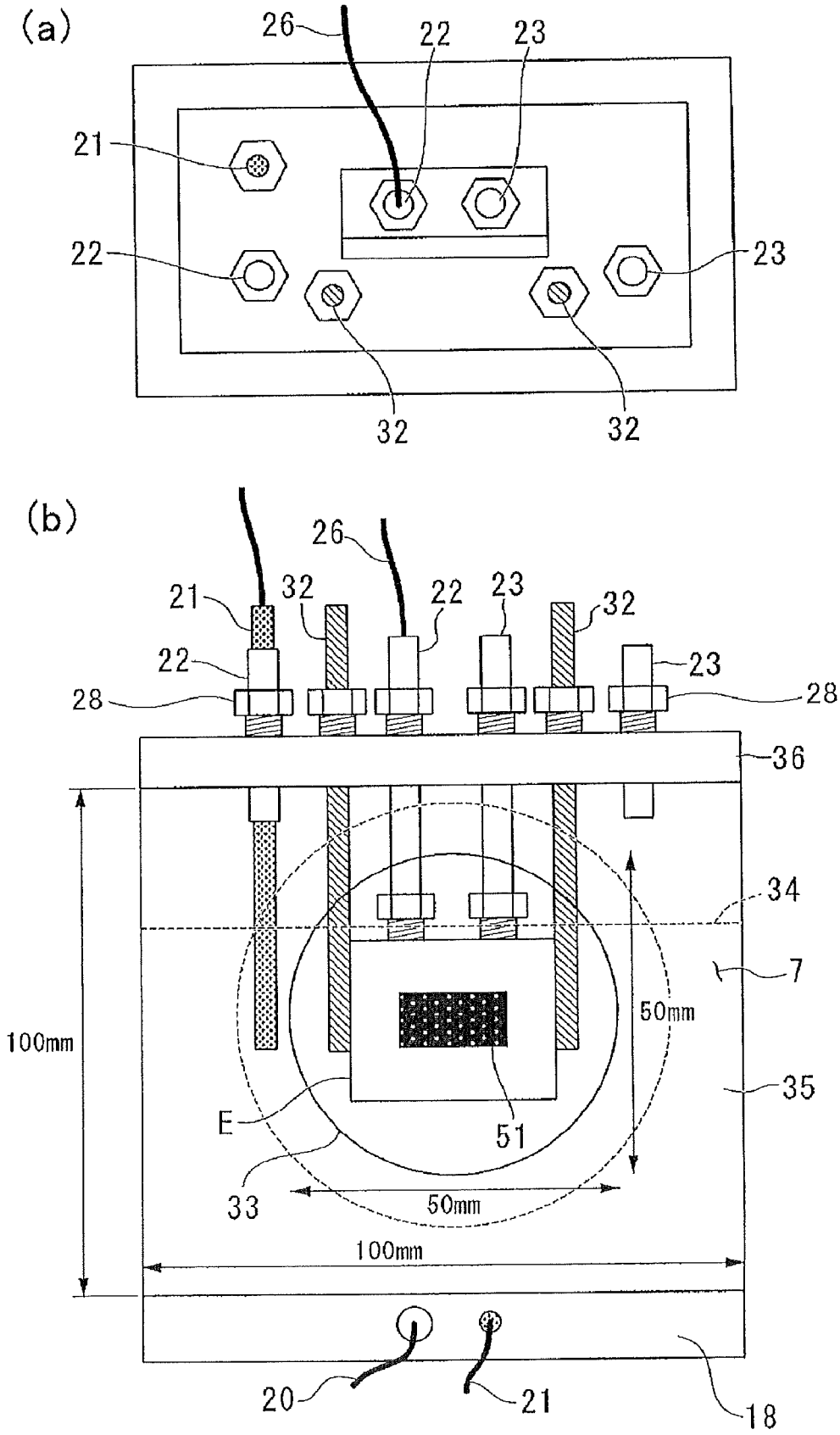
FIG. 45(*a*) is a top plan view and FIG. 45(*b*) is an elevational view of an electrolytic cell experiment device (this experiment device) in Example.

FIG. 45(*a*) is a top plan view and FIG. 45(*b*) is an elevational view of an electrolytic cell experiment device.

The electrolytic cell experiment device illustrated in FIGS. 45(*a*) and 45(*b*) was a device in which an electrolytic cell E was built into the center of a molten salt bath 35 for carrying out the electrolysis experiment. The inside of the molten salt bath 35 was transilluminated for the sake of convenience of illustration.

A plurality of Teflon (registered trademark) tubes 22, 23 including a reserve were vertically fixed by Teflon (registered trademark) joints 28 to a canopy 36 for covering the upper part of the molten salt bath 35.

As shown in FIG. 45(*b*), a rod electrode 32 was partly immersed in the electrolytic solution 7 and its upper part was outside the molten salt bath 35. The electrode 32 was connected with a cathode of a DC power source through a conductor (not shown). Furthermore, in the center of the molten salt bath 35, the electrolytic cell E was suspended from the canopy 36 and immersed in the electrolytic solution 7. Hereinafter, the electrolytic cell E will be described with reference to FIG. 46.

Figure 46:
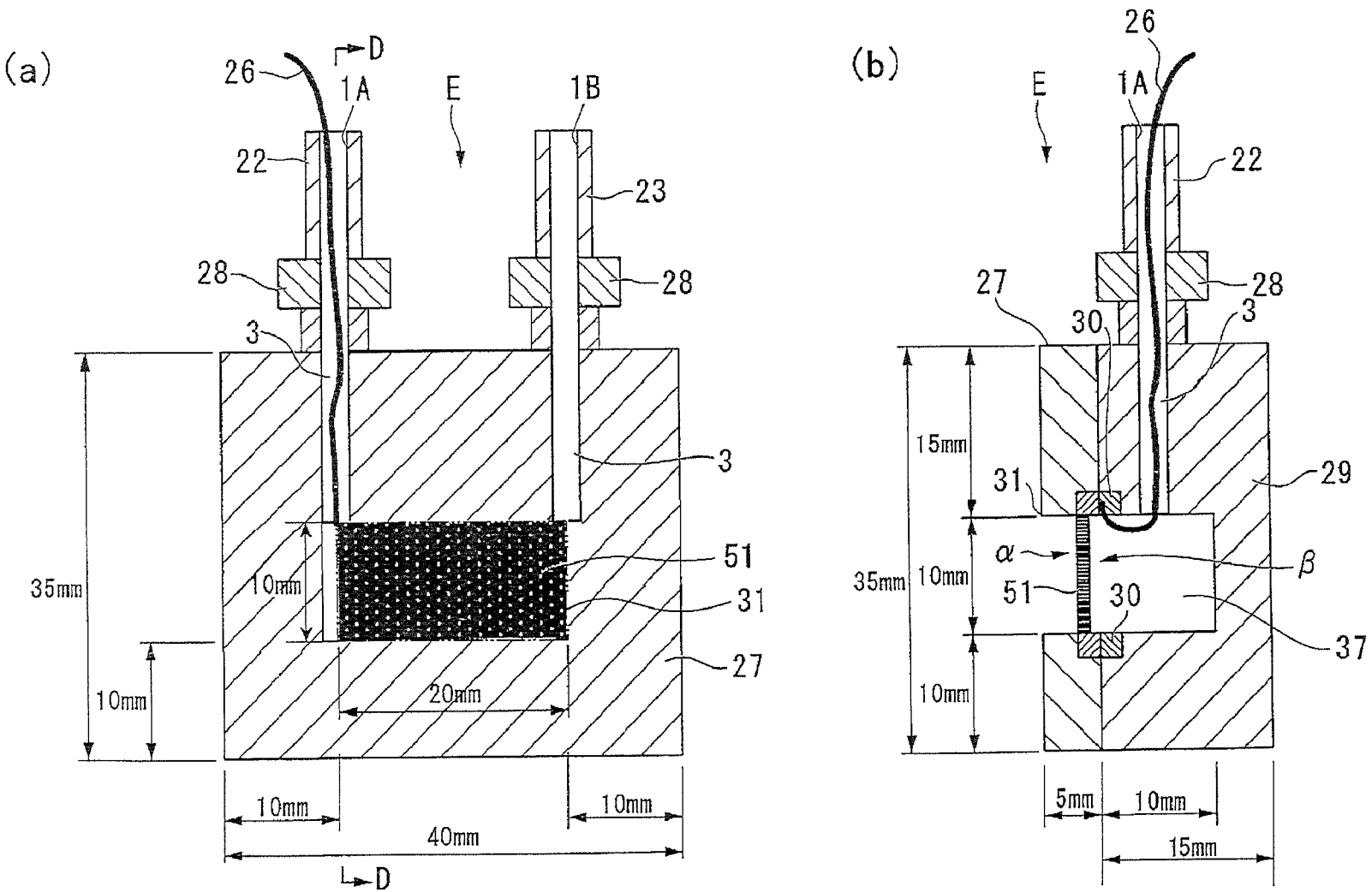
FIG. 46(*a*) is an elevational view of the electrolytic cell and 46(*b*) is its D-D sectional view in this experiment device.

FIG. 46(*a*) is a sectional view of the electrolytic cell E in this experiment device, while FIG. 46(*b*) is a D-D sectional view of FIG. 46(*a*). As shown in FIGS. 46(*a*) and 46(*b*), the electrolytic cell E was provided with an electrode 51 arranged in the front center of an electrolytic cell body 29 made of an insulating material. The electrode 51 was fixed by an electrode pressing plate 27. The gas generating surface α of the electrode 51 could be brought into contact with the electrolytic solution 7 by the electrode pressing plate 27. The electrode 51 was connected with an anode of a DC power source through a metal wire 26 (nickel wire) for electrical communication.

The electrolytic cell body 29 was composed of a PTFE plate and had a shape of 35 mm×40 mm×15 mmt. Furthermore, in the center thereof, a recessed portion 31 having a depth of 10 mm was provided. The gas releasing surface β of the electrode 51 was exposed in the inside of the recessed portion 31. Further, the electrolytic cell body 29 was provided with gas flow channels 3 arranged in the inside of Teflon (registered trademark) tubes 22, 23, and a gas could be introduced into a space 37 in the recessed portion 31 from the outside and discharged.

A recessed portion was formed in the front edge of the recessed portion 31, and a metal frame 30 for electrical communication was fitted in the recessed portion. On the other hand, the electrode 51 was fitted in the recessed portion 31 of the electrode pressing plate 27. The electrode pressing plate 27 was connected with the electrolytic cell body 29, whereby the electrode 51 was fixed to the electrolytic cell E.

A nitrogen gas was introduced into the space 37 of the recessed portion 31 by the Teflon (registered trademark) tube 22 connected with the electrolytic cell E, and released from the discharge tube 23. The gas flowing out from the discharge tube 23 could be collected for the analysis.

The negative electrode 32 was composed of two nickel rods having a diameter of 3 mm. The electrode 32 was placed near a side of the electrode 51 while avoiding the front thereof so as not to block the field of vision for observing the electrode 51, and two electrodes were arranged at the left-right symmetric positions in order to make the distance between positive and negative electrodes to be equal to each other.

A molten salt liquid surface level 34 was maintained at a height in which the electrode 51 of the electrolytic cell E was immersed in the electrolytic solution 7. Furthermore, in a state that the liquid surface of the electrolytic solution 7 remained 4 cm or more above the lowest part of the electrode 51, it was essentially required that the electrolytic solution 7 be not soaked into, permeated through and leaked out to the space 37 of the recessed portion 31 via the through holes.

The bottom of the molten salt bath 35 was configured so as to be placed by sandwiching a Teflon (registered trademark) sheet (t=0.2 mm) on a heater block 18 made of copper. The heater block 18 was provided with a rod heater 20 and a thermocouple 21 for properly heating the electrolytic solution 7 from the bottom of the molten salt bath 35. The temperature of the electrolytic solution 7 could be maintained at a prescribed temperature by feeding temperature information detected by the thermocouple 21 to a thermostat (not shown) or the like.

In present Example, in order to obtain an $F_2$ gas, the electrolytic solution containing HF was electrolyzed. In general, anhydrous HF exhibited high electrical resistance and was hard to perform electrolysis, but when, for example, KF was reacted with HF to prepare the electrolytic solution 7 of HF·nHF, electrical resistance of the electrolytic solution 7 was low so that HF in the electrolytic solution 7 could be electrolyzed.

$$2HF \rightarrow H_2 + F_2$$

In this reaction, KF was not consumed, but only HF as a raw material was consumed. Accordingly, there was a need to supply the HF gas into the electrolytic solution 7 depending on the amount of the generated $F_2$ gas. Then, the HF gas was bubbled in the electrolytic solution 7 in the electrolytic bath 35 for supplying HF to the electrolytic solution 7. The electrolytic solution 7 was heated to its melting point or more, a convection current was generated in the inside of the electrolytic bath, and the electrolytic solution 7 was further stirred along with an effect of a convection current generated by bubbling. Accordingly, HF supplied to the electrolytic solution 7 was almost uniformly diffused into the electrolytic solution 7.

Figure 47:
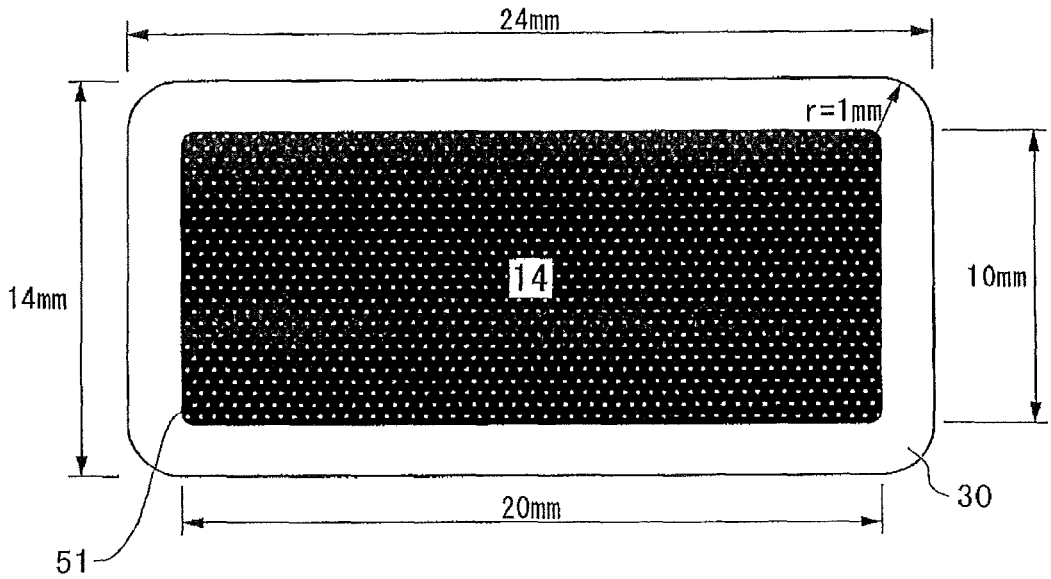
FIG. 47(*a*) is an elevational view of the electrode and FIG. 47(*b*) is an elevational view of the metal frame for electrical communication for use in the electrolytic cell in this experiment device.
Figure 47:
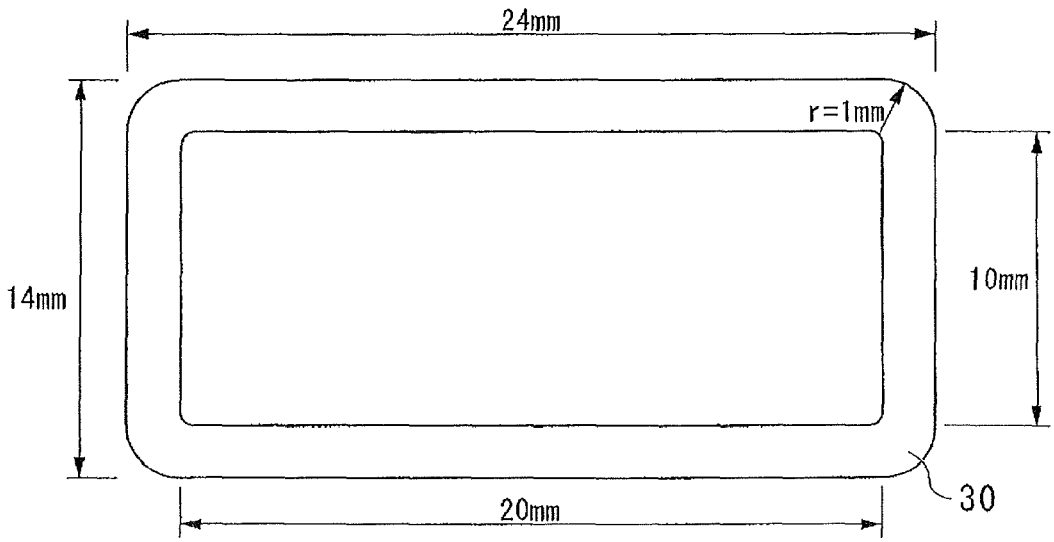

FIG. 47(*a*) is an elevational view of the electrode 51 of the electrolytic cell E in this experiment device, while FIG. 47(*b*) is an elevational view of the metal frame 30 for electrical communication. The electrode 51 shown in FIG. 47(*a*) was prepared by making a carbon plate (G348 1 mmt, a product of Tokai Carbon Co., Ltd.) at a size of 24 mm×14 mm (r=1 mm), and then forming recessed portions of a depth of 0.6 mm alone on a counterbore surface 14, and arranging through holes in the thickness direction of the carbon plate on the recessed portions of the counterbore surface 14.

As shown also in FIG. 29, the through holes 6 having a diameter of 100 μm were prepared in a 60° zig-zag form at a pitch of 150 μm using a drill (carbide solid micro drill ADR-0.1). Furthermore, the effective electrode surface area of a surface having the fine gas flow channels 112 in contact with the electrolytic solution 7 was set to 10 mm×20 mm.

As shown in FIG. 46(*b*), the metal frame 30 for electrical communication illustrated in FIG. 47(*b*) was a metal frame for electrical communication so as to support the electrode 51 and apply a positive voltage. The metal frame 30 for electrical communication was a nickel frame in which a window of 20 mm×10 mm (r=0.5 mm) was formed on the nickel plate having an outer size of 24 mm×14 mm×2 mmt (r=1 mm) by cutting process.

The metal frame 30 for electrical communication was connected to the positive power supply through the nickel wire having a diameter of 0.5 mm, that is, the metal wire 26 for electrical communication. The Teflon (registered trademark) joints 28 were arranged in the upper part of the electrolytic cell body 29, and Teflon (registered trademark) tubes 22, 23 were fixed to the Teflon (registered trademark) joints 28. The electrolytic cell E and the electrolytic cell experiment device were configured such that the metal wire 26 for electrical communication could be passed through the inside of the Teflon (registered trademark) tube 22 and brought into contact with the DC power source outside the electrolytic cell E.

In the electrolytic cell experiment device, a DC voltage of 7.0 V was applied between the electrode 51 serving as an anode and the electrode 32 serving as a cathode for carrying out constant voltage electrolysis. Nitrogen was supplied from the Teflon (registered trademark) tube 22 which is each gas flow channel inlet (inlet ports) at a flow rate of 10 mL/min. In this state, the gas generated from the electrode 51 was discharged into the space 37 of the recessed portion 31 via the through holes, and discharged from the Teflon (registered trademark) tube 23 which is each gas flow channel outlet (outlet port) along with the nitrogen gas. Incidentally, it was observed that bubbles coming up the liquid surface of the electrolytic solution 7 from the surface of the electrode 51 were not present.

Figure 48:
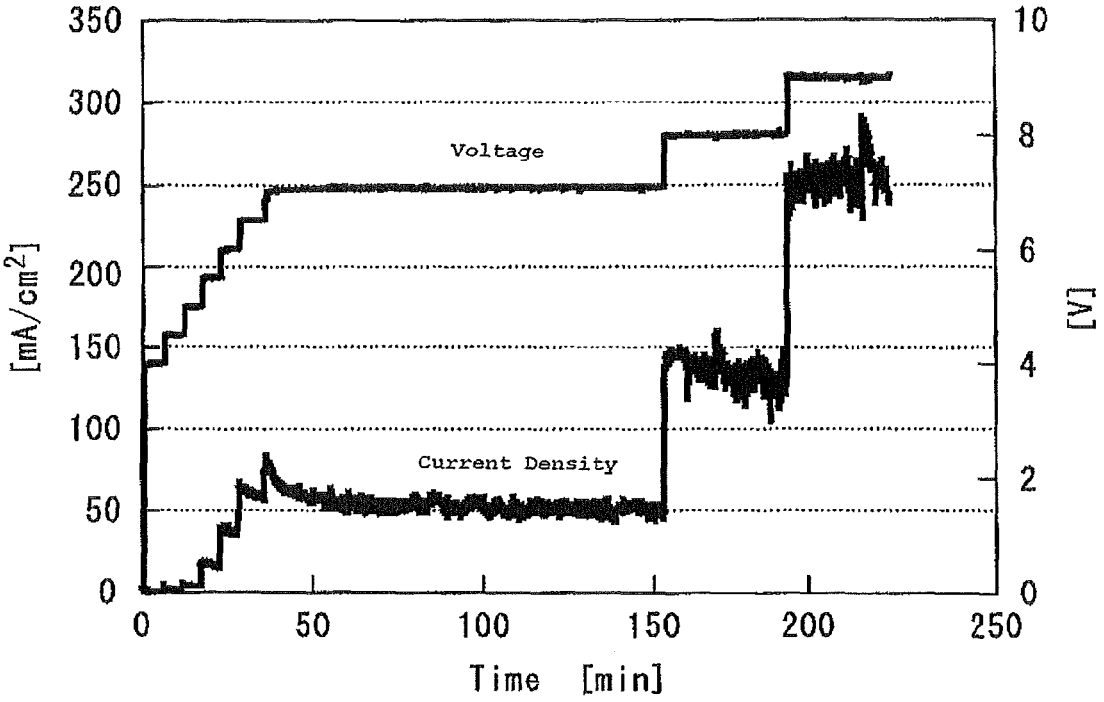
FIG. 48 is a graph showing the relationship between the time required for electrolysis and current density in Example 1.

The gas released from the gas flow channel outlet 23 (outlet port) was collected in a Tedlar bag, and a fluorine gas detector tube (Gas detector tube No. 17, a product of Gastec Corporation) was used for the measurement. As a result, an indicator of the detector tube was bleached to white so that it was confirmed that a fluorine gas was generated. As the amount of change with the time of current density, an average current density in a stable state was about 50 mA/cm$^2$. When the voltage was set to 8V, an average current density was about 120 mA/cm$^2$, while when the voltage was set to 9V, an average current density was about 250 mA/cm$^2$. FIG. 48 illustrates a graph showing the above results.

Example C2

Electrolysis was carried out in the same manner as in Example C1, except that the pitch of the through hole 6 arranged on the electrode 51 was changed to 1 mm. The liquid surface of the electrolytic solution 7 was filled up to the position of 4 cm or more above from the lowest part of the electrode 51. It was confirmed that the electrolytic solution 7 was not leaked to the space 37 of the recessed portion 31 via the through holes 6 in the same manner as in Example C1. Furthermore, when the voltage was set to 7V, an average current density in a stable state was about 80 mA/cm$^2$, while when the voltage was set to 8V, an average current density was about 150 mA/cm$^2$. When the voltage was set to 9V, an average current density was about 200 mA/cm$^2$.

Example C3

Figure 49:
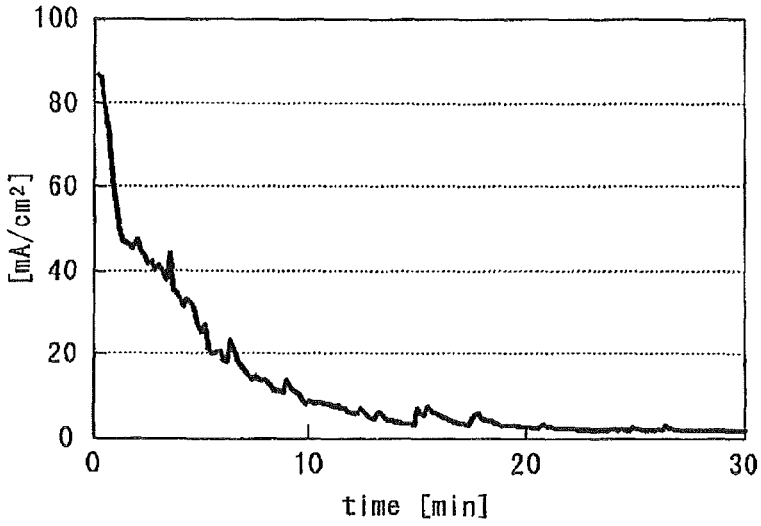
FIG. 49 is a graph showing the relationship between the time required for electrolysis and current density in Example 3.

Electrolysis was carried out in the same manner as in Example C1, except that the through holes 6 were not formed on the electrode 51. Immediately after the voltage of 7V was applied, a current was flowed at a current density of about 90 mA/cm$^2$, whereas the current was gradually decreased and rarely flowed after about 20 minutes. FIG. 49 illustrates a graph showing the above results.

Furthermore, in all of the aforementioned Examples, hydrogen fluoride was decomposed into fluorine and hydrogen by the electrolysis reaction of hydrogen fluoride which could be respectively recovered. Further, in this experiment, as a substance for the electrolysis reaction of hydrogen fluoride, the electrolytic solution containing hydrogen fluoride was exemplified. On the other hand, the electrolytic solution may be other substances.

The invention claimed is:

1. A gas generating device for generating a first gas at a first carbon electrode by applying a voltage between said first carbon electrode and a second electrode to electrolyze an electrolytic solution, wherein said first carbon electrode is an anode or a cathode, wherein said first carbon electrode is provided with a plurality of fine gas flow channels which selectively pass said first gas generated on one surface of said first carbon electrode to the other surface without allowing said electrolytic solution to permeate therethrough and wherein at least one of said first carbon electrode and said second electrode is composed of amorphous carbon, said fine gas flow channels are through holes for selectively passing gases, and the opening width of said through hole is not more than 1,000 μm.

2. The gas generating device as set forth in claim 1 for generating a second gas at said second electrode by applying a voltage between said first carbon electrode and said second electrode to electrolyze an electrolytic solution, comprising:

a liquid flow channel for allowing said electrolytic solution to flow, said first carbon electrode and said second electrode arranged on both side of said liquid flow channel to contact said electrolytic solution, a first gas storage unit for receiving said first gas which is arranged to sandwich said first carbon electrode between said liquid flow channel and said first gas storage unit, said second electrode is a second carbon electrode, a second gas storage unit for receiving said second gas which is arranged to sandwich said second carbon electrode between said liquid flow channel and the second gas storage unit, wherein said liquid flow channel is communicated with said first gas storage unit through said fine gas flow channels formed on said first carbon electrode and wherein said second carbon electrode is provided with a plurality of fine gas flow channels which selectively pass said second gas, and said liquid flow channel is communicated with said second gas storage unit through the appropriate fine gas flow channels.

3. The gas generating device as set forth in claim 2, wherein said first gas storage unit is a first gas flow channel having a gas inlet for introducing an inert gas and a gas outlet for leading out said first gas along with said inert gas, and said second gas storage unit is a second gas flow channel having a gas inlet for introducing an inert gas and a gas outlet for leading out said second gas along with said inert gas.

4. The gas generating device as set forth in claim 3, comprising a supporting substrate and a cover substrate arranged on said supporting substrate, wherein said liquid flow channel is formed of a groove for first flow channel formed on said supporting substrate and said cover substrate for covering said groove for first flow channel, said first gas storage unit and said second gas storage unit are formed of a groove for second flow channel and a groove for third flow channel respectively formed at intervals with the groove for first flow channel on both sides of said groove for first flow channel of said supporting substrate, and said cover substrate for covering said groove for second flow channel and said groove for third flow channel, said first carbon electrode is arranged in a first recessed portion for arrangement of an electrode disposed between said groove for first flow channel and said groove for second flow channel of said supporting substrate in contact therewith, and said second carbon electrode is arranged between said groove for first flow channel and said groove for third flow channel of said supporting substrate in contact therewith and disposed in the recessed portion for the second electrode arranged at a position facing to said recessed portion for arrangement of the first electrode.

5. The gas generating device as set forth in claim 2, wherein said first carbon electrode is composed of a first carbon plate with a plurality of through holes to be said fine gas flow channels arranged thereon, said second carbon electrode is composed of a second carbon plate with a plurality of through holes to be said fine gas flow channels arranged thereon, said first carbon electrode and said second carbon electrode are oppositely disposed to each other through said liquid flow channel, said first gas storage unit is provided on a back side of a surface of said first carbon plate facing to said second carbon electrode, and said second gas storage unit is provided on a back side of a surface of said second carbon plate facing to said first carbon electrode.

6. The gas generating device as set forth in claim 2, wherein a plurality of said first carbon electrodes and a plurality of said second carbon electrodes are disposed in the order of said second carbon electrode, said first carbon electrode, said first carbon electrode and said second carbon electrode, said liquid flow channel is disposed between said first carbon electrode and said second carbon electrode, and said first gas storage unit is disposed between said first carbon electrode and said first carbon electrode.

7. The gas generating device as set forth in claim 2, wherein said electrolytic solution is molten salt containing hydrogen fluoride, and wherein said first carbon electrode serving as an anode, a fluorine gas is generated at said first carbon electrode and a hydrogen gas is generated at said second carbon electrode.

8. The gas generating device as set forth in claim 1 for generating the first gas at said first carbon electrode and generating said second gas at said second electrode by applying a voltage between said first carbon electrode serving as an anode and the second electrode serving as a cathode for electrolyzing the electrolytic solution, comprising:

a liquid flow channel for allowing said electrolytic solution to flow, said first carbon electrode and said second electrode arranged to sandwich said liquid flow channel in which a facing surface is brought into contact with said electrolytic solution, a first gas storage unit for receiving said first gas arranged so as to surround the back surface of the surface of said first carbon electrode in contact with said electrolytic solution and a second gas storage unit for receiving said second gas arranged so as to surround the back surface of the surface of said second electrode in contact with said electrolytic solution, wherein said fine gas flow channels are through holes for passing gases, said liquid flow channel and said first gas storage unit are communicated with each other via said through holes for passing gases, said first gas generated on the surface of said first carbon electrode in contact with said electrolytic solution is selectively passed via said through holes for passing gases and supplied to said first gas storage unit, said second electrode is a second carbon electrode with a plurality of through holes for passing gases formed thereon which can selectively pass said second gas generated on one surface to the other surface, said liquid flow channel and said second gas storage unit are communicated with each other via said through holes for passing gases, and said second gas generated on the surface of said second carbon electrode in contact with said electrolytic solution is selectively passed via said through holes for passing gases and supplied to said second gas storage unit.

9. The gas generating device as set forth in claim 1, wherein said carbon material is obtained by firing an organic resin at a temperature of from 700 to 3,200 degrees centigrade, wherein said organic resin contains an aromatic polyimide resin or an aramid resin.

10. A process for producing a carbon electrode for gas generation for the gas generating device according to claim 1 comprising:

preparing an organic resin material, producing an organic resin film having a plurality of through holes, which selectively pass said first gas generated on one surface of said first carbon electrode to the other surface without allowing said electrolytic solution to permeate therethrough, using said organic resin material, and obtaining a carbon material by firing said organic resin film at a temperature of from 700 to 3,200 degrees centigrade.

11. The process for producing a carbon electrode for gas generation as set forth in claim 10, in which, in said producing said organic resin film having a plurality of said through holes, said through holes are formed by machining process, etching, injection molding, sandblasting or laser process.

12. A process for generating a gas using a gas generating device which is comprised of said liquid flow channel for allowing an electrolytic solution to flow, the first carbon electrode and said second electrode arranged to sandwich said liquid flow channel in which a facing surface is brought into contact with said electrolytic solution, the first gas storage unit arranged so as to surround the back of the surface of said first carbon electrode in contact with said electrolytic solution and the carbon electrode for gas generation composed of a carbon material and provided with a plurality of through holes which selectively pass the gas, wherein the opening width of said through hole is not more than 1,000 μm as said first carbon electrode, comprising flowing said electrolytic solution in said liquid flow channel, applying a voltage between said first carbon electrode and said second electrode for electrolyzing said electrolytic solution, thereby generating a first gas at said first carbon electrode, in which, in said generating said first gas, said electrolysis is continuously carried out and said first gas generated at said first carbon electrode is selectively passed via said through holes for passing gases and supplied to said first gas storage unit.

* * * * *